US006770140B2

(12) United States Patent
Ishii et al.

(10) Patent No.: US 6,770,140 B2
(45) Date of Patent: Aug. 3, 2004

(54) APPARATUS FOR HOT DIP GALVANIZING

(75) Inventors: Toshio Ishii, Fukuyama (JP); Munehiro Ishioka, Fukuyama (JP); Syu-ji Nomura, Fukuyama (JP); Yasunori Ohsaki, Fukuyama (JP); Seishi Hatakeyama, Fukuyama (JP); Kentaro Akashi, Fukuyama (JP); Ryuji Nagayama, Fukuyama (JP); Kozo Hadada, Fukuyama (JP); Yoichi Miyakawa, Kasaoka (JP); Kazuo Kunioka, Yokohama (JP); Kenji Araki, Yokohama (JP); Nobuyuki Ishida, Yokohama (JP); Keishi Yamashita, Kawasaki (JP); Teruhisa Kuwana, Yokohama (JP); Motoi Uesugi, Yokohama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/058,799

(22) Filed: Jan. 28, 2002

(65) Prior Publication Data

US 2002/0076502 A1 Jun. 20, 2002

Related U.S. Application Data

(62) Division of application No. 09/675,330, filed on Sep. 28, 2000, now Pat. No. 6,426,122, which is a continuation of application No. PCT/JP99/01664, filed on Mar. 31, 1999.

(30) Foreign Application Priority Data

| | | |
|---|---|---|
| Apr. 1, 1998 | (JP) | 10-088764 |
| Apr. 1, 1998 | (JP) | 10-088765 |
| Apr. 1, 1998 | (JP) | 10-088766 |
| Jul. 17, 1998 | (JP) | 10-202514 |
| Sep. 25, 1998 | (JP) | 10-270776 |
| Sep. 28, 1998 | (JP) | 10-273453 |
| Dec. 2, 1998 | (JP) | 10-342579 |

(51) Int. Cl.[7] ..... B05C 11/00
(52) U.S. Cl. ..... 118/602; 118/423
(58) Field of Search ..... 118/429, 419, 118/602, 603, 422, 423; 427/433, 431; 228/34, 36, 40, 56.1

(56) References Cited

U.S. PATENT DOCUMENTS

| | | | | |
|---|---|---|---|---|
| 928,385 | A | * | 7/1909 | Huxley |
| 2,721,813 | A | * | 10/1955 | Holmberg |
| 3,887,721 | A | * | 6/1975 | Schwieterman |
| 4,275,098 | A | | 6/1981 | Gunji et al. |
| 4,634,609 | A | * | 1/1987 | Fabiny et al. |
| 5,354,970 | A | * | 10/1994 | Knupfer |
| 5,558,715 | A | | 9/1996 | Abed et al. |
| 5,989,645 | A | * | 11/1999 | Flores |

FOREIGN PATENT DOCUMENTS

| | | | |
|---|---|---|---|
| JP | 57-44169 | | 3/1982 |
| JP | 4-154948 | A | 5/1992 |
| JP | 5-171388 | A | 7/1993 |
| JP | 7-207419 | A | 8/1995 |
| JP | 7-268587 | A | 10/1995 |
| JP | 7-305156 | A | 11/1995 |
| JP | 8-3707 | A | 1/1996 |
| JP | 10-72653 | A | 3/1998 |
| JP | 1112707 | * | 1/1999 |
| WO | 9929919 | * | 6/1999 |

* cited by examiner

*Primary Examiner*—Brenda A. Lamb
(74) *Attorney, Agent, or Firm*—Frishauf, Holtz, Goodman & Chick, P.C.

(57) ABSTRACT

An apparatus for galvanizing which comprises a plating tank, a dross removing tank, a means to transfer the molten metal bath from the plating tank to the dross removing tank, and an opening located on the plating tank to recycle the molten metal bath from the dross removing tank to the plating tank.

13 Claims, 35 Drawing Sheets

APPARATUS FOR HOT DIP GALVANIZING

This application is a divisional application of application Ser. No. 09/675,330 filed Sep. 28, 2000 (now U.S. Pat. No. 6,426,122), which is a continuation application of International application PCT/JP99/01664 (not published in English) filed Mar. 31, 1999.

FIELD OF THE INVENTION

The present invention relates to a method for hot-dip galvanizing and an apparatus therefor.

BACKGROUND OF THE INVENTION

Generation of surface defects on hot dip galvanized steel strip caused by dross is one of the most serious problems on the hot-dip galvanized steel strip. Dross is an intermetallic compound such as $FeZn_7$ generated from the reaction between iron and zinc which are eluted from the steel strip in a plating tank holding a zinc-base molten metal, and the dross has spherical equivalent diameters of from 5 to 300 microns. In a stagnant state of the molten metal in the plating tank, the dross deposits on the bottom of the plating tank.

However, with a natural convection of the molten metal, generated from the traveling steel strip, from the rotation of immersed rolls in the tank, or from the dissolved zinc-base ingot that supplies the consumed metal brought out along with the steel strip, the molten metal in the plating tank is agitated. As a result, the dross having less difference in specific gravity from the molten metal cannot deposit on the bottom of tank, or the once-deposited dross is stirred up to adhere the plated steel strip, thus causing the surface defects of the hot-dip galvanized steel strip.

To remove the dross, many proposals have been made. They include a method to sediment the dross by discharging the hot dip zinc bath to outside the plating tank, and a method to filter the hot dip zinc bath.

Nevertheless, those conventionally proposed methods are not brought into practical use. The reason is that these proposed technologies fail in practical application because of many problems in the complex mechanism, the durability, and the operability of commercial facilities, though they are reasonable in theory.

Regarding the methods for sedimentation separation of the dross, which have been proposed, the design emphasizes not to solidify the molten zinc during the transfer to outside the tank, and the design should take into account of the leak accident of molten zinc from the transfer piping. Consequently, the facilities increase the investment cost, which makes the facilities unrealistic ones.

As for the method to filter the dross, there appears a significant difference in the size of intermetallic compounds which can be filtered between the initial period of filtration and the point of degraded filtering performance after clogging the filter unit. As a result, the intermetallic compounds that cause the quality degradation cannot be efficiently and stably removed. Furthermore, on replacing a filter of the filter unit, dismounting and mounting the filter need an additional device that functions in the molten zinc bath, which also needs extra cost as in the case of molten zinc transfer. This also makes the facilities unrealistic ones.

In recent years, there have been proposed methods of direct removal of bottom dross immediately after the generation thereof, which methods stand on different point of view from the conventional methods. Typical examples of the methods are disclosed in JP-A-4-154948, (the term "JP-A" referred herein signifies "the Japanese Patent Laid-Open No."), (hereinafter referred to as the "Prior Art 1"), JP-A-8-3707, (hereinafter referred to as the "Prior Art 2"), and JP-A-7-268587, (hereinafter referred to as the "Prior Art 3").

The Prior Art 1 discloses a method to remove dross in a sedimentation tank installed separately from the plating tank. The characteristics of the method are that the plating tank is designed to decrease the distance between the steel strip and the tank bottom to prevent the sedimentation of the dross, that the transfer of the molten zinc from the plating tank to the sedimentation tank is conducted through a shallow flow passage to let the top dross of the plating tank flow into the sedimentation tank, and that the transfer of the molten zinc from the sedimentation tank to the plating tank is done by a pump.

The Prior Art 2 is characterized in that a flow passage to circulate the molten metal is established by placing a separation plate near an inner wall of the plating tank, that a circulation unit is mounted in the above-described flow passage to circulate the molten metal, that a heating device is mounted at inlet of the above-described flow passage to heat the molten metal to increase the size of dross to enhance the sedimentation of the dross, and that a dross recovery unit is located adjacent to the exit of the above-described flow passage to recover the sedimented dross.

The Prior Art 3 is characterized in that a plating tank having a circular bottom to plating the metal strip and a sedimentation tank to sediment and deposit the bottom dross generated in the plating bath are installed, that a connection hole is opened at near a side wall of the plating tank to let the molten metal for plating freely enter and leave between the plating bath tank and the sedimentation tank, thus the molten metal containing the dross is discharged to the sedimentation tank using the flow accompanied with the traveling steel strip to separate and sediment the bottom dross in the sedimentation tank where the flow rate is slow, and to recycle the molten metal after removed the dross to the plating tank.

According to the Prior Art 1, the suction opening for the molten zinc in the sedimentation tank has to be located at significantly below the bath level, so that the molten zinc containing sedimenting dross is sucked to the opening and transferred to the plating tank. In addition, since the transfer of the molten zinc from the sedimentation tank to the plating tank is conducted by a pump, a large amount of dross is generated in the plating tank which has a discharge opening. That is, the effect of sedimenting and removing the dross is not sufficient, and an additional problem of generation of top dross occurs.

Since the capacity of the sedimentation tank increases and since the problem of solidification and leak of molten zinc during the transfer of molten zinc between the plating and the distant sedimentation tank has not been solved, a problem of increasing investment cost and operation cost arises.

According to the Prior Art 2, the capacity of flow passage should be small as seen in an embodiment described later, so that the effect of sedimenting and removing the large amount of dross generated in the plating tank is not sufficient. Furthermore, the dross sediments and deposits in the flow passage to reduce the capacity of the flow passage, which increases the flow speed of the molten zinc. As a result, necessary sedimenting time cannot be secured, thus degrading the removal efficiency of the dross. In addition, the dross deposited in the narrow flow passage is not easily removed.

According to the Prior Art 3, since the molten zinc is discharged from the plating tank to the sedimentation tank using the flow accompanied with the traveling steel strip, the discharge flow rate cannot be controlled. Therefore, the dross in the plating tank cannot be fully discharged to the sedimentation tank, which raises a problem of accumulation and growth of the dross in the plating tank.

The Prior Art 1 and the Prior Art 3 consider only the flow of molten zinc bath in the cross sectional plane to the direction of traveling steel strip in the plating tank. FIG. 5 and FIG. 6 show schematic drawings of the distribution status of the dross deposited in the plating tank, which are derived from a water model and commercial plant data by the inventors of the present invention. FIG. 5 is a drawing viewed from cross sectional plane to the direction of traveling steel strip in the plating facility. FIG. 6 is a drawing viewed in A—A cross section of FIG. 5. In both drawings, the reference number 2 is a sink roll, and the reference number 8 is the dross.

As seen in FIGS. 5 and 6, the dross 8 deposits at the edge portion of the axial direction of the sink roll 2 and at the front and rear sides of the rotational direction thereof. That is, the flow pattern of the molten zinc between the sink roll and the inner wall surfaces of the plating tank is not a simple one which is represented by one-side cross sectional plane to the direction of traveling steel strip but complex flow in three-dimensional patterns. In many cases, the dross deposits at low flow speed portions of the molten metal, which can be seen in FIGS. 5 and 6. Consequently, it is evident that solely limiting the distance between the steel strip and the tank bottom in the cross sectional plane to the direction of traveling steel strip only changes the place of dross deposition, and the means cannot substantially solve the problem.

Therefore, the above-described Prior Arts fail to prevent the deposition of dross generating during the process of hot hip zinc-base plating and fall to efficiently remove the generated dross.

In the plating tank, the molten metal is consumed by brought out from the plating tank carried by the traveling steel strip. Normally, the make up of the consumed molten metal is done by directly dissolving a solid metal in the plating tank. In addition, it is necessary to control the temperature of the molten metal in the plating tank to a specified level. Ordinary plating tank is provided with an induction-heating device to dissolve the solid metal for plating and to control the temperature of the molten metal to a specified level even when the operating conditions vary.

The inventors of the present invention found that the directly dissolving a solid metal for plating in the plating tank varies the bath temperature in the plating tank, thus significantly enhances the generation and growth of the dross. Furthermore, the inventors found that the high temperature molten metal ejected from the induction-heating device directly contacts the steel strip entering the plating tank, which increases the elution of iron from the steel strip to increase the dross generation. The phenomenon becomes significant in smaller capacity of the plating tank.

To prevent deposition of dross in the plating tank and to efficiently remove the generated dross, it is essential to reduce the volume of generating dross considering the above-described findings. To this point, the above-described Prior Literatures lack the consideration on that point of view.

DISCLOSURE OF THE INVENTION

It is an object of the present invention to provide a method for plating, which method prevents deposition of dross generated during hot-dip galvanizing in a plating tank and which method efficiently removes the generated dross, and to provide an apparatus thereof.

To achieve the object, firstly the present invention provides a method for hot-dip galvanizing, which comprises the steps of:

- dividing a plating vessel which holds a molten metal into a plating tank located at upper portion thereof and a dross removing tank located beneath the plating tank;
- conducting hot-dip galvanizing by immersing a steel strip in a molten metal bath in the plating tank;
- transferring the molten metal bath from the plating tank to the dross removing tank;
- removing dross from the molten metal bath in the dross removing tank; and
- recycling the molten metal bath from the dross removing tank to the plating tank through an opening on the plating tank.

The method for hot-dip galvanizing preferably further comprises the step of dissolving a solid phase metal being used for plating in the dross removing tank.

The step of transferring the molten metal bath to the dross removing tank preferably comprises the transferring the molten metal bath from the plating tank to the dross removing tank using a mechanical pump. The step of transferring the molten metal bath to the dross removing tank preferably comprises the transferring the molten metal bath from the plating tank to the dross removing tank by sucking up thereof at bottom center portion of the plating tank.

The step of recycling the molten metal bath to the plating tank preferably comprises the returning the molten metal bath containing a supernatant after removed the dross to the plating tank through an opening of the plating tank. The step of recycling the molten metal bath to the plating tank preferably comprises the returning the molten metal bath from the dross removing tank to the plating tank through a side wall of the plating tank, which side wall is located at exit side of the steel strip and has a height lower than the surface level of the molten metal bath.

The plating tank and the dross removing tank preferably satisfy the relation of $W1 \leqq 10\ m^3$ and $W1 \leqq W2$, (W1 is the capacity of the plating tank, and W2 is the capacity of the dross removing tank), and the flow rate of molten metal bath being transferred from the plating tank to the dross removing tank is in a range of from 1 to 10 $m^3$/hour.

The step of conducting the hot dip galvanizing is preferably performed in an arrangement that side walls and bottom portion wall are allotted so as the distance between the steel strip and the side walls of the plating tank and between the steel strip and the bottom portion wall of the plating tank is in a range of from 200 to 500 mm.

Secondly, the present invention provides an apparatus for hot-dip galvanizing, which comprises:

- a plating vessel which holds a molten metal;
- a plating tank which is located at upper portion of the plating vessel and conducts the hot-dip galvanizing by immersing a steel strip thereinto;
- a dross removing tank which is located at lower portion of the plating vessel and which removes dross from the molten metal;
- a transfer means which transfers a molten metal bath in the plating tank to the dross removing tank; and
- an opening positioned on the plating tank to recycle the molten metal bath from the dross removing tank to the plating tank.

The transfer means is preferably a mechanical pump. The suction opening of the mechanical pump to suck the molten metal is positioned at bottom center portion of the plating tank.

The apparatus for hot-dip galvanizing preferably further comprises a dissolving means to dissolve a solid phase metal being used for plating in the dross removing tank.

The opening is preferably positioned so as the supernatant bath after removed the dross in the dross removing tank to be able to recycle to the plating tank.

The plating tank may have a side wall which is located at exit side of the steel strip and which has a height lower than the surface level of the molten metal bath, and wherein the molten metal bath is recycled from the dross removing tank to the plating tank through the side wall.

The plating tank and dross removing tank preferably satisfy the relation of W1≦10 $m^3$ and W1≦W2, (W1 is the capacity of the plating tank, and W2 is the capacity of the dross removing tank), and wherein the mechanical pump is able to transfer the molten metal bath at a flow rate in a range of from 1 to 10 $m^3$/hour.

The plating tank preferably has side walls and bottom portion wall, and these walls are preferably allotted so as the distance between the steel strip and the side wall of the plating tank and between the steel strip and the bottom portion wall of the plating tank is in a range of from 200 to 500 mm. The plating tank preferably has a pipe to fix the bottom portion, through which pipe the draining is conducted.

Thirdly, the present invention provides a method for hot-dip galvanizing, which comprises the steps of:

locating a separation wall inside of a plating tank which holds a molten metal to divide the plating tank into a plating zone where a steel strip is subjected to hot-dip plating, and a dross removing zone where dross in a molten metal bath is removed;

plating the steel strip in the plating zone;

transferring the molten metal bath in the plating zone to the dross removing zone;

removing the dross from the molten metal bath in the dross removing zone; and recycling a supernatant bath after removed the dross in the dross removing zone by locating a weir on the separation wall.

The step of transferring the molten metal bath to the dross removing zone preferably comprises the transferring the molten metal bath from the plating zone to the dross removing zone using a mechanical pump.

The method for hot-dip galvanizing preferably further comprises a heating device in the dross removing zone to conduct heating control so as the temperature of the molten metal bath in the plating zone to become a predetermined level.

The plating zone preferably has a molten metal bath capacity of W1, and the dross removing zone has a molten metal bath capacity of W2, wherein W1/W2 is in a range of from 0.2 to 5.

Fourthly, the prevent invention provides a method for hot-dip galvanizing, which comprises the steps of:

arranging a separation wall inside of a plating tank which holds a molten metal to divide the plating tank into a plating zone where a steel strip is subjected to hot-dip plating, a first dross removing zone and a second dross removing zone, where a dross in a molten metal bath is removed in the first dross removing zone and the second dross removing zone;

mounting a first mechanical pump to transfer the molten metal bath from the plating zone to the first dross removing zone and locating a weir to recycle the molten metal bath to the plating zone;

mounting a second mechanical pump to transfer the molten metal bath from the plating zone to the second dross removing zone and locating a weir to recycle the molten metal bath to the plating zone;

plating the steel strip in the plating zone;

removing the dross by transferring the molten metal bath from the plating zone to the first dross removing zone using the first mechanical pump; and discharging the dross deposited in the second dross removing zone to outside the plating tank by stopping the mechanical pump in the second dross removing zone.

Fifthly, the present invention provides an apparatus for hot-dip galvanizing, which comprises:

a plating tank which holds a molten metal;

a separation wall located in the plating tank to divide the plating tank into a plating zone where a steel strip is subjected to hot-dip plating, and a dross removing zone where dross from a molten metal bath is removed;

a mechanical pump which transfers the molten metal bath from the plating zone to the dross removing zone; and a weir located to the separation wall to transfer a supernatant bath of the molten metal bath after removed the dross in the dross removing zone to the plating zone.

The apparatus for hot-dip galvanizing preferably further comprises a heating device which is located in the dross removing zone and which controls the temperature of molten metal bath by heating thereof.

The plating zone preferably has a molten metal bath capacity of W1, and the dross removing zone has a molten metal bath capacity of W2, wherein W1/W2 is in a range of from 0.2 to 5.

Sixthly, the present invention provides an apparatus for hot-dip galvanizing, which comprises:

a plating tank which holds a molten metal;

a separation wall located in the plating tank to divide the plating tank into a plating zone where a steel strip is subjected to hot-dip plating, and a dross removing zone where dross in the molten metal bath is removed;

the dross removing zone comprising a first dross removing zone and a second dross removing zone;

a first mechanical pump which transfers the molten metal bath from the plating zone to the first dross removing zone;

a second mechanical pump which transfers the molten metal bath from the plating zone to the second dross removing zone;

a first weir located to the separation wall to transfer a supernatant bath of the molten metal bath after removed the dross in the first dross removing zone to the plating zone; and a second weir located to the separation plate to transfer a supernatant bath of the molten metal bath after removed the dross in the second dross removing zone to the plating zone.

Seventhly, the present invention provides a method for hot-dip galvanizing, which comprises the steps of:

arranging a separation wall inside of a plating tank which holds a molten metal to divide the plating tank into a plating zone where a steel strip is subjected to hot-dip plating, and a dross removing zone where dross in a molten metal bath is removed;

continuously plating the steel strip in the plating zone using a sink roll;

transferring the molten metal bath above the sink roll in the plating zone to the dross removing zone using a mechanical pump;

removing the dross from the molten metal bath in the dross removing zone; and recycling a supernatant bath after removed the dross in the dross removing zone to the plating zone via a weir located on the separation wall.

The method for hot-dip galvanizing preferably further comprises a step of locating a heating device in the dross removing zone to conduct heating control so as the temperature of the molten metal bath in the plating zone to become a predetermined level.

The plating zone preferably has a molten metal bath capacity of W1, and the dross removing zone has a molten metal bath capacity of W2, wherein W1/W2 is in a range of from 0.2 to 5.

Eighthly, the present invention provides an apparatus for hot-dip galvanizing, which comprises:

a plating tank which holds a molten metal;

a sink roll which makes a steel strip immerse in and travel through the molten metal;

a separation wall located in the plating tank to divide the plating tank into a plating zone where the steel strip is subjected to hot-dip plating, and a dross removing zone where dross in the molten metal bath is removed;

a mechanical pump which transfers the molten metal bath above a sink roll in the plating zone to the dross removing zone; and a weir located on the separation wall to transfer a supernatant bath of the molten metal bath after removed the dross in the dross removing zone to the plating zone.

The apparatus for hot-dip galvanizing preferably further comprises a heating device which is located in the dross removing zone and which controls the temperature of the molten metal bath by heating thereof.

The plating zone preferably has a molten metal bath capacity of W1, and the dross removing zone has a molten metal bath capacity of W2, wherein W1/W2 is in a range of from 0.2 to 5.

Ninthly, the present invention provides a method for hot-dip galvanizing, which comprises the steps of:

locating a sink roll which guides a steel strip traveled through a snout into a plating vessel which holds a molten metal;

separating the plating vessel into a plating zone and a dross removing zone by locating a plating tank so as to cover the sink roll, and by locating a shielding member to shield a gap formed between a lower portion of the snout beneath the steel strip and an upper portion of the plating tank;

conducting hot-dip galvanizing by immersing the steel strip in the plating zone;

removing dross from a molten metal bath in the plating zone by discharging the molten metal bath from the plating zone to the dross removing zone using a mechanical pump; and recycling the molten metal bath from the dross removing zone to the plating zone.

The plating tank is preferably located so as the upper end of the plating tank to become higher than the level of a rotary shaft of the sink roll.

Tenthly, the present invention provides an apparatus for hot-dip galvanizing, which comprises:

a snout through which a steel strip travels;

a plating vessel which holds a molten metal, which plating vessel has a sink roll to guide the steel strip traveled through the snout;

a plating zone to conduct hot-dip galvanizing by immersing the steel strip thereinto and a dross removing zone to remove dross from a molten metal bath, which zones are formed by locating a shielding member to shield a gap formed between a lower portion of the snout beneath the steel strip and an upper portion of a side wall of the plating tank; and a mechanical pump to discharge the molten metal bath from the plating zone to the dross removing zone and also to recycle the molten metal bath from the dross removing zone to the plating zone.

The plating tank is preferably located so as the upper end of the plating tank to become higher than the level of a rotary shaft of the sink roll.

Eleventhly, the present invention provides an apparatus for hot-dip galvanizing, which comprises:

a plating bath tank which holds a hot-dip galvanizing bath containing aluminum at contents of 0.05 wt. % or more;

a snout through which a steel strip immersed in the plating bath tank travels;

a plating tank which conducts plating and a dross removing tank which separates dross by sedimenting the dross, both of which tanks are formed by locating a separation wall in the plating bath tank;

a snout cleaning device to connect the plating tank and the dross removing tank at directly below the snout and at a part of exit of the steel strip so as a connecting passage to have 0.1 meter or more hydraulic diameter defined by a formula given below and so as the bath levels of both tanks to become equal to each other, to suck the plating bath in the snout by a pump from both longitudinal edges of the snout to discharge the sucked bath to a portion where no steel strip travels, thus cleaning the plating bath surface in the snout, and to circulate the plating bath between the plating tank and the dross removing tank; wherein the hydraulic diameter is defined as $$\text{Hydraulic diameter}=\{(\text{Cross sectional area of flow passage})/(\text{Wet length of flow passage})\}\times 4.$$

The capacity of the plating tank is preferably not more than 10 $m^3$, and the capacity of the dross removing tank is not more than 10 $m^3$.

Twelfthly, the present invention provides a method for hot-dip galvanizing, which comprises the steps of:

locating a separation wall in a plating bath tank which holds a hot-dip galvanizing bath containing aluminum in an amount of 0.05 wt. % or more to divide the plating bath tank into a plating tank which conducts plating and a dross removing tank which dissolves an ingot and which separates dross by sedimenting thereof;

connecting the plating tank and the dross removing tank at directly below the snout and at a part of exit of the steel strip so as a connecting passage to have 0.1 meter or more hydraulic diameter defined by a formula given below and so as the bath levels of both tanks to become equal to each other, and sucking the plating bath in the snout by a pump from both longitudinal edges of the snout to discharge the sucked bath to a portion where no steel strip travels, thus cleaning the plating bath surface in the snout and circulating the plating bath between the plating tank and the dross removing tank, wherein the hydraulic diameter is defined as Hydraulic diameter={(Cross sectional area of flow passage)/(Wet length of flow passage)}×4.

The capacity of the plating tank is preferably 10 $m^3$ or less, the capacity of the dross removing tank is 10 $m^3$ or more, the circulation flow rate of the plating bath between the plating tank and the dross removing tank is between 0.5 and 5 $m^3$/hour.

Thirteenthly, the present invention provides an apparatus for hot-dip galvanizing, which comprises:

a molten zinc tank which holds a molten zinc and has a heating means for heating the molten zinc;

a sink roll which is immersed in the molten zinc in the molten zinc tank and around which a steel strip is wound;

a vessel which holds the sink roll therein and comprises side panels and a bottom panel, while opening the upper end thereof;

whereby hot-dip galvanizing is performed to a continuously fed steel plate in the molten zinc tank.

The heating means of the molten zinc tank preferably conducts coreless induction heating.

The vessel preferably keeps gaps of from 200 to 500 mm between the vessel walls and the steel strip traveling through the vessel, the sink roll, and a jig to fix the sink roll.

The apparatus for hot-dip galvanizing further comprises a cover which substantially covers the lower surface of the steel strip being immersed in the molten zinc in the molten zinc tank until the steel strip reaches the vessel.

The vessel preferably has a curved face at joints of the side plates and the bottom plate.

The vessel preferably has a discharge opening at the bottom thereof to discharge the molten zinc, through which discharge opening the molten zinc is forcefully discharged into the molten zinc tank.

Fourteenthly, the present invention provides a method for hot-dip galvanizing, which comprises the steps of:

dividing a plating vessel which holds a molten metal into a dross removing tank and a plating tank which is located in the dross removing tank;

conducting hot-dip galvanizing by immersing a steel strip in a molten metal bath in the plating tank;

transferring the molten metal bath from the plating tank to the dross removing tank using a mechanical pump and using a flow accompanied with the traveling steel strip appeared at a first opening;

removing a dross from the molten metal bath in the dross removing tank; and recycling the molten metal bath from the dross removing tank to the plating tank via a second opening located on the plating tank.

The plating tank preferably keeps gaps of from 200 to 500 mm between the walls of plating tank and the steel strip, and between the walls of plating tank and the sink roll in the bath, and wherein the plating tank and the dross removing tank preferably satisfy the relation of W1≦10 $m^3$ and W1≦W2, (W1 is the capacity of the plating tank, and W2 is the capacity of the dross removing tank), and the flow rate of molten metal bath being transferred from the plating tank to the dross removing tank is preferably in a range of from 1 to 10 $m^3$/h.

Fifteenthly, the present invention is to provide an apparatus for hot-dip galvanizing, which comprises:

a plating vessel which holds a molten metal, wherein the plating vessel comprises a dross removing tank which removes dross from the molten metal, and a plating tank which is located in the dross removing tank and which conducts hot-dip galvanizing to a steel strip;

a transfer means which transfers a molten metal bath from the plating tank to the dross removing tank;

a first opening which is located at the plating tank and functions to transfer the molten metal bath from the plating tank to the dross removing tank using a flow accompanied with the traveling steel strip; and a second opening which is located at the plating tank and which functions to recycle the molten metal bath from the dross removing tank to the plating tank.

The plating tank preferably keeps gaps of from 200 to 500 mm between the walls of plating tank and the steel strip, and between the walls of plating tank and the sink roll in the bath, and wherein the plating tank and the dross removing tank preferably satisfy the relation of W1≦10 $m^3$ and W1≦W2, (W1 is the capacity of the plating tank, and W2 is the capacity of the dross removing tank).

BRIEF DESCRIPTION OF THE DRAWINGS

FIG. 1(*a*) is the plan view, and FIG. 1(*b*) is the cross sectional view taken along A—A line of FIG. 1(*a*).

FIG. 10(*a*) is the plan view. FIG. 10(*b*) is the cross sectional view taken along A—A line of FIG. 10(*a*).

FIG. 15(*a*) is the plan view. FIG. 15(*b*) is the cross sectional view taken along A—A line of FIG. 15(*a*).

FIG. 17(*a*) is the cross sectional view taken along A—A line. FIG. 17(*b*) is the cross sectional view taken along B—B line. FIG. 17(*c*) is the cross sectional view taken along C—C line.

FIG. 21(*a*) is the plan view. FIG. 21(*b*) is the cross sectional view along A—A line of FIG. 21(*a*). FIG. 21(*c*) is the cross sectional view along B—B line of FIG. 21(*a*).

FIG. 23(*a*) is the cross sectional view along A—A line. FIG. 23(*b*) is the cross sectional view along B—B line. FIG. 23(*c*) is the cross sectional view along C—C line.

FIG. 24(*a*) is the plan view. FIG. 24(*b*) is the cross sectional view along A—A line of FIG. 24(*a*). FIG. 24(*c*) is the cross sectional view along B—B line of FIG. 24(*a*).

FIG. 44(*a*) shows the first opening shape. FIG. 44(*b*) shows the second opening shape. FIG. 44(*c*) shows the third opening shape.

FIG. 48(*a*) shows the front view. FIG. 48(*b*) shows the cross sectional view taken along A—A line of FIG. 48(*a*).

BEST MODE FOR CARRYING OUT THE INVENTION

Best mode 1

Figure 1A:
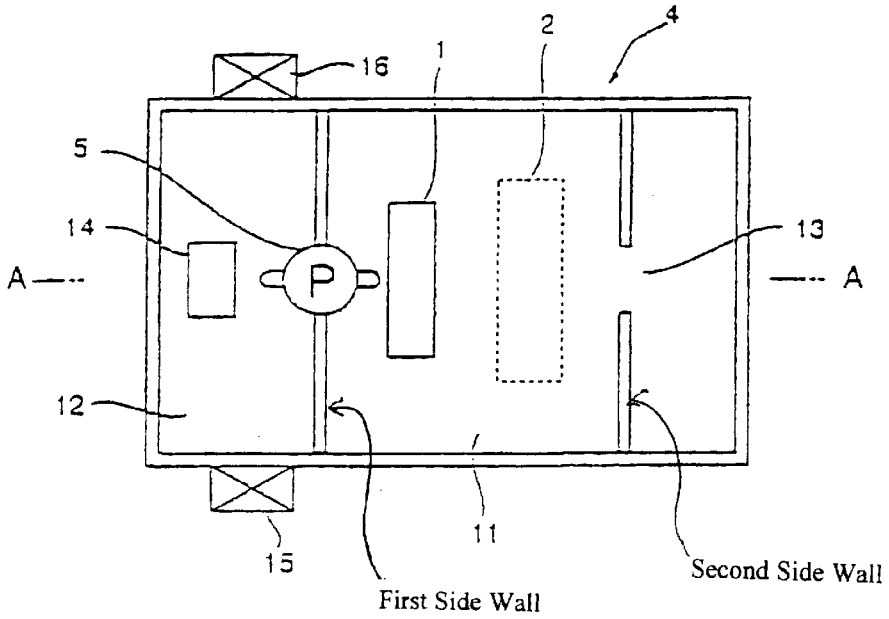
FIG. 1 shows an apparatus for hot-dip galvanizing according to the Best Mode 1.

The characteristic concept of the present invention is described below.

1) Basically, dross is removed by sedimentation. To do this, the sedimentation tank has a large capacity.
2) In the plating tank, the contained liquid is exchanged before the dross grows to a harmful size. To do this, the plating tank preferably has a minimum capacity.
3) The charge of raw material zinc to the plating tank is in a form of liquid zinc, not in a form of solid zinc. The reason is to prevent enhancement of dross growth caused from variations of temperature of bath in the plating tank.
4) The charge of raw material zinc is done by dissolving a solid zinc (an ingot) in the sedimentation tank. The reason is to enhance dross growth using the bath temperature variations in the vicinity of the dissolving zone of solid zinc. The sedimentation tank essentially has a heating device.
5) The charge of molten zinc from the sedimentation tank to the plating tank is conducted in a very mild flow mode to suppress the generation of top dross. If any flow to entrap air appears on the bath surface, the top dross is vigorously generated. The required condition is established by connecting the sedimentation tank with the plating tank at an opening to make the liquid level of both tanks equal.

6) The discharge of molten zinc from the sedimentation tank after removed dross is most preferably done by a flow including the liquid surface zone in the sedimentation tank. The condition is satisfied by locating the opening at upper zone as far as possible.

7) The above-listed requirements are satisfied by dividing a single vessel into an upper zone for plating tank and a lower zone for dross removing tank. The means is to simplify the facilities, to stabilize the operation, to reduce the investment cost, and to reduce the space of apparatus.

The present invention is based on the above-described concept, and the essentials of the Best Mode 1 are described below.

The first embodiment is a method for hot-dip galvanizing characterized in that, on conducting hot-dip galvanizing continuously to a steel strip by immersing the steel strip in a plating vessel which contains a molten metal, the plating vessel is divided into the plating tank at upper zone and the dross removing tank at lower zone thereof, thus the steel strip is immersed in the plating tank to conduct the hot-dip galvanizing, then the molten metal bath in the plating tank is transferred to the dross removing tank using a mechanical pump, thus removing the dross from the molten metal bath in the dross removing tank, and dissolving a solid phase metal for plating, further the molten metal bath in the dross removing tank is recycled to the plating tank through an opening located on the plating tank.

The second embodiment is the method for hot-dip galvanizing described in the first embodiment, which method is characterized in that the molten metal bath recycled from the dross removing tank to the plating tank contains a supernatant bath after removed the dross.

The third embodiment is the method for hot-dip galvanizing described in the first embodiment or the second embodiment, which method is characterized in that the plating tank and the dross removing tank satisfy the relation of W1≦10 $m^3$ and W1≦W2, (W1 is the capacity of the plating tank, and W2 is the capacity of the dross removing tank), and the flow rate of molten metal bath being transferred from the plating tank to the dross removing tank is in a range of from 1 to 10 $m^3$/h.

The fourth embodiment is an apparatus for hot-dip galvanizing continuously to a steel strip by immersing the steel strip in a plating vessel which contains a molten metal, which apparatus is characterized in that the plating vessel is divided into the plating tank at upper zone and the dross removing tank at lower zone thereof, thus the steel strip is immersed in the plating tank to conduct the hot-dip galvanizing, while removing the dross from the molten metal bath in the dross removing tank, and dissolving a solid phase metal for plating in the dross removing tank, that a mechanical pump is installed to transfer the molten metal bath from the plating tank to the dross removing tank, and that an opening is located on the plating tank to recycle the molten metal bath from the dross removing tank to the plating tank.

The fifth embodiment is the apparatus for hot-dip galvanizing described in the fourth embodiment, which apparatus is characterized in that an opening is located on the plating tank so as the molten metal bath containing a supernatant bath after removed the dross to recycle to the plating tank.

The sixth embodiment is the apparatus for hot-dip galvanizing described in the fourth embodiment or the fifth embodiment, which apparatus is characterized in that the plating tank and the dross removing tank satisfy the relation of W1≦10 $m^3$ and W1≦W2, (W1 is the capacity of the plating tank, and W2 is the capacity of the dross removing tank), and the flow rate of molten metal bath being transferred from the plating tank to the dross removing tank is in a range of from 1 to 10 $m^3$/h.

According to the Best Mode 1, the make up of zinc which was brought out by adhesion to the steel strip, or the dissolving solid phase zinc (ingot), is done in the dross removing tank located beneath the plating tank. Consequently, the variations of temperature of the molten metal bath (melt) in the plating tank become less, thus reducing the generated amount of the dross in the plating tank.

Since the melt containing dross in the plating tank is transferred to the dross removing tank using a mechanical pump, there occurs no problem of quality and operation, such as generation of fume and top dross, which are observed in the case of using a gas lift pump. In addition, the use of mechanical pump improves unstable transfer of the melt utilizing the flow accompanied with the traveling steel strip, and assures the transfer of melt from a portion of high concentration of dross to the dross removing tank at a necessary flow rate.

Inside of the dross removing tank, no agitation occurs caused from the traveling steel strip, so that the flow becomes calm to enhance the sedimentation of the dross. Furthermore, dissolving an ingot in the dross removing tank enhances the sedimentation and removal of dross owing to the reduction of local melt temperature and to the changes in aluminum concentration. With these two actions, the dross is efficiently and promptly removed in the dross removing tank.

The dross is removed in the dross removing tank. The cleaned melt is preferentially recycled to the plating tank through the opening on the plating tank. Since the melt flows with very little flow resistance, there appears very little difference in liquid level between the plating tank and the dross removing tank. As a result, when the melt returns to the plating tank, very little top dross is generated.

When the opening is located at upper part as far as possible so as the supernatant bath after removed the dross in the dross removing tank to be recycled, the supernatant bath in the vicinity of the bath surface zone where the cleanliness is superior is preferentially recycled to the plating tank.

The apparatus of the Best Mode 1 is a simple one only dividing a plating vessel into a plating tank at upper zone and a dross removing tank at lower zone. Accordingly, the apparatus solves several problems such as the investment cost problem accompanied with melt transfer to a distant tank, and the problems of solidification and leak of melt.

Under the conditions that the plating tank and the dross removing tank satisfy the relation of W1≦10 $m^3$ and W1≦W2, (W1 is the capacity of the plating tank, and W2 is the capacity of the dross removing tank), and the flow rate of molten metal bath being transferred from the plating tank to the dross removing tank is in a range of from 1 to 10 $m^3$/h, the dross deposition at a stagnant melt flow zone in the plating tank is prevented, and the once-generated dross is efficiently removed in the dross removing tank.

Figure 1B:
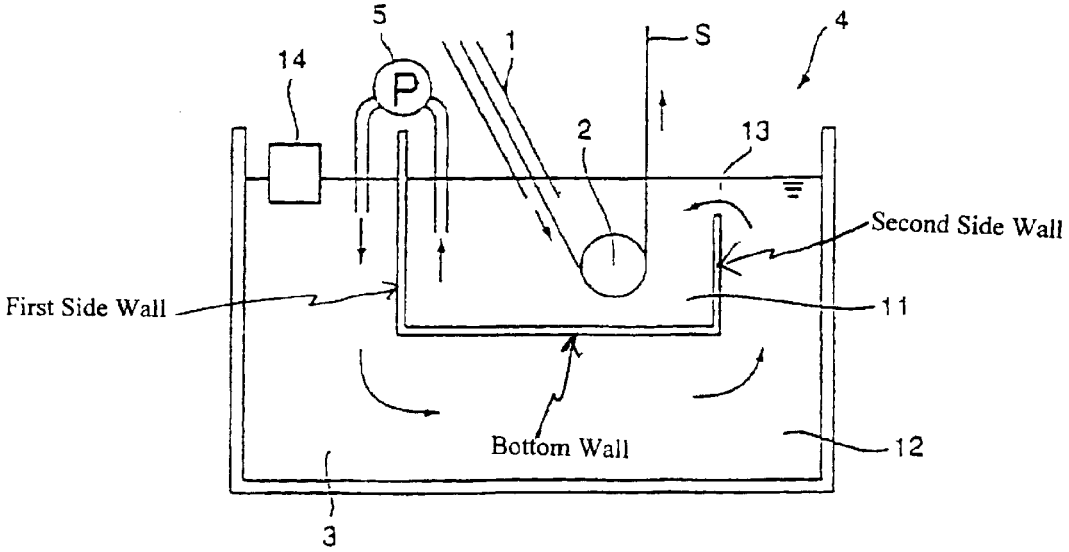
Figure 2:
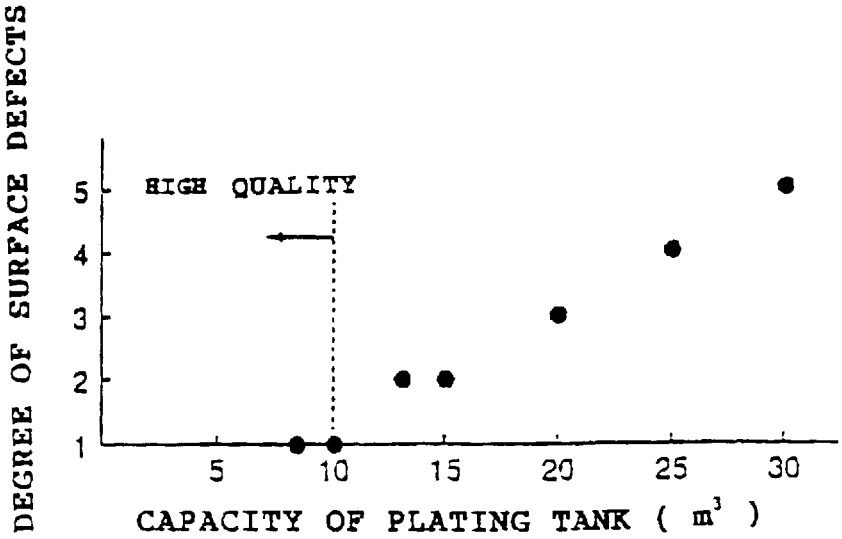
FIG. 2 shows the relation between the capacity of plating tank and the degree of surface defects on the apparatus for hot-dip galvanizing of FIG. 1.

The Best Mode 1 is described in detail referring to FIGS. 1 and 2. FIG. 1 shows a apparatus for hot-dip galvanizing according to the Best Mode 1. FIG. 1(*a*) is the plan view, and FIG. 1(*b*) is the cross sectional view along A—A line of FIG. 1(*a*).

In both figures, the reference number 1 is the snout, 2 is the sink roll, 3 is the molten metal bath (melt), and 4 is the plating vessel. The plating vessel 4 is divided into the plating tank 11 which conducts plating the steel strip S, and the dross removing tank 12 which is located beneath the plating tank 11 and which conducts sedimentation and removal of dross and further dissolves an ingot 14. The reference number 5 is the mechanical pump, and 13 is the opening located on the plating tank 11.

The steel strip S travels in the arrow direction to enter from the snout 1 to the plating tank 11, then turns the traveling direction around the sink roll 2, and is pulled up from the molten metal bath 3. After being adjusted the coating weight in a coating weight controller (not shown), the steel strip S is cooled and subjected to specified post-treatment to become a plated steel strip.

The melt 3 containing dross in the plating tank 11 is transferred to the dross removing tank by the mechanical pump 5. The dross is sedimented and removed in the dross removing tank 12. The melt 3 is recycled to the plating tank 11 via the opening 13. The flow rate of melt which is transferred by the mechanical pump 5 is the recycle rate of the melt 3 between the plating tank 11 and the dross removing tank 12.

A pair of heating devices (induction heating devices) 15, 16 are located at the dross removing tank 12. The temperature of melt in the plating tank 11 is determined by the heat of melt 3 recycled from the dross removing tank 12 and by the temperature of steel strip S entering the plating tank 11.

The apparatus has no heating device in the plating tank 11, and the temperature control of the melt in the plating tank 11 is conducted by the heating devices 15, 16 located at the dross removing tank 12. When an ingot 14 is charged in the dross removing tank 12 the temperature of melt flowing into the plating tank 11 through the opening 13 is controlled to a specified level by adequately functioning the heating devices 15, 16.

Since the ingot 14 is not dissolved in the plating tank 11, the temperature variations of the melt 3 in the plating tank 11 become minimum. Since the temperature control of the melt 3 in the plating tank 11 is done by the heating devices 15, 16 of the dross removing tank 11, the hot melt 3 ejected from the induction heating devices does not contact the steel strip S. As a result, the elution of iron from the steel strip S is suppressed, and the generation of dross in the plating tank 12 is reduced.

A ceramics mechanical pump 5 for transferring the melt 3 from the plating tank 11 to the dross removing tank 12 is mounted to the plating vessel 4. Since the plating tank 11 and the dross removing tank 12 are adjacent to each other, the transfer distance of the melt 3 is short, and the problems of solidification and leak of the melt 3 during transfer are substantially solved. In addition, the melt 3 is transferred from the specified zone in the plating tank 11 to the dross removing tank 12 at a necessary amount.

The mechanical pump means a pump such as a volute pump (centrifugal pump), a turbine pump, and a displacement pump, which transfers melt directly contacting the melt to working parts of the pump. The mechanical pump described here does not include a gas lift pump.

In the dross removing tank 12, the ingot 14 is dissolved, and the bottom dross is sedimented to remove. In the dross removing tank 12, the flow of melt 3 is uniformized. Adding to the functions, the local melt temperature reduction and the variations of aluminum concentration accompanied with the ingot dissolving become significant, thus enhancing the sedimentation and removal of the dross. As a result, the efficiency of sedimentation and removal of dross improves.

The dross removing tank 12 may have, at need, separation plate(s) to uniformize the flow of melt 3.

The opening 13 is located on a side wall of the plating tank 11 at opposite side to the ingot charge portion, which opening 13 forms a flow passage at near the bath surface zone including the bath surface. The dissolved ingot melt is mixed to the flow, and the supernatant bath, in the vicinity of the bath surface, clarified by sedimenting and removing the dross preferentially returns from the opening 13 to the dross removing tank 11. Since the flow of melt 3 has very little flow resistance, the melt 3 gives very little difference in the liquid level between the plating tank 11 and the dross removing tank 12. Therefore, the melt 3 recycled to the plating tank 11 generates very little top dross.

The melt 3 recycled to the plating tank 11 is clean removing the dross, and the amount of generated dross in the plating tank 11 is little. As a result, the effect to prevent the dross deposition in the plating tank 11 is excellent.

Figure 3:
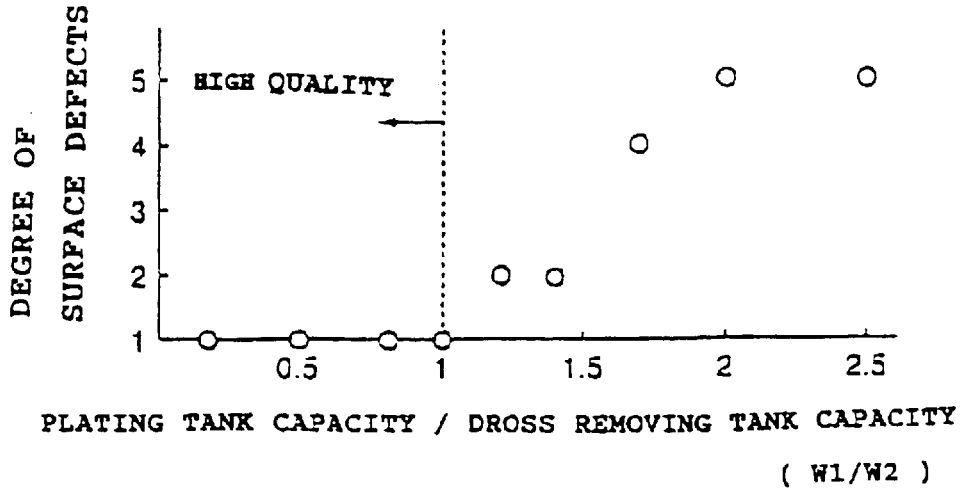
FIG. 3 shows the relation between the (capacity of plating tank)/(capacity of dross removing tank) and the degree of surface defects on the apparatus for hot-dip galvanizing of FIG. 1.
Figure 4:
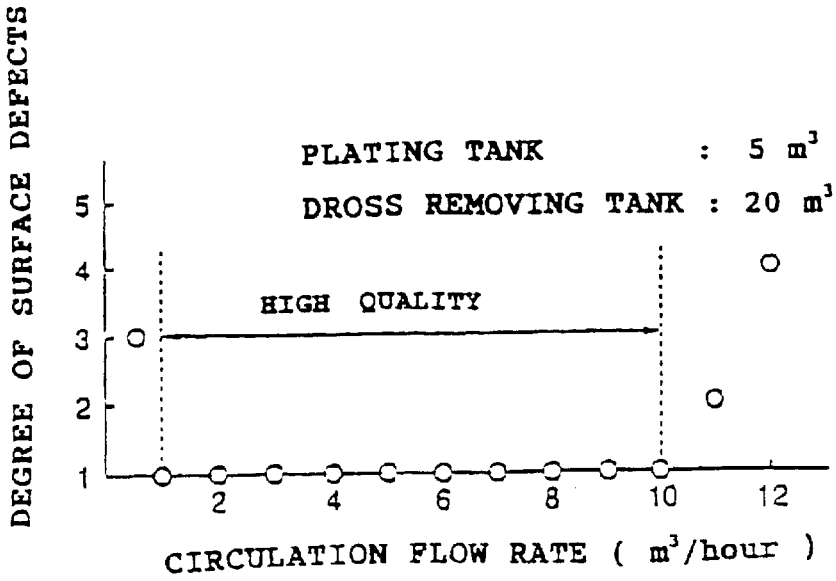
FIG. 4 shows the relation between the circulation flow rate and the degree of surface defects on the apparatus for hot-dip galvanizing of FIG. 1.
Figure 5:
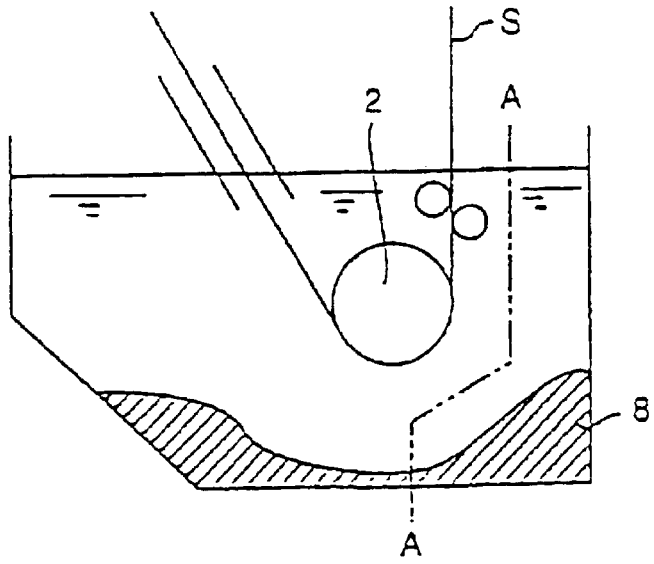
FIG. 5 shows a dross deposition state in the plating vessel in cross sectional plane to the direction of traveling steel strip.
Figure 6:
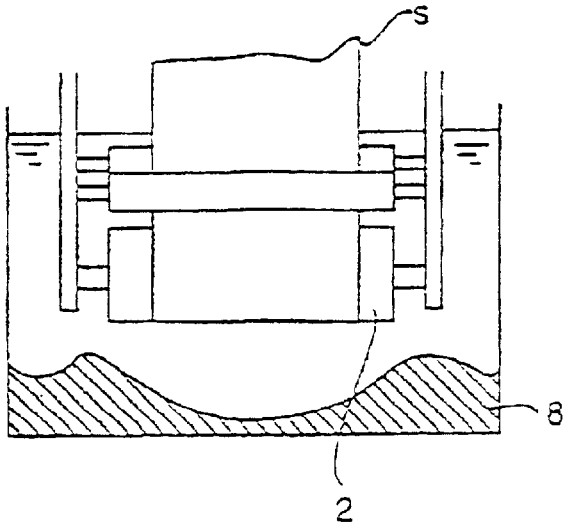
FIG. 6 shows the dross deposition state in the plating vessel in A—A cross section of FIG. 5.

With the apparatus shown in FIG. 1, the inventors of the present invention studied the generation of quality defects caused by the dross adherence in the plating tank 11 under variations of tank capacity and of circulation flow rate. The result is shown in FIGS. 2 through 4.

FIG. 2 shows the generation of quality defects of a steel strip S caused by the dross adherence under the conditions of 20 $m^3$ of the capacity of dross removing tank 12, and fixed circulation flow rate of 3 $m^3/h$, with varied capacity of the plating tank 11. The quality defect generation caused from the dross adherence was determined by visual observation of the surface of steel strip S after plating. The degree of quality defects was evaluated by five grades of indexes 1 through 5. The index 1 is the best, equivalent to the quality required to the high quality hot-dip galvanized steel strip.

With the capacities of plating tank 11 not more than 10 $m^3$, the index is 1, or good quality. With the capacities of plating tank 11 more than 10 $m^3$, however, the index increases to degrade the quality. Increased capacity of the plating tank 11 more likely induces generation of stagnant zone where the bottom dross deposits. To prevent the deposition of bottom dross in the plating tank 11, reducing the capacity of the plating tank 11 is an effective means. When the capacity of the plating tank 11 is brought to less than 10 $m^3$, the currently required high quality hot-dip galvanized steel strip is produced.

The inventors studied the generation of quality defects on steel strip S caused by dross adherence at a fixed circulation flow rate of 3 $m^3/h$ while varying the capacity of the dross removing tank 12. Since the size of the dross removing tank 12 is influenced by the capacity of the plating tank 11, the data of quality defect generation on the steel strip S caused from dross adherence were rearranged using a parameter W1/W2 (W1 is the capacity of the plating tank 11, W2 is the capacity of the dross removing tank 12). The result is shown in FIG. 3.

In the zones of not more than W1/W2=1.0, the index is 1, or good quality. However, in the zones of exceeding W1/W2=1.0, the index increases to degrade the quality. Therefore, by controlling the value of W1/W2 to not more than 1.0, the currently required high quality hot-dip galvanized steel strip is produced.

Furthermore, the inventors studied the generation of quality defects on steel strip S caused by dross adherence at fixed capacity of the plating tank 11 and the dross removing tank 12 to 5 $m^3$ and 20 $m^3$, respectively, while varying the circulation flow rate. The result is shown in FIG. 4.

When the circulation flow rate was large, defects occurred presumably caused from insufficient sedimentation and removal of dross in the dross removing tank 12, resulting in the incoming dross in the plating tank 11. In the dross removing tank 12, it is important to assure a retention time not less than the dross sedimentation time taking into account of the target dross sedimentation time. The above-described defects were reduced with the reduction in circulation flow rate, and the acceptable quality was attained at not more than 10 $m^3$/h of the circulation flow rate. However, further reduced circulation flow rate to less than 1 $m^3$/h resulted to stop discharging the dross from the plating tank 11 to the dross removing tank 12, and the dross remained in the plating tank 11, thus the index inversely increased, and the quality was degraded. To produce high quality hot-dip galvanized steel strip, the circulation flow rate is necessary to control between 1 and 10 $m^3$/h.

Example

The Example used the apparatus shown in FIG. 1. The plating vessel 4 had 2 meters in depth. The plating tank 11 had 5 $m^3$ in capacity, and the dross removing tank 12 had 20 $m^3$ in capacity. The dross sedimentation speed which raises problem in ordinary hot-dip galvanizing is around 1 meter per hour. Since the depth of the plating vessel 4 was 2 meters the dross removing tank 12 required 2 hours or longer retention time. If the circulation flow rate is not more than 10 $m^3$/h, the retention time exceeds 2 hours, which expects the dross removal effect. On the other hand, if the circulation flow rate becomes below 1 $m^3$/h, the dross in the plating tank 11 remains in the plating tank 11 to cause the generation of quality defects. Considering the above-described conditions, the circulation flow rate was selected to 5 $m^3$/h.

The apparatus was used to conduct the hot-dip galvanizing to a steel strip. The generation of dross defects on the plated steel strip became zero, compared with around 2% of defect generation in conventional production line. Thus, the problem of dross adherence was completely solved.

According to the Best Mode 1, the amount of dross generated during the hot-dip galvanizing on steel strip is reduced, the once-generated dross is prevented from deposition in the plating tank, and the dross is efficiently removed in the dross removing tank located below the plating tank. Consequently, the quality defects caused from the dross adherence to the steel strip are reduced. The Best Mode 1 produces high quality hot-dip galvanized steel strip.

The apparatus of the Best Mode 1 is a simple one only dividing a plating vessel into a plating tank at upper zone and a dross removing tank at lower zone. Accordingly, the apparatus solves several problems such as the investment cost problem accompanied with melt transfer to a distant tank, and the problems of solidification and leak of melt.

Since the melt 3 flows with very little flow resistance, there appears very little difference in liquid level between the plating tank 11 and the dross removing tank 12. As a result, when the melt returns to the plating tank 11, very little top dross is generated.

Since the Best Mode 1 allows minimized zone for sedimentation and removal of dross, the total size of plating vessel is reduced, thus an existing apparatus can be modified to easily implement the Best Mode 1.

Best Mode 2

The first embodiment is a method for hot-dip galvanizing characterized in that, on conducting hot-dip galvanizing continuously to a steel strip by immersing the steel strip in a plating vessel which contains a molten metal, the plating vessel is divided into a separable plating tank at upper zone and a dross removing tank at lower zone thereof, thus the steel strip is immersed in the plating tank to conduct the hot-dip galvanizing, then the molten metal bath in the plating tank is transferred to the dross removing tank using a mechanical pump, thus removing the dross from the molten metal bath in the dross removing tank, and dissolving a solid phase metal for plating, further the molten metal bath in the dross removing tank is recycled to the plating tank through an opening located on the plating tank.

The second embodiment is the method for hot-dip galvanizing described in the first embodiment, which method is characterized in that the molten metal bath in the plating tank is sucked at bottom center portion of the plating tank to transfer to the dross removing tank.

The third embodiment is the method for hot-dip galvanizing described in the first embodiment or the second embodiment, which method is characterized in that the molten metal bath recycled from the dross removing tank to the plating tank contains a supernatant bath after removed the dross therefrom.

The fourth embodiment is the method for hot-dip galvanizing described in any one of the first through third embodiments, which method is characterized in that the plating tank and the dross removing tank satisfy the relation of $W1 \leqq 10$ $m^3$ and $W1 \leqq W2$, (W1 is the capacity of the plating tank, and W2 is the capacity of the dross removing tank), and the flow rate of molten metal bath being transferred from the plating tank to the dross removing tank is in a range of from 1 to 10 $m^3$/h.

The fifth embodiment is an apparatus for hot-dip galvanizing continuously to a steel strip by immersing the steel strip in a plating vessel which contains a molten metal, which apparatus is characterized in that the plating vessel is divided into the plating tank at upper zone and the dross removing tank at lower zone thereof, thus the steel strip is immersed in the plating tank to conduct the hot-dip galvanizing, while removing the dross from the molten metal bath in the dross removing tank, and dissolving a solid phase metal for plating in the dross removing tank, that a mechanical pump is installed to transfer the molten metal bath from the plating tank to the dross removing tank, and that an opening is located on the plating tank to recycle the molten metal bath from the dross removing tank to the plating tank.

The sixth embodiment is the apparatus for hot-dip galvanizing described in the fifth embodiment, which apparatus is characterized in that the suction of the mechanical pump for molten metal is located at bottom center portion of the plating tank.

The seventh embodiment is the apparatus for hot-dip galvanizing described in the fifth embodiment or the sixth embodiment, which apparatus is characterized in that the opening is located so as the supernatant bath after removed the dross in the dross removing tank to be recycled to the plating tank.

The eighth embodiment is the apparatus for hot-dip galvanizing described in any one of the fifth through seventh embodiments, which apparatus is characterized in that the plating tank and the dross removing tank satisfy the relation of $W1 \leqq 10$ $m^3$ and $W1 \leqq W2$, (W1 is the capacity of the plating tank, and W2 is the capacity of the dross removing tank), and the flow rate of molten metal bath being transferred from the plating tank to the dross removing tank is in a range of from 1 to 10 $m^3$/h.

According to the Best Mode 2, the make up of zinc which was brought out by adhesion to the steel strip, or the dissolving solid phase zinc (ingot), is done in the dross removing tank located beneath the plating tank. Consequently, the variations of temperature of the molten metal bath (melt) in the plating tank become less, thus reducing the generated amount of the dross in the plating tank.

Furthermore, the plating tank is located at upper portion of the plating vessel, so that low temperature zones which appear at near the refractory of the plating vessel are not generated in the plating tank, which gives an effect to reduce the generation of bottom dross.

Since the melt containing dross is transferred from the plating tank to the dross removing tank using a mechanical pump, there occurs no problem of fume and top dross generation observed in the case of gas lift pump application. The use of mechanical pump improves unstable transfer of the melt utilizing the flow accompanied with the traveling steel strip, and assures the transfer of melt from a portion of high concentration of dross to the dross removing tank at a necessary flow rate. To assure the transfer of the melt from a portion of high concentration of dross, it is preferable to suck the melt at bottom center portion of the plating tank to transfer it to the dross removing tank.

Inside of the dross removing tank, no agitation occurs caused from the traveling steel strip, so that the flow becomes calm to enhance the sedimentation of the dross. Furthermore, dissolving an ingot in the dross removing tank enhances the sedimentation and removal of dross owing to the reduction of local melt temperature and to the changes in aluminum concentration. With these two actions, the dross is efficiently and promptly removed in the dross removing tank.

The dross is removed in the dross removing tank. The cleaned melt is preferentially recycled to the plating tank through the opening on the plating tank. Since the melt flows with very little flow resistance, there appears very little difference in liquid level between the plating tank and the dross removing tank. As a result, when the melt returns to the plating tank, very little top dross is generated.

When the opening is located at upper part as far as possible so as the supernatant bath after removed the dross in the dross removing tank to be recycled, the supernatant bath in the vicinity of the bath surface zone where the cleanliness is superior is preferentially recycled to the plating tank.

In the Best Mode 2, since the applied plating tank generally has a capacity of around 10 $m^3$, a plating tank made of stainless steel cannot be annealed at the welded sections, which may induce thermal strain when the plating tank is immersed in the plating vessel. In an extreme case of large deformation of the plating tank, the plating tank cannot be taken out from the plating vessel. If the bottom of the plating tank has no hole, the immersion of the plating tank into the plating vessel needs charge of molten zinc by a pump, which makes the work complicated one. To this point, if the plating tank is designed in separable structure, the plating tank is easily put into and taken out from the plating vessel. Even when thermal strain occurs to deform the plating tank, the separable plating tank is readily taken out from the plating vessel, thus assuring the apparatus easily operable one.

The apparatus of the Best Mode 2 is a simple one only dividing a plating vessel into a plating tank at upper zone and a dross removing tank at lower zone. Accordingly, the apparatus solves several problems such as the investment cost problem accompanied with melt transfer to a distant tank, and the problems of solidification and leak of melt.

Under the conditions that the plating tank and the dross removing tank satisfy the relation of $W1 \leqq 10$ $m^3$ and $W1 \leqq W2$, (W1 is the capacity of the plating tank, and W2 is the capacity of the dross removing tank), and the flow rate of molten metal bath being transferred from the plating tank to the dross removing tank is in a range of from 1 to 10 $m^3/h$, the dross deposition at a stagnant flow of melt in the plating tank is prevented, and the once-generated dross is efficiently removed in the dross removing tank.

The following is the description about the flow analysis of the melt within the plating tank focusing on the action to prevent dross deposition in the plating tank according to the present invention.

Figure 7:
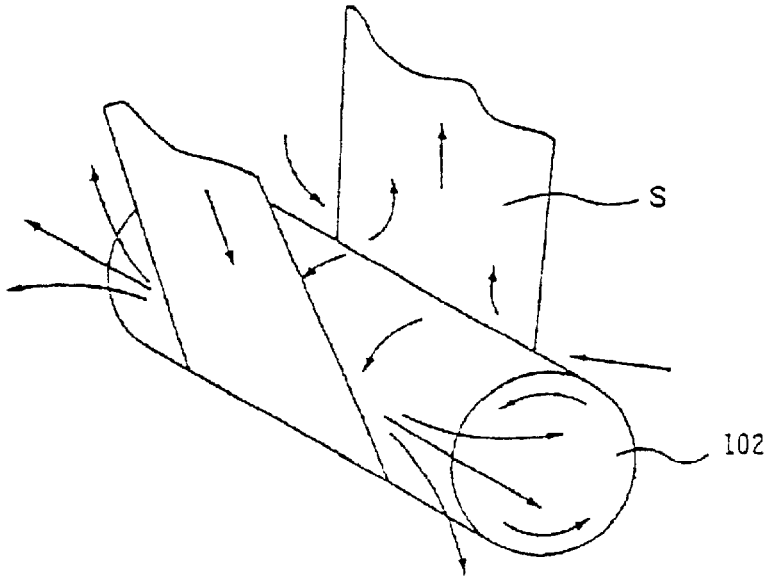
FIG. 7 illustrates the melt flow state accompanied with traveling steel strip and with the roll at a portion that the steel strip contacts the roll.

Inside the plating tank, as illustrated in FIG. 7, at the portion that the steel strip S contacts the sink roll 102, the flow accompanied with the traveling steel strip S and the rotating sink roll 102 fails to find escape exit, which results in a strong flow to lateral direction (in the direction of roll shell length). At the same time, there appears an upward flow accompanied with the traveling steel strip S after changed its traveling direction by the sink roll 102.

Figure 8:
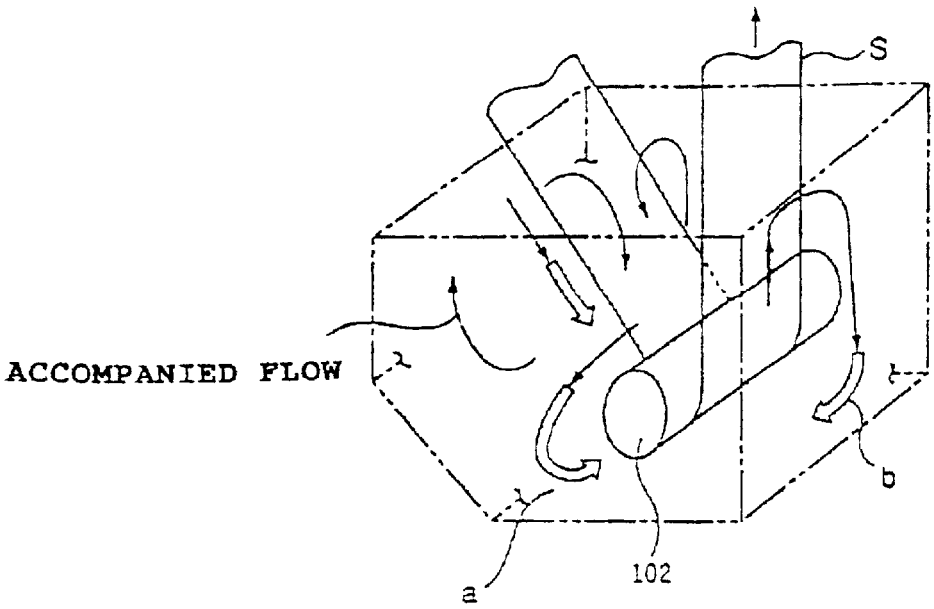
FIG. 8 illustrates the melt flow state in the plating tank.

Since a conventional plating tank has large capacity, these flows lose the intensity at roll edges and at side walls of the plating tank, thus the dross sediments and deposits in the above-described zones. If, however, the size of plating tank is reduced from conventional one, these flows do not attenuate, and the flow in the direction of roll shell length collides against a side wall of the plating tank, then, a part of the flow becomes an activated flow directing the bottom center portion of the plating tank (the flow 'a' in FIG. 8). The upward flow accompanied with the traveling steel strip S after changed its traveling direction by the sink roll 102 changes a part thereof in opposite flow direction to become a downward flow along the side wall of the plating tank, further becomes an activated flow toward the bottom center portion of the plating tank (the flow 'b' of FIG. 8). Owing to these activated flows, the dross is prevented from sedimentation and deposition in the plating tank.

The size and the traveling speed of the steel strip for hot-dip galvanizing are not necessarily fixed. For example, when a steel strip is heated in an annealing furnace provided with a direct-fired oven, increased plate thickness of the steel strip takes a heating time, so that the traveling speed of the steel strip becomes slow. If the plate width becomes narrow, the heating efficiency in the direct-fired oven degrades, and the temperature of exhaust gas of the heating furnace increases, which also results in slowing the traveling speed of the steel strip.

Figure 9:
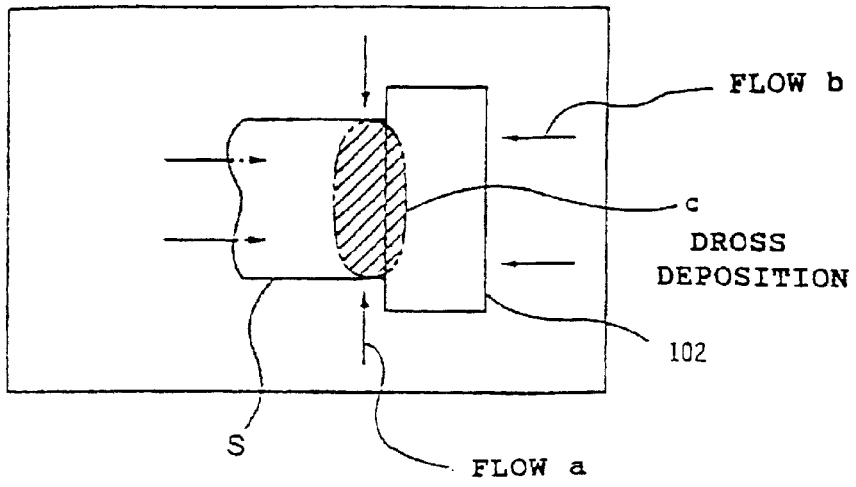
FIG. 9 illustrates the melt flow state and the dross deposition zone at bottom portion of the plating tank under a condition of low traveling speed of the steel strip.

The experiments carried out by the inventors of the present invention revealed the followings. That is, when the steel strip travels at a slow speed, as illustrated in FIG. 9, the above-described activated flows (flow 'a', 'b') induce intense flow to collect the dross to the bottom center portion of the plating tank at center part of the width of the traveling steel strip. The collected dross likely deposits on the bottom center portion (zone 'c') of the plating tank. When the traveling speed of the steel strip increases, the deposited dross is stirred up. That is, when the width of the steel strip increases and when the traveling speed of the steel strip increases, the dross adherence to the steel strip likely occurs in the initial stage of operation. If the melt at the bottom center of the plating tank is sucked by a pump to transfer it to outside the plating tank, then the dross deposition in the zone 'c' for the case of low traveling speed is surely prevented.

Figure 10A:
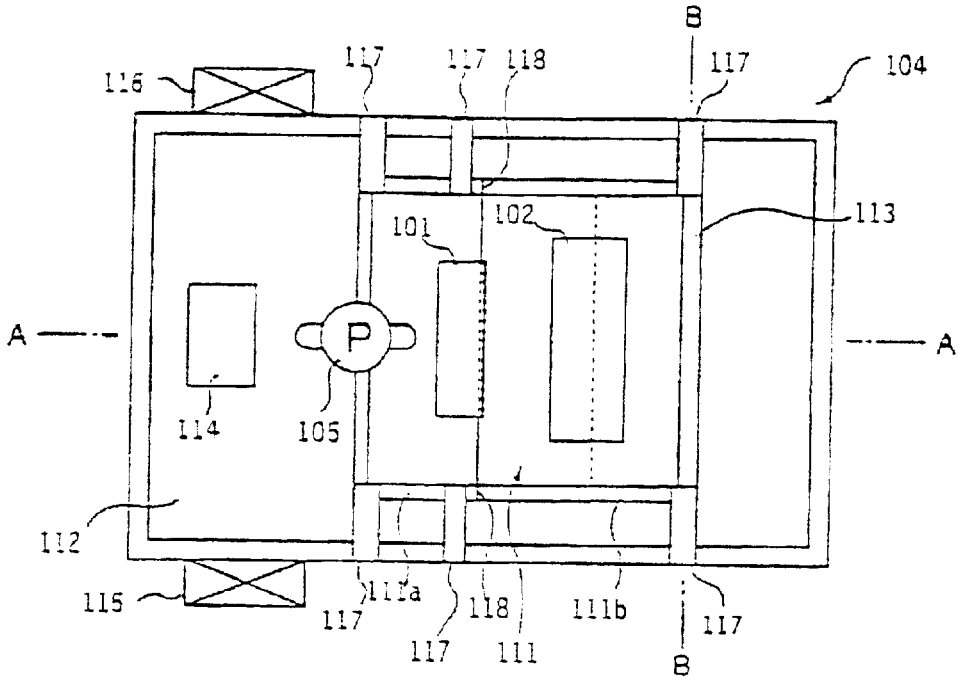
FIG. 10 shows an apparatus for hot-dip galvanizing according to the Best Mode 2.
Figure 10B:
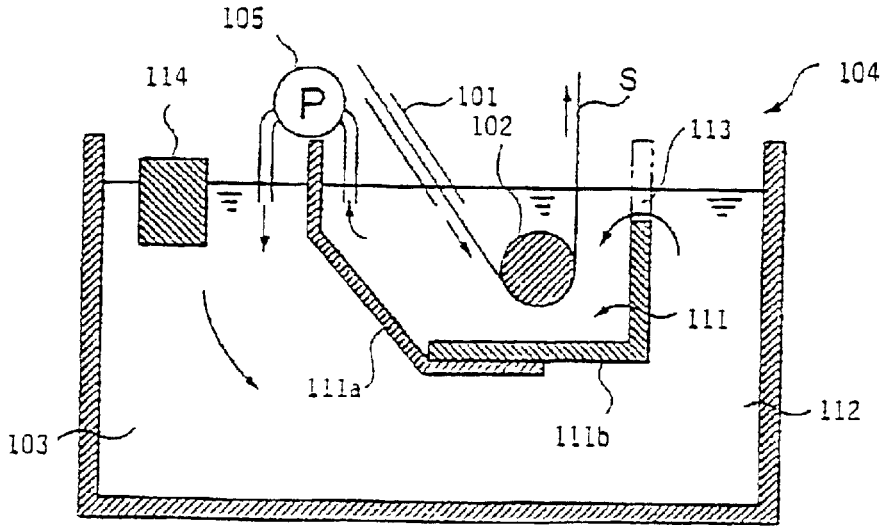
Figure 11:
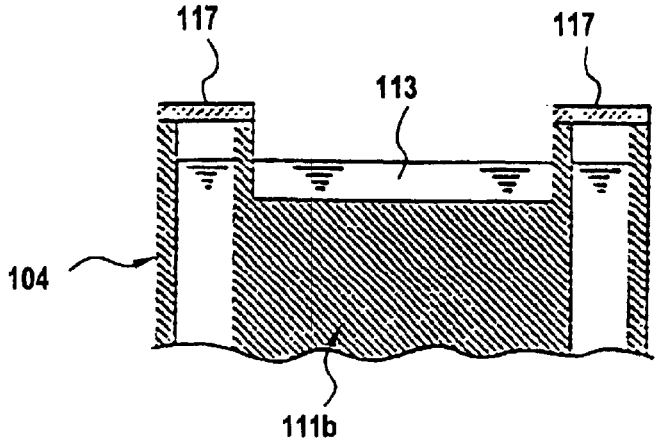
FIG. 11 is the cross sectional view along B—B line of FIG. 10(*a*).

The Best Mode 2 is described referring to FIGS. 10 and 11. FIG. 10 shows a apparatus for hot-dip galvanizing of the Best Mode 2. FIG. 10(*a*) is the plan view. FIG. 10(*b*) is the cross sectional view along A—A line of FIG. 10(*a*). FIG. 11 is the cross sectional view along B—B line of FIG. 10(*a*). In these drawings, the reference number 101 is the snout, 102 is the sink roll, 103 is the molten metal bath (melt), and 104 is the plating vessel.

The plating vessel 104 is divided into the plating tank 111 which conducts plating the steel strip S, and the dross removing tank 112 which is located beneath the plating tank 111 and which conducts sedimentation and removal of dross and dissolves the ingot 114. The reference number 105 is the mechanical pump, 113 is the opening located on the plating tank 111. The plating tank 111 comprises a plating tank member 111*a* and a plating tank member 111*b,* which are separable from each other. These plating tank members are detachably mounted to the plating vessel 104 by the flow-stopping jigs 117, as shown in FIG. 11.

For mounting the plating tank 111 to the plating vessel 104, the plating tank member 111*a* is fixed to the plating vessel 104 using a flow-stopping jig 117, then the bottom of the plating tank member 117*b* is placed on the bottom of the plating tank member 111*a,* and the horizontal position of the plating tank member 111*b* is adjusted to almost zero of the gap between the contact portions 118 of the side walls of the members, followed by fixing the plating tank member 111*b* to the plating vessel 104 using a flow-stopping jig 117. Thus located the plating tank 111 allows to substantially prevent the transfer of the melt 103 between the plating tank 111 and the dross removing tank 112 through the contact portion of the plating tank member 111*a* and the plating tank member 111*b,* which allows to utilize the plating tank as a single tank.

According to the apparatus the bottom portion of the plating tank member 111*b* has a structure located near to the slope of the plating tank member 111*a.* At that portion, the influence of the flow accompanied with the traveling steel strip S is weak, so that, even if the plating tank members 111*a* and 111*b* deform by thermal strain to generate a gap between the bottom of them to result in establishing a connection between the plating tank 111 and the dross removing tank 112, the melt 103 cannot move between the plating tank 111 and the dross removing tank 112 through the connection passage.

For detaching the plating tank 111 from the plating vessel 104, the plating tank member 111*b* is removed, then the plating tank member 111*a* is removed. Even if the plating tank 111 is deformed by thermal strain, the plating tank 111 is separated to divisions to readily take out from the plating vessel 104.

In the above-described apparatus, the steel strip S travels in the arrow direction to enter and dip into the plating tank 111 through the snout 101, and the steel strip S changes the travel direction around the sink roll 102, then is taken out from the molten metal bath 103. After being adjusted the coating weight in a coating weight controller (not shown), the steel strip S is cooled and subjected to a specified post-treatment to become a plated steel strip.

The melt 103 containing dross in the plating tank 111 is transferred to the dross removing tank 112 by the mechanical pump 105. The dross is sedimented and removed in the dross removing tank 112, while the melt 103 is recycled to the plating tank 111 through the opening 113. The amount of the melt transferred by the mechanical pump 105 is the circulation flow rate of the melt 103 between the plating tank 111 and the dross removing tank 112.

The apparatus has no heating device in the plating tank 111, and the temperature control of the melt in the plating tank 111 is conducted by the heating devices (induction heating devices) 115, 116 located in the dross removing tank 112 and by the adjustment of the temperature of traveling steel strip. When an ingot 114 is charged in the dross removing tank 112, the temperature of melt flowing into the plating tank 111 through the opening 113 is controlled to a specified level by adequately functioning the heating devices 115, 116.

Since the ingot 114 is not dissolved in the plating tank 111, the temperature variations of the melt 103 in the plating tank 111 become minimum. Since the temperature control of the melt 103 in the plating tank 111 is done by the heating devices 115, 116 of the dross removing tank 112, the hot melt 103 ejected from the induction heating devices does not contact the steel strip S. As a result, the elution of iron from the steel strip S is suppressed, and the generation of dross in the plating tank 111 is reduced.

Furthermore the plating tank 111 is hung down in the plating vessel 104, so that the low temperature zones which appear at near the refractory of the bottom portion of the plating vessel 104 are not generated in the plating tank 111, which gives an effect to reduce the generation of bottom dross.

A ceramics mechanical pump 105 for transferring the melt 103 from the plating tank 111 to the dross removing tank 112 is mounted in the plating vessel 104. Since the plating tank 111 and the dross removing tank 112 are adjacent to each other, the transfer distance of the melt 103 is short, and the problems of solidification and leak of the melt 103 during transfer are substantially solved. In addition, the melt 103 is transferred from the plating tank 111 to the dross removing tank 112 at a necessary amount.

The mechanical pump means a pump such as a volute pump (centrifugal pump), a turbine pump, and a displacement pump, which transfers melt directly contacting the melt to working parts of the pump. The mechanical pump described here does not include a gas lift pump.

In the dross removing tank 112, the ingot 114 is dissolved, and the bottom dross is sedimented and is removed. In the dross removing tank 112, the flow of melt 103 is uniformized because of absence of agitation of the melt 103 caused from the traveling steel strip S. Adding to the functions, the local melt temperature reduction and the variations of aluminum concentration accompanied with the ingot dissolving become significant, thus enhancing the sedimentation and removal of the dross. As a result, the efficiency of sedimentation and removal of dross improves.

The dross removing tank 112 may have, at need, separation plate(s) to uniformize the flow of melt 103 aiming at efficient sedimentation and removal of bottom dross.

The opening 113 is located on a side wall of the plating tank 111 at opposite side to the ingot charge portion, as shown in FIG. 11, which opening 113 forms a flow passage at near the bath surface zone including the bath surface. The dissolved ingot melt is mixed to the flow, and the supernatant bath, in the vicinity of the bath surface, clarified by sedimenting and removing the dross preferentially returns from the opening 113 to the plating tank 111. Since the flow of melt 103 has very little flow resistance, the melt 103 gives very little difference in the liquid level between the plating tank 111 and the dross removing tank 112. Therefore, the melt 103 recycled to the plating tank 111 generates very little top dross.

The melt 103 recycled to the plating tank 111 is clean removing the dross, and the amount of generated dross in the plating tank 111 is little. As a result, the effect to prevent the dross deposition in the plating tank 111 is excellent.

Figure 13:
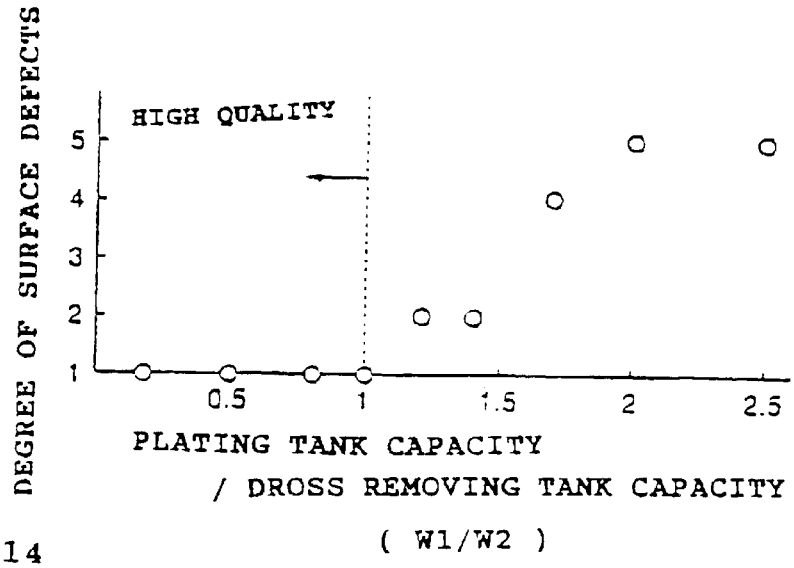
FIG. 13 shows the relation between the (capacity of plating tank)/(capacity of dross removing tank) and the degree of surface defects in the method for molten zinc-base plating according to the Best Mode 2.
Figure 14:
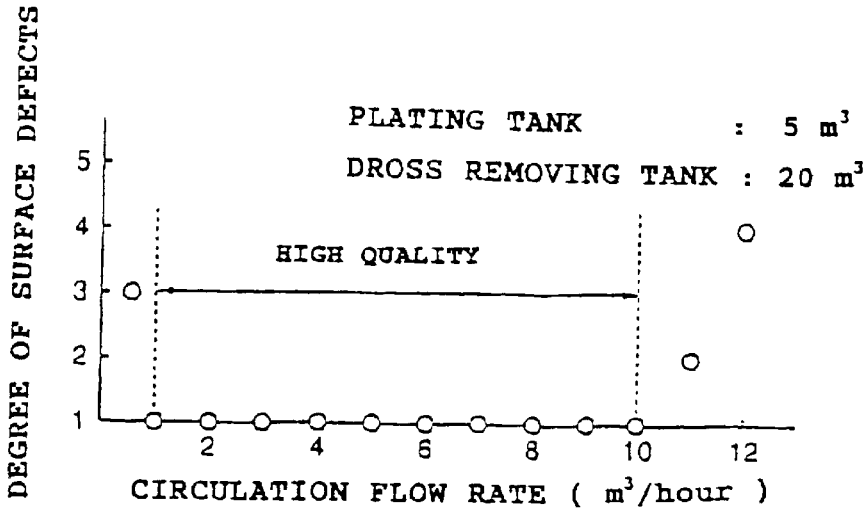
FIG. 14 shows the relation between the circulation flow rate and the degree of surface defects in the method for hot-dip galvanizing according to the Best Mode 2.

With the apparatus shown in FIG. 10, the inventors of the present invention studied the generation of quality defects caused by the dross adherence in the plating tank 111 under variations of tank capacity and of circulation flow rate. The result is shown in FIGS. 12 through 14.

Figure 12:
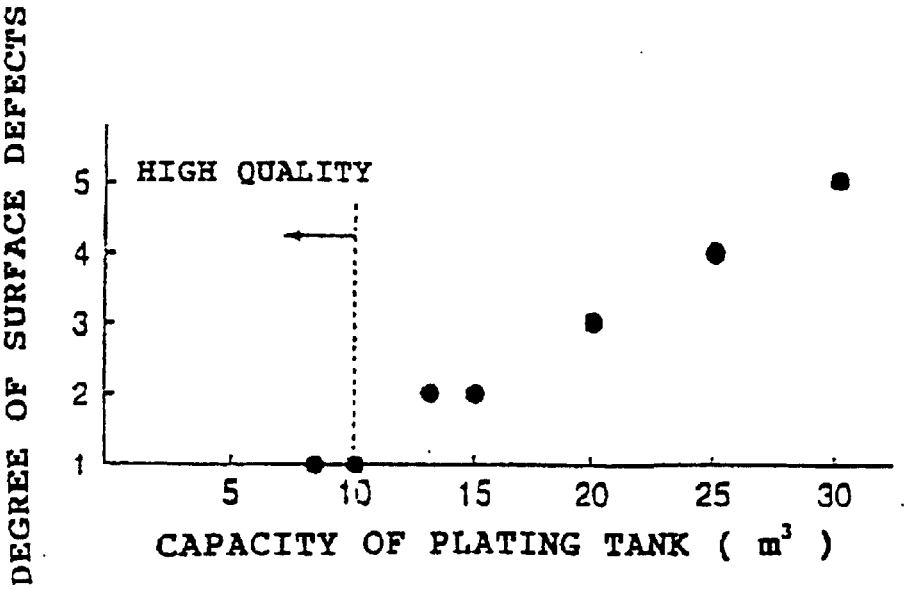
FIG. 12 shows the relation between the capacity of plating tank and the degree of surface defects in the method for hot-dip galvanizing according to the Best Mode 2.

FIG. 12 shows the generation of quality defects of a steel strip S caused by the dross adherence under the conditions of 20 $m^3$ of the capacity of dross removing tank 112, and a fixed circulation flow rate of 3 $m^3$/h, with varied capacity of the plating tank 111. The quality defect generation caused from the dross adherence was determined by visual observation of the surface of steel strip S after plating. The degree of quality defects was evaluated by five grades of indexes 1 through 5. The index 1 is the best, equivalent to the quality required to the high quality hot-dip galvanized steel strip.

With the capacities of plating tank 111 not more than 10 $m^3$, the index is 1, or good quality. With the capacities of plating tank 111 more than 10 $m^3$, however, the index increases to degrade the quality. Increased capacity of the plating tank 111 more likely induces generation of stagnant zone where the bottom dross deposits. To prevent the deposition of bottom dross in the plating tank 111, reducing the capacity of the plating tank 111 is an effective means. When the capacity of the plating tank 111 is brought to less than 10 $m^3$, the currently required high quality hot-dip galvanized steel strip is produced.

The inventors studied the generation of quality defects on steel strip S caused by dross adherence at a fixed circulation flow rate of 3 $m^3$/h while varying the capacity of the dross removing tank 112. Since the size of the dross removing tank 112 is influenced by the capacity of the plating tank 111, the data of quality defect generation on the steel strip S caused from dross adherence were rearranged using a parameter W1/W2 (W1 is the capacity of the plating tank 111, W2 is the capacity of the dross removing tank 112). The result is shown in FIG. 13.

In the zones of not more than W1/W2=1.0, the index is 1, or good quality. However, in the zones of exceeding W1/W2=1.0, the index increases to degrade the quality. Therefore, by controlling the value of W1/W2 to not more than 1.0, the currently required high quality hot-dip galvanized steel strip is produced.

Furthermore, the inventors studied the generation of quality defects on steel strip S caused by dross adherence at fixed capacity of the plating tank 111 and the dross removing tank 112 of 5 $m^3$ and 20 $m^3$, respectively, while varying the circulation flow rate. The result is shown in FIG. 14.

When the circulation flow rate was large, defects occurred presumably caused from insufficient sedimentation and removal of dross in the dross removing tank 112, resulting in the incoming dross into the plating tank 111. In the dross removing tank 112, it is important to assure a retention time not less than the dross sedimentation time taking into account of the target dross sedimentation time. The above-described defects were reduced with the reduction in circulation flow rate, and the acceptable quality was attained at not more than 10 $m^3$/h of the circulation flow rate. However, further reduced circulation flow rate to less than 1 $m^3$/h resulted to stop discharging the dross from the plating tank 111 to the dross removing tank 112, and the dross remained in the plating tank 111, thus the index inversely increased, and the quality was degraded. To produce high quality hot-dip galvanized steel strip, the circulation flow rate is necessary to control between 1 and 10 $m^3$/h.

Figure 15A:
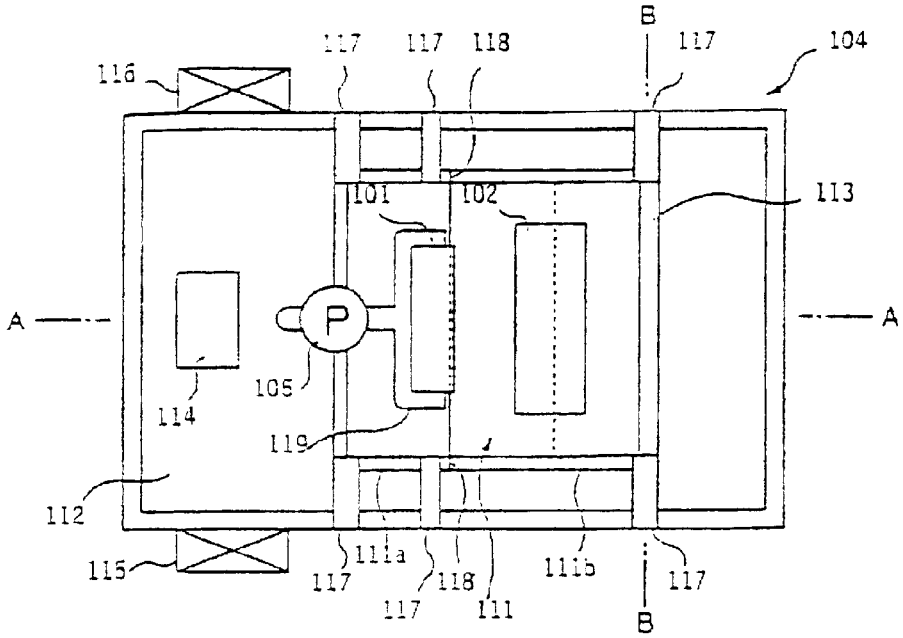
FIG. 15 shows another apparatus for hot-dip galvanizing according to the Best Mode 2.
Figure 15B:
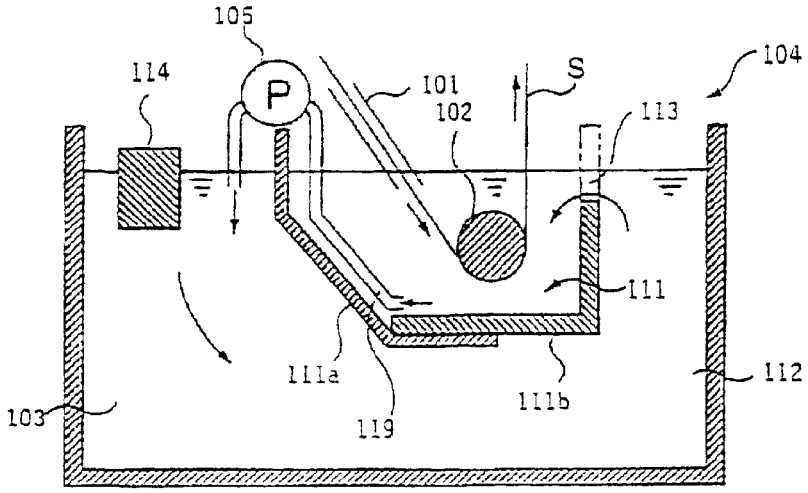

Another embodiment according to the present invention is described below referring to FIG. 15. FIG. 15 shows an apparatus for hot-dip galvanizing, shown in FIGS. 10 and 11, provided with a suction opening of the mechanical pump 105 at bottom center portion of the plating tank 111. FIG. 15(*a*) is the plan view, and FIG. 15(*b*) is the cross sectional view along A—A line of FIG. 15(*a*).

According to the apparatus, the melt 103 containing dross in the plating tank 111 is transferred to the dross removing tank 112 by the mechanical pump 105 having a suction opening at bottom center portion of the plating tank 111. Even when the steel strip width becomes narrow and the travelling speed of the steel strip becomes slow, the effect of preventing deposition of dross at bottom center portion of the plating tank 111 is superior. Thus, when the steel strip width increases or when the traveling speed of the steel strip increases, the effect of preventing the dross adherence to the steel strip in the initial period of operation is superior.

Example 1

Example 1 used the apparatus shown-in FIG. 10. The plating vessel 104 had 2.5 meters in depth. The plating tank 111 had 10 $m^3$ in capacity, and the dross removing tank 112 had 30 $m^3$ in capacity. The dross sedimentation speed which raises problem in ordinary hot-dip galvanizing is around 1 meter per hour. Since the depth of the plating vessel 104 was 2.5 meters, the dross removing tank 112 required 2.5 hours or longer retention time. If the circulation flow rate is not more than 12 $m^3$/h, the retention time exceeds 2.5 hours, which expects the dross removal effect. On the other hand, if the circulation flow rate becomes below 1 $m^3$/h, the dross in the plating tank 111 remains in the plating tank 111 to cause the generation of quality defects. Considering the above-described conditions, the circulation flow rate was selected to 5 $m^3$/h.

The apparatus was used to conduct the hot-dip galvanizing to a steel strip. The generation of dross defects on the plated steel strip became zero, compared with around 2% of defect generation in conventional production line. Thus, the problem of dross adherence was completely solved.

Example 2

Example 2 used the apparatus shown in FIG. 15. The plating vessel 104 and the plating tank 111 had the same capacities and dimensions as those of Example 1. The hot-dip galvanizing to a steel strip was conducted at a fixed melt circulation flow rate of 5 $m^3$/h, which was the same as Example 1. The generation of dross defects on the plated steel strip became zero, compared with around 2% of defect generation in conventional production line. Thus, the problem of dross adherence was completely solved. As a result, the steel strip traveling speed could be increased from conventional level of 100 m/min to 140 m/min.

According to the Best Mode 2, the amount of dross generated during the hot-dip galvanizing on steel strip is reduced, the once-generated dross is prevented from deposition in the plating tank, and the dross is efficiently removed in the dross removing tank located below the plating tank. In addition, since the melt flows with very little flow resistance, there appears very little difference in liquid level between the plating tank and the dross removing tank. As a result, when the melt returns to the plating tank, very little top dross is generated. Consequently, the Best Mode 2 produces high quality hot-dip galvanized steel strip.

The apparatus of the Best Mode 2 is a simple one only dividing a plating vessel into a plating tank at upper zone and a dross removing tank at lower zone. Accordingly, the investment cost reduces. The apparatus solves several problems such as the investment cost problem accompanied with melt transfer to a distant tank, and the problems of solidification and leak of melt.

Since the Best Mode 2 needs only a narrow zone for dross sedimentation and removal, the total plating vessel becomes small. Therefore, an existing facility is easily modified to implement the present invention.

Best Mode 3

The essentials of the Best Mode 3 are the following.

The first embodiment is a method for hot-dip galvanizing characterized in that, on conducting hot-dip galvanizing continuously to a steel strip by immersing the steel strip in a plating tank which contains a molten metal, a separation wall is located inside of the plating tank to divide into a plating zone where the steel strip is subjected to hot dip plating, and a dross removing zone where dross in the molten metal bath is removed, that the steel strip is subjected to plating in the plating zone, that the molten metal bath in the plating zone is transferred to the dross removing zone using a mechanical pump, then the dross is removed from the molten metal bath in the dross removing zone, that a solid phase metal for plating is dissolved in the dross removing zone, and that a supernatant bath after removed the dross in the dross removing zone is recycled to the plating zone having the same liquid level to each other via a weir on the separation wall.

The second embodiment is the method for hot-dip galvanizing described in the first embodiment, which method is characterized in that a heating device is located in the dross removing zone to conduct heating control so as the temperature of the molten metal bath in the plating zone to become a predetermined level.

The third embodiment is the method for hot-dip galvanizing described in the first embodiment or the second embodiment, which method is characterized in that the plating zone has a molten metal bath capacity of W1, and the dross removing zone has a molten metal bath capacity of W2, wherein W1/W2 is in a range of from 0.2 to 5.

The fourth embodiment is the method for hot-dip galvanizing described in any one of the first through third embodiments, which method is characterized in that separation walls mounted in the plating tank divide the plating tank into a plating zone and two dross removing zones, that a mechanical pump is located to each of the dross removing zones to transfer the molten metal bath from the plating zone, that a weir is located to each of the dross removing zone to recycle the molten metal bath to the plating zone, that the mechanical pump mounted to the one dross removing zone transfers the molten metal bath from the plating zone to the dross removing zone to remove the dross, that the mechanical pump mounted to the other dross removing zone is stopped to let the dross deposited in the other dross removing zone discharge to outside the plating tank.

The fifth embodiment is an apparatus for hot-dip galvanizing continuously to a steel strip by immersing the steel strip in a plating tank which contains a molten metal, which apparatus is characterized in that a separation wall is located in the plating tank to divide the plating tank into a plating zone where the steel strip is subjected to hot dip plating, and a dross removing zone where dross is removed from the molten metal bath, and where a solid phase metal for plating is dissolved, that a mechanical pump which transfers the molten metal bath from the plating zone to the dross removing zone is located, and that a weir is located on the separation wall to transfer a supernatant bath of the molten metal bath after removed the dross in the dross removing zone to the plating zone having the same liquid level to that in the dross removing zone.

The sixth embodiment is the apparatus for hot-dip galvanizing described in the fifth embodiment, which apparatus is characterized in that a heating device is located in the dross removing zone to conduct heating control so as the temperature of the molten metal bath in the plating zone to become a predetermined level.

The seventh embodiment is the apparatus for hot-dip galvanizing described in either the fifth embodiment or the sixth embodiment, which apparatus is characterized in that the plating zone has a molten metal bath capacity of W1, and the dross removing zone has a molten metal bath capacity of W2, wherein W1/W2 is in a range of from 0.2 to 5.

The eighth embodiment is the apparatus for hot-dip galvanizing described in any one of the fifth through seventh embodiments, which apparatus is characterized in that separation walls are located in the plating tank to divide into a plating zone where the steel strip is subjected to hot dip plating, and two dross removing zones where dross is removed from the molten metal bath, that a mechanical pump which transfers the molten metal bath from the plating zone to the dross removing zone is located to each of the two dross removing zones, and that a weir is located to each of the separation walls that separate the plating zone from respective dross removing zones to transfer a supernatant bath of the molten metal bath after removed the dross in each of the dross removing zones to the plating zone.

According to the Best Mode 3, the make up of zinc which was brought out by adhesion to the steel strip, or the dissolving solid phase zinc (ingot), is done in the dross removing zone. Thus, the plating zone receives the zinc in a form of liquid zinc from the dross removing zone. Consequently, the variations of temperature of the molten metal bath (melt) in the plating zone become less, which prevents the generation and growth of the dross in the plating zone.

Since the melt containing dross in the plating zone is transferred to the dross removing zone using a mechanical pump, there occurs no problem of quality and operation, such as generation of fume and top dross, which are observed in the case of using a gas lift pump. In addition, the use of mechanical pump improves unstable transfer of the melt appearing in utilizing the flow accompanied with the traveling steel strip, and assures the transfer of melt from a portion of high concentration of dross to the dross removing zone at a necessary flow rate.

Since the dross removing zone is separated by the separation walls from the plating zone, no agitation of the melt in the dross removing zone caused from the traveling steel strip occurs, so that the flow becomes calm to enhance the sedimentation of the dross. Furthermore, dissolving the ingot in the dross removing zone enhances the sedimentation and removal of dross owing to the reduction of local melt temperature and to the changes in aluminum concentration. With these two actions, the dross is efficiently and promptly removed in the dross removing zone.

The supernatant bath after removing dross in the dross removing zone is preferentially recycled to the plating zone via the weir located on the separation wall. Since the liquid level of the dross removing zone and that of the plating zone are equal, no top dross is generated in the plating zone on recycling the supernatant bath.

The apparatus is a simple one only separating the plating zone from the dross removing zone. Accordingly, the apparatus is fabricated at a low investment cost, and solves several problems such as the investment cost problem accompanied with melt transfer to a distant tank, and the problems of solidification and leak of melt.

According to the Best Mode 3, the heating device located in the dross removing zone conducts the control of melt temperature in the plating zone. When the heating device is located in the plating zone, it is preferable that the heating device generates only heat at a low output to ensure a constant temperature of the melt in the plating zone. In the plating zone, the hot melt does not contact the steel strip. As a result, the elution of iron from the steel strip is suppressed, and the generation of dross in the plating zone is reduced.

If more than one heating device are installed in the dross removing zone, the heaving devices may be handled as a single group to control the melt temperature in the plating zone. Alternatively, these heating devices may be separated to two groups, and the one group may conduct control of the melt temperature in the plating zone, while other group may conduct control of the melt temperature in the vicinity of the ingot-dissolving zone in the dross removing zone, thus assuring more reasonable heating of the total plating tank.

When the suction opening of the mechanical pump in the plating zone is located at 500 mm or less of distance from the bottom of the plating zone, the melt in the zone where the dross concentration is high and where the dross likely deposits in the plating tank can be preferentially transferred to the dross removing zone. Consequently, the effect of prevention of the dross deposition in the plating zone is further improved.

By locating the weir on the separation wall at 500 mm or less of depth below the bath surface, the melt near the bath surface having excellent cleanliness can be recycled to the plating zone. Accordingly, the cleanliness of the melt in the plating zone is further improved. The weir is most preferably in a shallow one such as a groove flow passage.

When the capacity of the plating zone and the capacity of the dross removing zone are defined as W1 and W2, respectively, if W1/W2 becomes 0.2 or more, the effect of dross removal in the dross removing zone is further improved. If, however, W1/W2 exceeds 5, the effect of dross removal saturates, and the capacity of the plating zone increases, which increases the investment cost and the quantity of the molten metal. Therefore, W1/W2 is preferably in a range of from 0.2 to 5.

When two dross removing zones are located in the plating tank, and when the melt is transferred from the plating zone to one dross removing zone, while the dross deposited in the other dross removing zone is discharged from the plating tank, thus discharging the deposited dross from the plating tank without stopping the plating operation and without giving influence to the quality of the plated portions.

Figure 16:
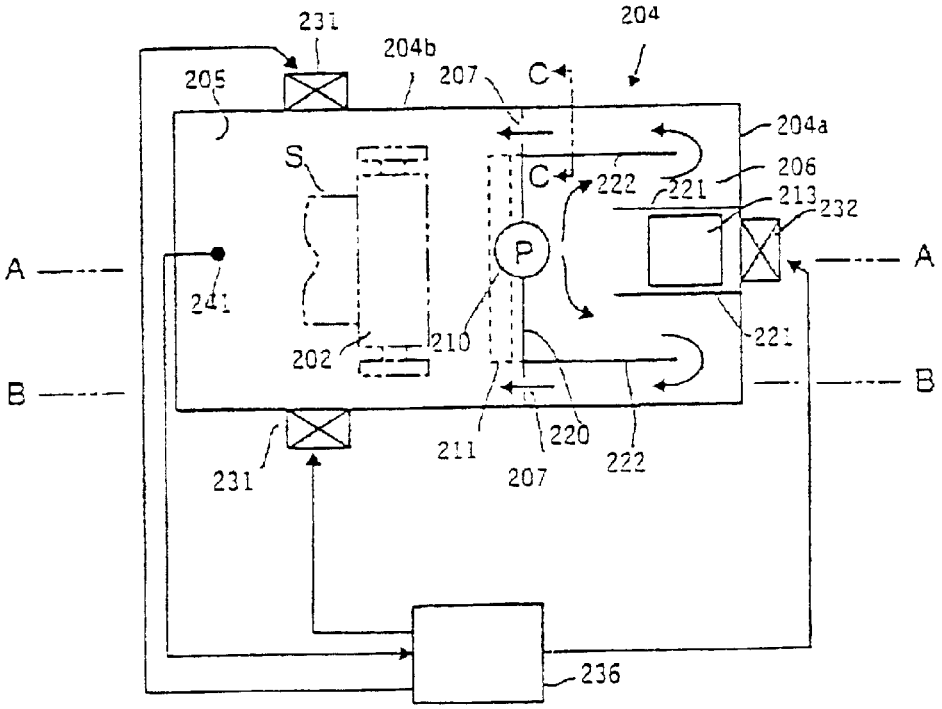
FIG. 16 shows the plan view of the first apparatus for hot-dip galvanizing of the Best Mode 3.
Figure 17A:
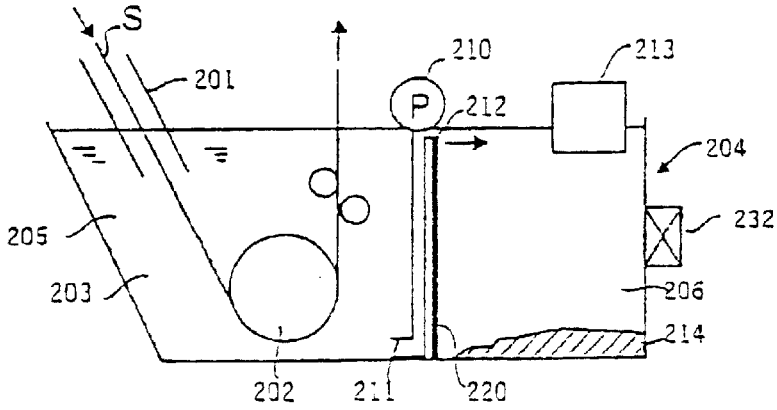
FIG. 17 shows the cross sectional views of the apparatus for hot-dip galvanizing of FIG. 16.
Figure 17B:
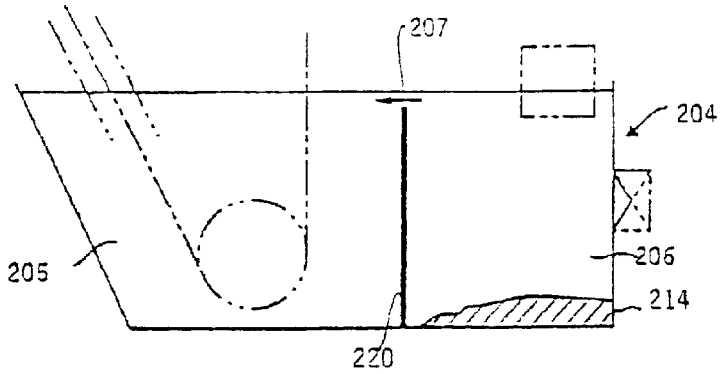
Figure 17C:
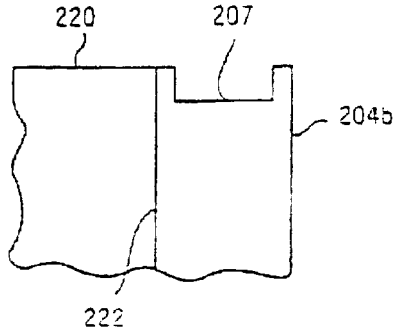

The Best Mode 3 is described referring to FIGS. 16 and 17. FIG. 16 shows the plan view of the apparatus for hot-dip galvanizing of the Best Mode 3. FIG. 17(*a*) is the cross sectional view along A—A line, FIG. 17(*b*) is the cross sectional view along B—B line, FIG. 17(*c*) is the cross sectional view along C—C line (enlarged view), of FIG. 16. In these figures, the reference number 201 is the snout, 202 is the sink roll, 203 is the molten metal bath (melt), 204 is the plating tank, 205 is the plating zone, 206 is the dross removing zone, 207 is the weir, and 210 is the mechanical pump.

In the above-described apparatus, the steel strip S travels in the arrow direction to enter the plating zone 205 through the snout 201, and the steel strip S changes the travel direction around the sink roll 202, then is taken out from the molten metal bath 203. After being adjusted the coating weight in a coating weight controller (not shown), the steel strip S is cooled and subjected to a specified post-treatment to become a plated steel strip. The melt 203 containing the dross in the plating zone 205 is transferred to the dross removing zone 206 by the mechanical pump 210 to sediment and remove the dross in the dross removing zone 206, then the melt 203 is recycled to the plating zone 205 via the weir 207.

The plating tank 204 is divided into the plating zone 205 to conduct plating the steel strip S, and the dross removing zone 206 to sediment and remove the dross and to dissolve the ingot 213, by the separation wall 220 located in the plating tank 204.

The plating zone 205 is provided with a pair of heating devices 231 and a thermometer 241. The dross removing zone 206 is provided with a heating device 232 at near the charge portion of the ingot 213. The heating devices 231 and 232 are induction heating devices.

The pair of heating devices 231 heat the melt in the plating zone 205 and control the melt temperature to a specified level. The heating to dissolve the ingot 213 and the heating the melt 203 up to the operation temperature of the plating zone 205 are done by the heating device 232 in the dross removing zone 206 via the controller 236 so as the temperature detected by the thermometer 241 in the plating zone 205 to become a specified level. Since the make up of zinc which was brought out by adhesion to the steel strip S is not given in the plating zone 205, the temperature changes in the melt 203 in the plating zone 205 is minimized. Furthermore, since the hot melt 203 ejected from the heating devices 231 does not contact the steel strip S, the elution of iron from the steel strip S is suppressed, and the generated amount of the dross is reduced.

A ceramics mechanical pump 210 for transferring the melt 203 from the plating zone 205 to the dross removing zone 206 is mounted between the plating zone 205 and the dross removing zone 206. The suction opening 211 of the pump is preferably at 500 mm or less above the bottom of the plating zone. The apparatus of FIG. 16 has the pump at near the bottom of the plating tank 204. The width of the suction opening 211 is wider by 400 mm than the shaft length of the sink roll 202. The configuration prevents the deposition of the dross on the edges of the roll.

The mechanical pump means a pump such as a volute pump (centrifugal pump), a turbine pump, and a displacement pump, which transfers melt directly contacting the melt to working parts of the pump. The mechanical pump described here does not include a gas lift pump.

The plating zone 205 and the dross removing zone 206 are only separated by a separation wall 220. Accordingly, the transfer distance of the dross becomes significantly short, and the problems of solidification and leak of melt 203 during transfer are solved. If the pumping head of the melt 203 is increased, the melt disturbs the bath surface on splashing thereto, which generates large amount of top dross (zinc oxide). To prevent the phenomenon, the pumping head is required to minimize.

According to the apparatus of FIG. 16, the pump discharge opening 212 is located at near the bath surface in the dross removing zone 206, so that the dross generation caused from the disturbance on the bath surface is avoided. In addition, since the transfer passage of the melt 203 is substantially not located outside the tank, there occurs no problem of solidification and leak of the melt 203 during the melt transfer.

In the dross removing zone 206, dissolving the ingot 213 and sedimentation and removal of the bottom dross 214 are carried out. The dross removing zone 206 is provided with the separation walls 221, 222 to efficiently dissolve the ingot 213 and to sediment and remove the bottom dross 214.

The separation walls 221, 222 uniformize the flow of melt 203 in the dross removing zone 206, thus Improving the efficiency of sedimentation and removal of the dross. Adding to the action, the local melt temperature and the aluminum concentration changes accompanied with the ingot dissolving are increased, thus enhancing the sedimentation and removal of the dross.

The weir 207 on the separation wall 222 is preferably located at 500 mm or less below the bath surface. The apparatus of FIG. 16 has the weir 207 at near the bath surface. The dissolved ingot melt is mixed to the flow, and the supernatant bath in the vicinity of the bath surface having high cleanliness after sedimented and removed the dross preferentially overflows from the weir 207 to return to the plating zone 205. Since the melt flows with very little flow resistance, there appears very little difference in liquid level between the plating zone 205 and the dross removing zone 206. As a result, when the melt 203 returns to the plating zone 205, no top dross is generated.

The expression that the same bath level in both the dross removing zone and the plating zone, referred in the present invention, includes not only the same level in both zones but also the case that, even if a difference in liquid level exists, no generation of top dross which induces quality degradation occurs on returning the melt 203 from the dross removing zone 206 to the plating zone 205, furthermore, includes the case that the transfer is carried out in liquid-filled state without containing gas phase.

In the apparatus shown in FIG. 16, the plating zone 205 has 15 $m^3$ in capacity, and the dross removing zone 206 has 12 $m^3$ in capacity and 2 m in depth. In the apparatus of FIG. 16, the quantity of the melt transferred by the pump is the circulation flow rate. Since the target dross for removal has a sedimentation speed of 1 m/h, if the retention time necessary for sedimentation and removal of the dross in the melt 203 in the dross removing zone 206 is assumed as 2 hours, the circulation flow rate of 6 $m^3$/h is sufficient. However, since the apparatus of FIG. 16 does not establish perfect uniformized flow in the dross removing zone 206, the time necessary for sedimenting the dross is assumed as double the above-described time, to set 4 hours of retention time. Thus, the apparatus of FIG. 16 sets the circulation flow rate to 3 $m^3$/h.

The apparatus of FIG. 16 has the capacity of the plating zone 205 larger than that of the dross removing zone 206. The capacity of the plating zone is preferably minimum. Even when the capacity of the plating zone 205 is reduced, the capacity of the dross removing zone 206 is preferably not reduced. If the capacity of the dross removing zone 206 is significantly larger than that of the plating zone 205, the necessary dross removal is able to be conducted in the dross removing zone 206 under an increased circulation flow rate. Since the increased circulation flow rate assures the agitation in the plating zone 205, the effect to prevent the deposition of the dross in the plating zone 205 is improved. By increasing the capacity of the dross removing zone 206, the effect of sedimentation and removal of dross in the dross removing zone 206 is improved.

When the plating zone has a molten metal bath capacity of W1, and the dross removing zone has a molten metal bath capacity of W2, W1/W2 is preferably in a range of from 0.2 to 5.

Another embodiment of the present invention is described referring to the apparatus for hot-dip galvanizing shown in FIGS. 18 through 21. In these figures, the same portions explained in FIGS. 16 and 17 have the same respective reference numbers. The mechanical pump for transferring the melt is the mechanical pump having suction and discharge openings similar to those of the apparatus of FIGS. 16 and 17. The heating device is an induction heating device.

Figure 18:
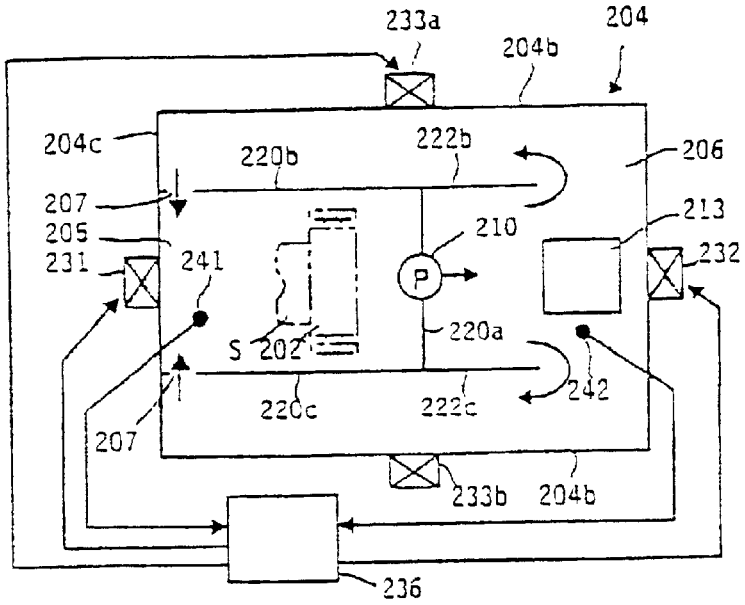
FIG. 18 shows the plan view of the second apparatus for ho-dip galvanizing of the Best Mode 3.

The apparatus shown in FIG. 18 has the plating tank 204 which is divided into the plating zone 205 and the dross removing zone 206 by the separation walls 220*a*, 220*b*, 220*c* located in the plating tank 204. The dross removing zone 206 is provided with plates 222*b*, 222*c* to uniformize the melt flow. The plating zone 205 is provided with the heating device 231. The dross removing zone 206 is provided with the heating device 232 at near the ingot-dissolving portion. The plating tank 204 is provided with the heating devices 233*a*, 233*b* at the respective side walls 204*b*. The plating zone 205 is provided with a thermometer 241. The dross removing zone 206 is provided with a thermometer 242.

Similar with the case of FIGS. 16 and 17, the apparatus of FIG. 18 uses the heating device 231 to control the melt temperature in the plating zone 205 to a constant level, and the heating devices 232, 233*a*, 233*b* of the dross removing zone 206 heat the ingot to dissolve and heat the melt 203 up to the operation temperature and control the temperature level. As for the dissolving the ingot and the heating of melt to the operation temperature of the plating zone 205, the controller 236 is applied to control each heating device by gathering the heating devices 232, 233*a*, 233*b* as one group, based on the melt temperature of the plating zone 205 detected by the thermometer 241, or alternatively, the heating devices 233*a*, 233*b* are gathered to form the first group, and the heating device 232 is set as the second group then the controller 236 controls the output of the first group, or the heating devices 233*a* and 233*b*, based on the melt temperature in the plating zone detected by the thermometer 241, while the output of the second group, or the heater 232, is adjusted on the basis of the melt temperature in the dross removing zone 206 detected by the thermometer 242. With the heating and controlling as in the latter case, the sedimentation of dross in the dross removing zone 206 is enhanced without influencing the operation in the plating zone 205. Thus, further reasonable heating of the melt in the plating tank 204 can be achieved.

The melt transferred from the plating zone 205 is further transferred to the dross removing zone 206 by the mechanical pump 210. While the melt flows in the dross removing zone 206 in the arrow direction shown in FIG. 18, and the dross is sedimented and removed. The supernatant bath after sedimented and removed the dross is recycled to the plating zone 205 through the weirs 207 which are located on the respective separation walls 220*b*, 220*c*, at near the bath surface toward the side wall 204*c* of the plating tank 204.

According to the apparatus of FIG. 18, the dross removing zone 206 is located to cover the three sides of the plating zone 205, thus increasing the capacity of the dross removing zone 206 to prolong the time for sedimentation and removal of dross as well as to further reduce the heating of the plating zone 205 by the heating device 231. Accordingly, the generation of dross in the plating zone 205 is further decreased, and the sedimentation and removal of dross in the dross removing zone 206 is further improved. The apparatus is effective in the case that the sedimentation and removal of the bottom dross is required as preferential action.

Figure 19:
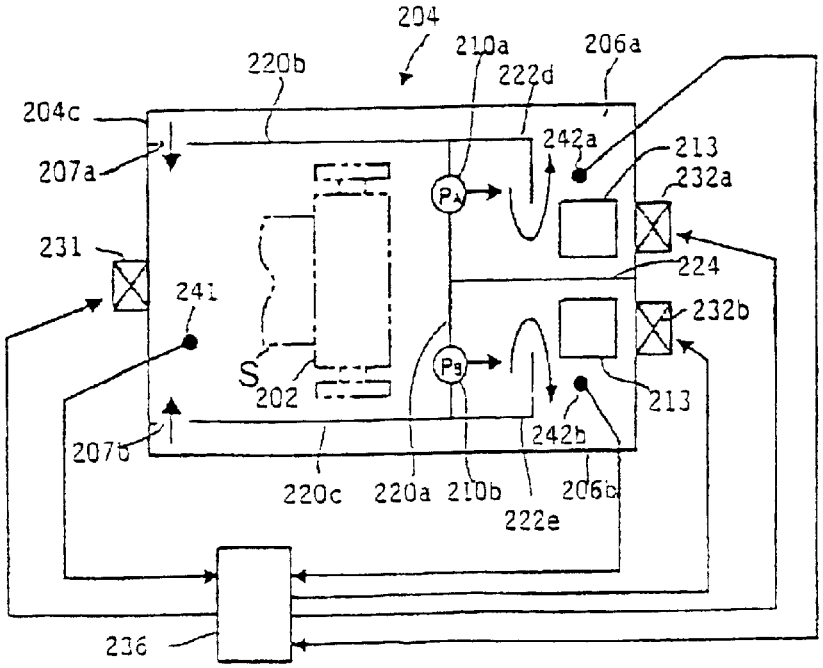
FIG. 19 shows the plan view of the third apparatus for ho-dip galvanizing of the Best Mode 3.

According to the apparatus of FIG. 19 the plating tank 204 is divided into the plating zone 205 and two dross removing zones 206*a,* 206*b.* The melt circulation means is located between the plating zone 205 and each of the dross removing zones 206*a* and 206*b.* That is, the plating tank 204 is divided into the plating zone 205 and the dross removing zones 206*a* and 206*b* by the plurality of separation walls 220*a,* 220*b,* 220*c,* 224 located in the plating tank 204. The melt is transferred from the plating zone 205 to the dross removing zones 206*a,* 206*b* via respective mechanical pumps 210*a,* 210*b.*

The dross removing zones 206*a,* 206*b* are provided with respective L-shape separation walls 222*d* 222*e* to allow the dissolving the ingot 213 and to avoid the melt transferred by the mechanical pumps 210*a,* 210*b* from forming a short cut flow. In addition, weirs 207*a,* 207*b* are located on the respective separation walls 220*b,* 220*c* at near the bath surface toward the side wall 204 in the plating tank 204.

The plating zone 205 is provided with the heating device 231. The dross removing zones 206*a,* 206*b* are provided with the respective heating devices 232*a,* 232*b* at near the ingot dissolving portion. The plating zone 205 is provided with the thermometer 241. The dross removing zones 206*a,* 206*b* are provided with respective thermometers 242*a,* 242*b.* The controller 236 dissolves the ingot using the heating device 232*a* or 232*b* on the basis of the melt temperature in the plating zone 205 detected by the thermometer 241 and heats the melt 203 up to the operation temperature of the plating zone 205 and controls the melt temperature at the level. The controller 236 also controls the melt temperature in the dross removing zones 206*a* or 206*b,* separately, using the heating device 232*a* or 232*b,* on the basis of the melt temperature in the dross removing zone 206 detected by the thermometer 242*a* or 242*b* mounted in the dross removing zone 206.

The melt transferred from the plating zone 205 is further transferred to the dross removing zone 206*a* or 206*b* by the mechanical pump 210*a* or 210*b,* respectively. While the melt flows in the dross removing zone 206*a* or 206*b* in the arrow direction shown in FIG. 18, the dross is sedimented and removed. The supernatant bath after sedimented and removed the dross is recycled to the plating zone 205 through the weirs 207*a* or 207*b* which are located on the respective separation walls 220*b,* 220*c,* at near the bath surface toward the side wall 204*c* of the plating tank 204.

Since continuous plating operation induces deposition of bottom dross in the dross removing zone where the melt is circulated using the mechanical pump, the deposited bottom dross has to be taken out from the plating tank 204. If the plating operation is stopped to bring out the deposited dross, the productivity is degraded.

The apparatus of FIG. 19 avoids the above-described problem by alternately transferring the melt to either of the dross removing zones 206*a* and 206*b.* That is, the melt is transferred between the plating zone and either of the dross removing zones 206*a* and 207*b,* alternately. During the period that one dross removing zone conducts the sedimentation and removal of dross, the other dross removing zone can carry out the discharge of the deposited bottom dross from the plating tank using a Wellman scoop or the like, (hereinafter the work is referred to as "drossing"), which allows the continuous plating operation.

In this case, the melt temperature in the plating zone 205 is heated by the heating device 231 to a stable level. Based on the temperature of the plating zone 205 detected by the thermometer 241, the heating device located in the dross removing zone where the melt is transferred conducts the ingot-dissolving and the melt-heating up to the operation temperature of the plating zone. As for the melt temperature in the dross removing zone where the drossing is conducted, the heating device located in the zone is used to control the temperature on the basis of the melt temperature in the dross removing zone detected by the thermometer in the zone.

If the liquid in the plating zone 205 does not overflow the weirs 207*a,* 207*b* in case of pump stop, and if the pump of the drossing side is stopped, the liquid level of the dross removing zone where the drossing is conducted reduces down to the level of the weir of the zone, thus eliminating the mixing of melts between the plating zone 205 and the dross removing zone where the drossing is conducted. As a result, even if the drossing induces stirring up the bottom dross in the dross removing zone, no influence is given to the plating zone 205. After cleaned the dross in the dross removing zone, and after sedimenting the fine dross which was not removed after a predetermined time has passed, the melt transfer to the cleaned dross removing zone may be resumed.

The apparatus of FIG. 19 controls separately the melt temperature of the dross removing zone during the pump is stopped. During the pump is stopped, the melt temperature in the dross removing zone is reduced, and the dross in the melt is sufficiently deposited and sedimented, and is removed, after that, drossing is given. The procedure assures efficient removal of bottom dross.

In hot-dip galvanizing, the composition of the dissolving ingot may be changed to change the composition of the melt 203 in the plating zone 205. According to the apparatus of FIG. 19, an ingot having different composition from that of the melt in the dross removing zone may be dissolved during the pump is stopped, thus allowing prompt change of the composition of the melt 203 in the plating zone 205.

Figure 20:
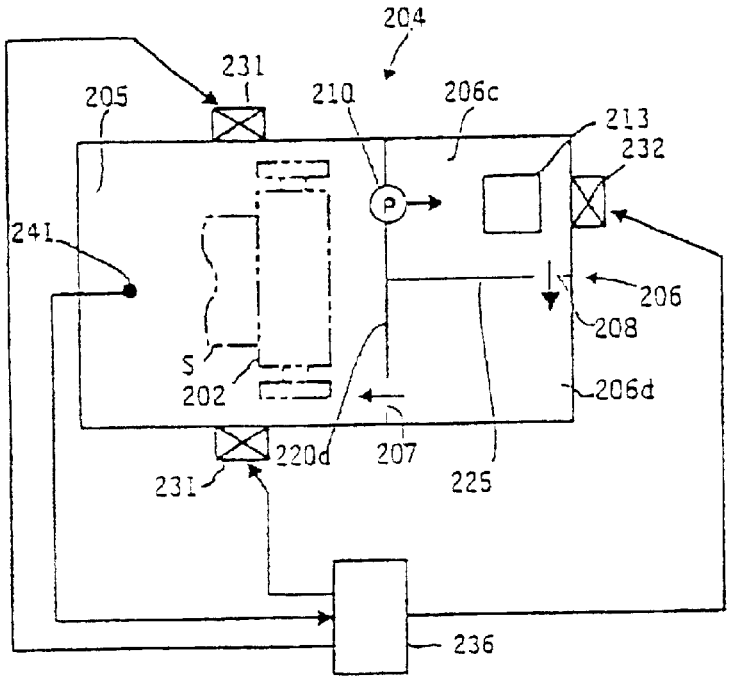
FIG. 20 shows the plan view of the fourth apparatus for ho-dip galvanizing of the Best Mode 3.

According to the apparatus of FIG. 20, the plating tank 204 is divided into the plating zone 205 and the dross removing zone 206 by the separation wall 220*d*. The dross removing zone 206 is further divided into the main zone 206*c* which conducts sedimentation and removal of dross and conducts the dissolving of ingot 213, and the melt reservoir zone 206*d* which conducts sedimentation and removal of dross that was not sedimented and removed in the main zone 206*c* and which temporarily holds the melt after dissolving the ingot to be transferred to the plating zone 205. The weir 207 is located on the separation wall 220*d* at near the liquid surface toward a side wall of the plating tank 204. The weir 208 is located on the separation wall 225 at near the liquid surface toward a side wall of the plating tank 204.

The plating zone 205 is provided with a pair of heating devices 231. The main zone 206*c* is provided with a heating device 232 at near the ingot charge portion. The heating device 231 heats the melt to a specified temperature. On the basis of the melt temperature detected by the thermometer 241 in the plating zone 205, the heating device 232 dissolves the ingot and heats the melt up to the operation temperature of the plating zone 205 using the controller 236.

The melt transferred from the plating zone 205 by the pump 210 separates the dross by sedimentation and removal in the main zone 206*c.* The ingot 213 is dissolved in the main zone 206*c.* Then, the melt in the main zone 206*c* enters the melt reservoir zone 206*d* via the weir 208. If the composition of the ingot 213 to be dissolved is changed, the presence of the melt reservoir zone 206*d* prevents sudden change in composition of the plating zone 205.

Figure 21A:
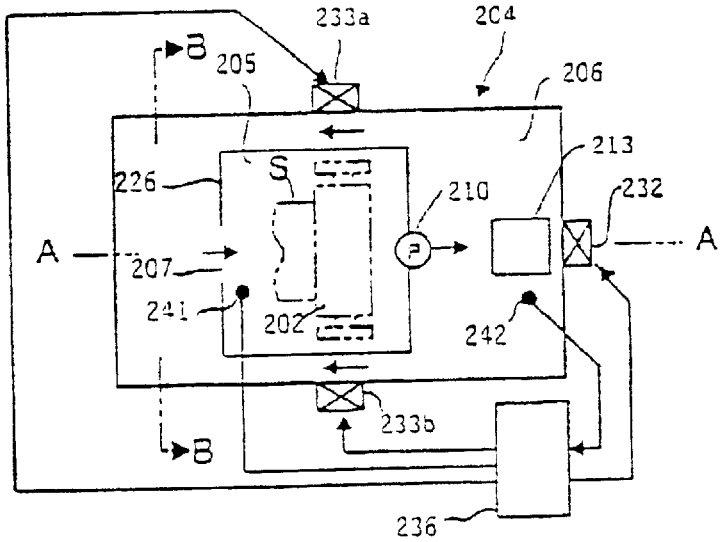
FIG. 21 shows the plan view of the fifth apparatus for ho-dip galvanizing of the Best Mode 3.
Figure 21B:
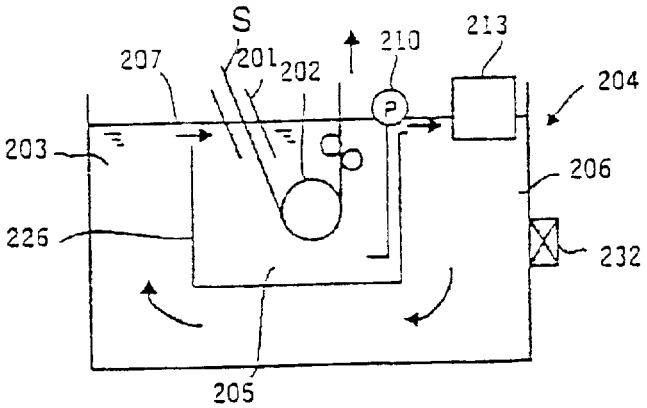
Figure 21C:
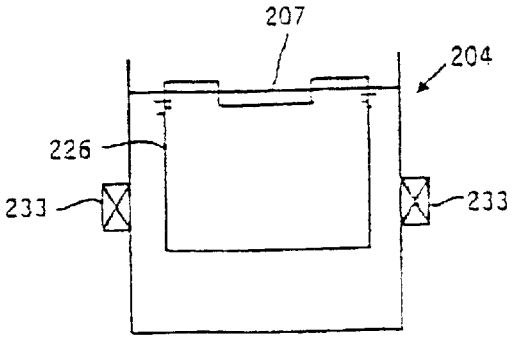

The apparatus of FIG. 21 has the separation wall 226 to place the plating zone 205 above the dross removing zone 206. FIG. 21(*a*) is the plan view of the apparatus. FIG. 21(*b*) is the cross sectional view along A—A line of FIG. 21(*a*). FIG. 21(*c*) is the cross sectional view along B—B line of FIG. 21(*a*). The weir 207 is located on the separation wall 226 at near the bath surface and at rear side of the snout 201. The dross removing zone 206 is provided with the heating device 232 at near the ingot dissolving portion. The plating tank 204 is provided with the heating devices 233*a*, 233*b* at respective side walls thereof. The plating zone 205 is provided with the thermometer 241. The dross removing zone 206 is provided with the thermometer 242.

According to the apparatus, all the supply of heat to compensate the heat emissions from the plating zone 205 and the heating for ingot-dissolving and the heating of melt 203 up to the operation temperature of the plating zone 205 are given by the heating devices 232, 233*a*, 233*b* in the dross removing zone 206. As for the dissolving the ingot and the heating of melt 203 up to the operation temperature of the plating zone 205, the heaving devices 232, 233*a*, 233*b* may be handled as a single group using the controller 236 on the basis of the melt temperature of the plating zone 205 detected by the thermometer 241. Alternatively, these heating devices may be separated into two groups (the first group consisting of 233*a*, 233*b*, and the second group consisting of 232), and the controller 236 is applied to control the output of the first group heating devices 233*a*, 233*b* on the basis of the melt temperature in the plating zone detected by the thermometer 241, while the output of the second group heating device 232 is adjusted on the basis of the melt temperature in the dross removing zone 206 detected by the thermometer 242.

The melt 203 in the plating zone 205 is transferred to the dross removing zone 206 by the mechanical pump 210. While the melt flows in the dross removing zone 206 in the arrow direction shown in FIG. 21, the dross is sedimented and removed. The supernatant bath after sedimented and removed the dross is recycled to the plating zone 205 through the weir 207 which is located on the separation wall 226 at near the bath surface and at rear side of the snout 201.

The apparatus of FIG. 21 is possible to increase the capacity of the dross removing zone 206. Accordingly, the retention time for sedimenting and removing the bottom dross in the dross removing zone 206 is secured to a sufficiently long period.

According to the present invention, when what is called the "tandem pot" plating apparatus is installed having plurality of plating tanks for producing different kinds of hot-dip galvanized steel strips each having significantly different compositions of coating films, the plurality of plating tanks may be installed on a single vehicle for assuring quick replacement of the applied plating tanks, and for simultaneously moving there each.

According to the Best Mode 3, the amount of dross generated during the hot-dip galvanizing on steel strip is reduced, the once-generated dross is prevented from deposition in the plating tank, and the dross is efficiently removed in the dross removing tank located below the plating tank. Consequently, the quality defects caused from the dross adherence to the steel strip are reduced. The Best Mode 3 allows to produce high quality hot-dip galvanized steel strip.

Since the apparatus of the Best Mode 3 has no additional tank for removing the dross, an existing facility may be modified to apply the present invention. The apparatus is a simple and inexpensive one, and solves several problems such as solidification and leak of melt. Furthermore, the apparatus does not induce additional operational and quality problems accompanied with the transfer of melt, which are encountered in gas lift pump application.

According to the Best Mode 3, the presence of plurality of dross removing zones assures the discharge of bottom dross deposited in the dross removing zone to outside the plating tank without stopping the plating operation.

In addition, even when the plurality of plating tanks are installed for producing different grades of hot-dip galvanized steel strips, the apparatus according to the Best Mode 3 is advantageous owing to the small space for installation.

Best Mode 4

The essentials of Best Mode 4 are the following.

The first embodiment is a method for hot-dip galvanizing, on conducting hot-dip galvanizing continuously to a steel strip via a sink roll located in a plating tank which contains a molten metal by immersing the steel strip therein and by traveling the steel strip therethrough, which method is characterized in that a separation wall is located inside of the plating tank to divide the plating tank into a placing zone where the steel strip is subjected to hot dip plating, and a dross removing zone where dross in the molten metal bath is removed, thus conducting plating to the steel strip in the plating zone, that the molten metal bath above the sink roll in the plating zone is transferred to the dross removing zone using a mechanical pump, that the dross is removed from the molten metal bath in the dross removing zone, and a solid metal for plating is dissolved in the dross removing zone, and that a weir is located on the separation wall, through which weir a supernatant bath after removed the dross in the dross removing zone is recycled to the plating zone having the same bath surface level with that in the dross removing zone.

The second embodiment is the method for hot-dip galvanizing described in the first embodiment, which method is characterized in that a heating device is located in the dross removing zone to conduct heating control so as the temperature of the molten metal bath in the plating zone to become a predetermined level.

The third embodiment is the method for hot-dip galvanizing described in the first embodiment or the second embodiment, which method is characterized in that the plating zone has a molten metal bath capacity of W1, and the dross removing zone has a molten metal bath capacity of W2, wherein W1/W2 is in a range of from 0.2 to 5.

The fourth embodiment is an apparatus for hot-dip galvanizing, on conducting hot-dip galvanizing continuously to a steel strip via a sink roll located in a plating tank which contains a molten metal by immersing the steel strip therein and by traveling the steel strip therethrough, which apparatus is characterized in that a separation wall is located inside of the plating tank to divide the plating tank into a placing zone where the steel strip is subjected to hot dip plating, and a dross removing zone where dross in the molten metal bath is removed and a sold phase metal for plating is dissolved therein, thus conducting plating to the steel strip in the plating zone, that the molten metal bath above the sink roll in the plating zone is transferred to the dross removing zone using a mechanical pump, and that a weir is located on the separation wall, through which weir the supernatant bath after removed the dross in the dross removing zone is recycled to the plating zone having the same bath surface level with that in the dross removing zone.

The fifth embodiment is the apparatus for hot-dip galvanizing described in the fourth embodiment, which apparatus is characterized in that a heating device is located in the dross removing zone to conduct heating control so as the temperature of the molten metal bath in the plating zone to become a predetermined level.

The sixth embodiment is the apparatus for hot-dip galvanizing described in the fourth embodiment or the fifth embodiment, which apparatus is characterized in that the plating zone has a molten metal bath capacity of W1, and the dross removing zone has a molten metal bath capacity of W2, wherein W1/W2 is in a range of from 0.2 to 5.

According to the Best Mode 4, the make up of zinc which was brought out by adhesion to the steel strip, or the dissolving solid phase zinc (ingot), is done in the dross removing zone. Thus, the plating zone receives the zinc in a form of liquid zinc from the dross removing zone. Consequently, the variations of temperature of the molten metal bath (melt) in the plating zone become less, which prevents the generation and growth of the dross in the plating zone.

Since the melt containing dross in the plating zone is transferred to the dross removing zone using the mechanical pump, there occurs no problem of quality and operation, such as generation of fume and top dross, which are observed in the case of using a gas lift pump. In addition, the use of mechanical pump improves unstable transfer of the melt appearing in utilizing the flow accompanied with the traveling steel strip, and assures the transfer of melt from a portion of high concentration of dross to the dross removing zone at a necessary flow rate.

Since the dross removing zone is separated by the separation wall from the plating zone, no agitation of the melt in the dross removing zone caused from the traveling steel strip occurs, so that the flow becomes calm to enhance the sedimentation of the dross. Furthermore, dissolving the ingot in the dross removing zone enhances the sedimentation and removal of dross owing to the reduction of local melt temperature and to the changes in aluminum concentration. With these two actions, the dross is efficiently and promptly removed in the dross removing zone.

The supernatant bath after removing dross in the dross removing zone is preferentially recycled to the plating zone via the weir located on the separation wall. Since the liquid level of the dross removing zone and that of the plating zone are equal, no top dross is generated in the plating zone on recycling the supernatant bath.

The apparatus is a simple one only separating the plating zone from the dross removing zone. Accordingly, the apparatus is fabricated at a low investment cost, and solves several problems such as the investment cost problem accompanied with melt transfer to a distant tank, and the problems of solidification and leak of melt.

According to the Best Mode 4 the heating device located in the dross removing zone conducts the control of melt temperature in the plating zone. When the heating device is located in the plating zone, it is preferable that the heating device generates only heat at a low output to ensure a constant temperature of the melt in the plating zone. In the plating zone, the hot melt does not contact the steel strip. As a result, the elution of iron from the steel strip is suppressed to reduce the generation of bottom dross, and the effect to prevent the deposition of dross in the plating zone is further improved.

If more than one heating device are installed in the dross removing zone, the heaving devices may be handled as a single group to control the melt temperature in the plating zone. Alternatively, these heating devices may be separated into two groups, and the one group may conduct control of the melt temperature in the plating zone, while other group may conduct control of the melt temperature in the vicinity of the ingot-dissolving zone in the dross removing zone, thus assuring more reasonable heating of the total plating tank.

Since the portion above the sink roll in the plating zone is in a state of less exchange of bath the concentration of dross likely increases. If the suction opening of the mechanical pump is located in the portion, the molten metal bath of higher concentration portion is preferentially transferred to the dross removing zone. Thus, the effect of preventing dross deposition in the plating zone and the effect of preventing dross adhesion to the steel strip are further improved. In addition, the dross is further effectively sedimented and removed in the dross removing zone. The suction opening is preferably located within 500 mm above the sink roll and within the width of the sink roll.

By locating the weir on the separation wall at 500 mm or less of depth below the bath surface, the melt near the bath surface having excellent cleanliness can be preferentially recycled to the plating zone. Accordingly, the cleanliness of the melt in the plating zone is further improved. The weir is most preferably in a shallow one such as a groove flow passage.

When the capacity of the plating zone and the capacity of the dross removing zone are defined as W1 and W2, respectively, if W1/W2 becomes 0.2 or more, the effect of dross removal in the dross removing zone is further improved. If, however, W1/W2 exceeds 5, the effect of dross removal saturates, and the capacity of the plating zone increases, which increases the investment cost and the quantity of the molten metal. Therefore, W1/W2 is preferably in a range of from 0.2 to 5.

Figure 22:
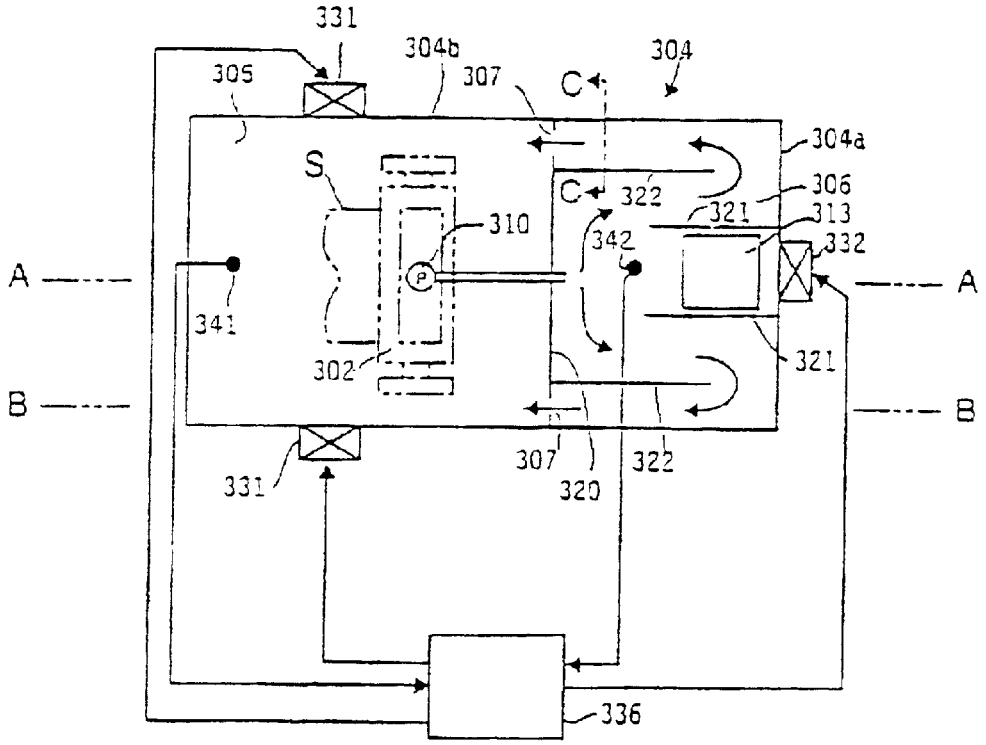
FIG. 22 shows the plan view of the apparatus for ho-dip galvanizing of the Best Mode 4.
Figure 23A:
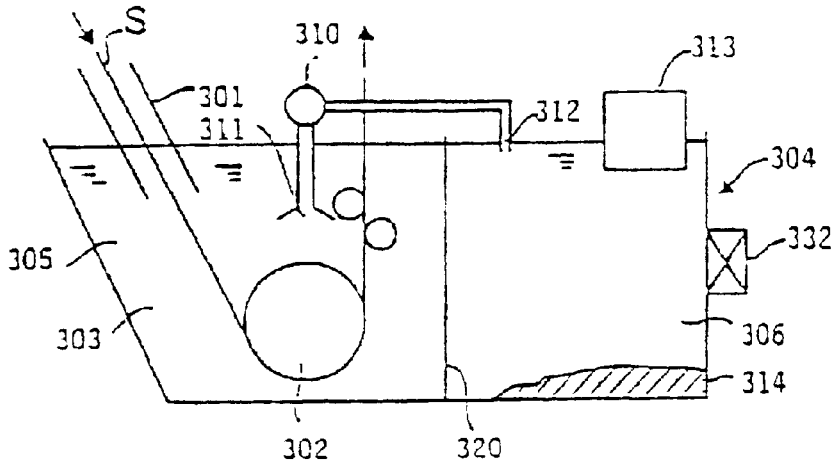
FIG. 23 shows the cross sectional views of the apparatus for hot-dip galvanizing of FIG. 22.
Figure 23B:
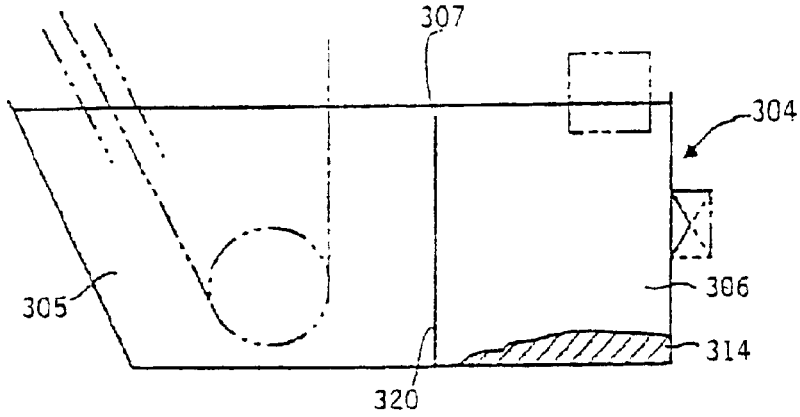
Figure 23C:
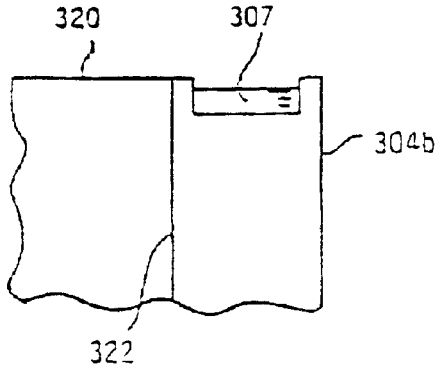

The Best Mode 4 is described referring to FIGS. 22 and 23. FIG. 22 shows the plan view of the apparatus for hot-dip galvanizing of the Best Mode 4. FIG. 23 shows the cross sectional views of the apparatus for hot-dip galvanizing of FIG. 22. FIG. 23(*a*) is the cross sectional view along A—A line. FIG. 23(*b*) is the cross sectional view along B—B line. FIG. 23(*c*) is the cross sectional view along C—C line.

In these figures, the reference number 301 is the snout, 302 is the sink roll, 303 is the molten metal bath (melt), 304 is the plating tank, 305 is the plating zone, 306 is the dross removing zone, 307 is the weir, and 310 is the mechanical pump.

In the above-described apparatus, the steel strip S travels in the arrow direction to enter the plating zone 305 through the snout 301, and the steel strip S changes the travel direction around the sink roll 302, then is taken out from the molten metal bath 303. After being adjusted the coating weight in a coating weight controller (not shown), the steel strip S is cooled and subjected to a specified post-treatment to become a plated steel strip. The melt 303 containing the dross in the plating zone 305 is transferred to the dross removing zone 306 by the mechanical pump 310 to sediment and remove the dross in the dross removing zone 306, then the melt 303 is recycled to the plating zone 305 via the weir 307.

The plating tank 304 is divided into the plating zone 305 to conduct plating the steel strip S, and the dross removing zone 306 to sediment and remove the dross and to dissolve the ingot 313, by the separation wall 320 located in the plating tank 304.

The plating zone 305 is provided with a pair of heating devices 331 and a thermometer 341. The dross removing zone 306 is provided with a heating device 332 at near the charge portion of the ingot 313. The heating devices 331, 332 are induction heating devices.

The pair of heating devices 331 heat the melt in the plating zone 305 and control the melt temperature to a specified level. The heating to dissolve the ingot 313 and the heating the melt 303 up to the operation temperature of the plating zone 305 are done by the heating device 332 in the dross removing zone 306 via the controller 336 so as the temperature detected by the thermometer 341 in the plating zone 305 to become a specified level. Since the make up of zinc which was brought out by adhesion to the steel strip S is not given in the plating zone 305, the temperature changes in the melt 303 in the plating zone 305 is minimized. Furthermore, since the hot melt 303 ejected from the heating devices 331 does not contact the steel strip S, the elution of iron from the steel strip S is suppressed, and the generated amount of the bottom dross is reduced.

A ceramics mechanical pump 310 for transferring the melt 303 from the plating zone 305 to the dross removing zone 306 is mounted between the plating zone 305 and the dross removing zone 306. The suction opening 311 of the pump is preferably located within 500 mm above the sink roll and within the width of the sink roll. Since the melt 303 in a zone of high dross concentration in the plating zone 305 is efficiently sucked, the dross deposition in the plating zone 305 is prevented.

The mechanical pump means a pump such as a volute pump (centrifugal pump), a turbine pump, and a displacement pump, which transfers melt directly contacting the melt to working parts of the pump. The mechanical pump described here does not include a gas lift pump.

If the pumping head of the melt 303 is increased the melt 303 disturbs the bath surface on splashing thereto, which generates large amount of top dross (zinc oxide). To prevent the phenomenon, the pumping head is required to minimize. According to the apparatus of FIG. 22, the pump discharge opening 312 is located at near the bath surface in the dross removing zone 306, so that the dross generation caused from the disturbance on the bath surface is avoided. In addition, since the plating zone 305 and the dross removing zone 306 are separated from each other by the separation wall 320, the transfer distance of the melt 303 is short. Thus, there occurs no problem of solidification and leak of the melt 303 during the melt transfer.

In the dross removing zone 306, dissolving the ingot 313 and sedimentation and removal of the bottom dross 314 are carried out. The dross removing zone 306 is provided with the separation walls 321, 322 to efficiently sediment and remove the bottom dross 314 without fail.

The separation walls 321, 322 uniformize the flow of melt 303 in the dross removing zone 306, thus improving the efficiency of sedimentation and removal of the dross. Adding to the action, the local melt temperature and the aluminum concentration changes accompanied with the ingot dissolving are increased, thus enhancing the sedimentation and removal of the dross.

The weir 307 on the separation wall 322 is preferably located at 500 mm or less below the bath surface. The apparatus of FIG. 22 has the weir 307 at near the bath surface. The dissolved ingot melt is mixed to the flow, and the supernatant bath in the vicinity of the bath surface having high cleanliness after sedimented and removed the dross preferentially overflows from the weir 307 to return to the plating zone 305. Since the melt 303 flows with very little flow resistance, there appears very little difference in the level of melt 303 between the plating zone 305 and the dross removing zone 306. As a result, when the melt 303 returns to the plating zone 305, no top dross is generated.

The expression that the same bath level in both the dross removing zone and the plating zone, referred in the present invention, includes not only the same level in both zones but also the case that, even if a difference in liquid level exists, no generation of top dross which induces quality degradation occurs on returning the melt 303 from the dross removing zone 306 to the plating zone 305, furthermore, includes the case that the transfer is carried out in liquid-filled state without containing gas phase.

In the apparatus shown in FIG. 22, the plating zone 305 has 15 $m^3$ in capacity and 3 m in depth, and the dross removing zone 306 has 12 $m^3$ in capacity and 2 m in depth. In the apparatus of FIG. 22, the quantity of the melt transferred by the pump is the circulation flow rate. Since the target dross for removal has a sedimentation speed of 1 m/h, if the retention time necessary for sedimentation and removal of the dross in the melt 303 in the dross removing zone 306 is assumed as 2 hours, the circulation flow rate of 6 $m^3$/h is sufficient. However, since the apparatus of FIG. 22 does not establish perfect uniformized flow in the dross removing zone 306, the time necessary for sedimenting the dross is assumed as double the above-described time, to set 4 hours of retention time. Thus, the apparatus of FIG. 22 sets the circulation flow rate to 3 $m^3$/h.

When the pump suction opening 311 was located excessively near to the sink roll 302 in the plating tank 304, the contact between the suction opening and the sink roll gave flaws on the sink roll. When the pump suction opening 311 was located at a distance of 500 mm or more from the sink roll, the dross floating in the vicinity of the sink roll could not be sucked. Consequently, the suction opening 311 was set at 300 mm directly above the sink roll. The width of the suction opening 311 was set within the maximum width of the steel strip S.

The apparatus of FIG. 22 has the capacity of the plating zone 305 larger than that of the dross removing zone 306. The capacity of the plating zone 305 is preferably minimum. Even when the capacity of the plating zone 305 is reduced, the capacity of the dross removing zone 306 is preferably not reduced. If the capacity of the dross removing zone 306 is significantly larger than that of the plating zone 305 the necessary dross removal is able to be conducted in the dross removing zone 306 under an increased circulation flow rate. Since the increased circulation flow rate assures the agitation in the plating zone 305, the effect to prevent the deposition of the dross in the plating zone 305 is improved. By increasing the capacity of the dross removing zone 306, the effect of sedimentation and removal of dross in the dross removing zone 306 is improved.

When the plating zone 305 has a molten metal bath capacity of W1, and the dross removing zone has a molten metal bath capacity of W2, W1/W2 is preferably in a range of from 0.2 to 5.

Figure 24A:
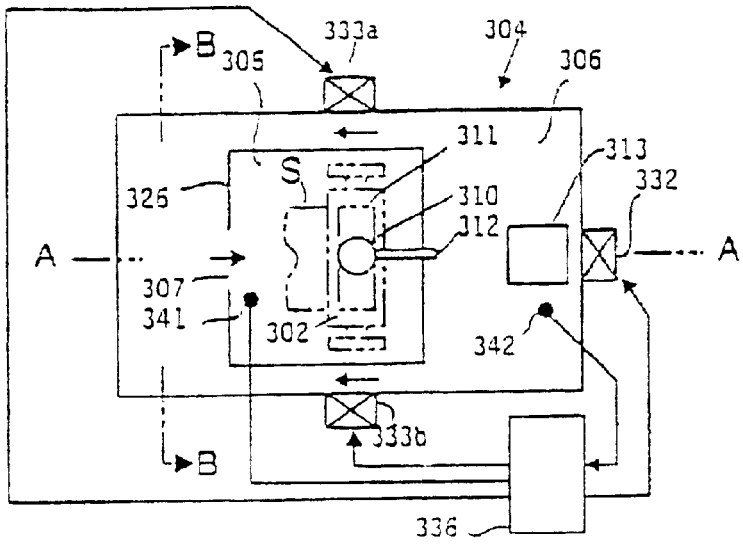
FIG. 24 shows another apparatus for hot-dip galvanizing of the Best Mode 4.
Figure 24B:
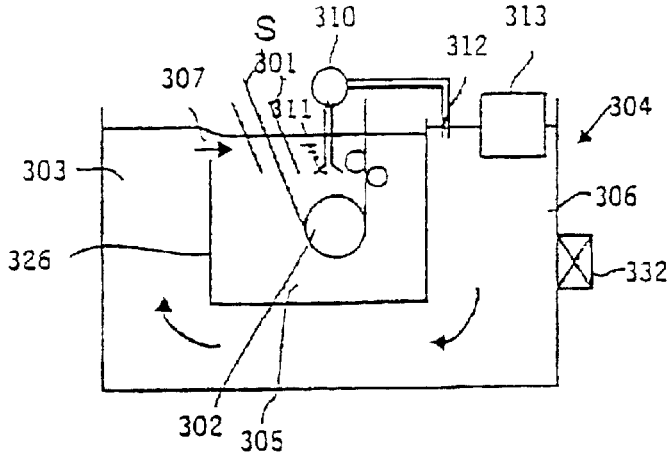
Figure 24C:
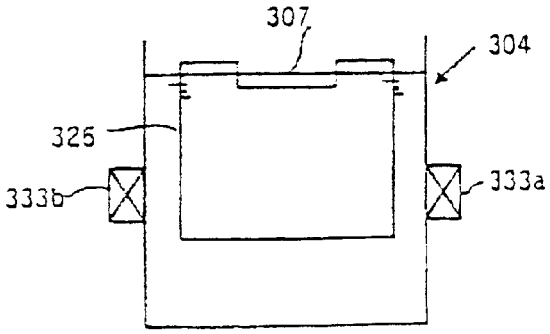

Another embodiment of the Best Mode 4 is described referring to the apparatus for hot-dip galvanizing shown in FIG. 24. In the figure, the same portions explained in FIGS. 22 and 23 have the same respective reference numbers. The mechanical pump for transferring the melt is the mechanical pump having suction and discharge openings similar to those of the apparatus of FIGS. 22 and 23. The heating device is an induction heating device.

The apparatus of FIG. 24 is provided with a separation wall 326 to let the plating zone 305 positioning above the dross removing zone 306. FIG. 24(*a*) is the plan view of the apparatus. FIG. 24(*b*) is the cross sectional view along A—A line of FIG. 24(*a*). FIG. 24(*c*) is the cross sectional view along B—B line of FIG. 24(*a*). The weir 307 is located on the separation wall 326 at near the bath surface and rear side of the snout 301. The heating device 332 is located at near the ingot-dissolving portion, and the heating devices 333*a,* 333*b* are located on respective side walls of the plating tank 304. The plating zone 305 is provided with a thermometer 341, and the dross removing zone 306 is provided with a thermometer 342.

According to the apparatus, all of the heating of the melt 303 in the plating zone 305 to maintain a specified level, the heating of the ingot to melt, and the heating of the melt 303 up to the operation temperature of the plating zone 305 are conducted by the heating devices 332, 333*a,* 333*b* in the dross removing zone 306. As for the dissolving of the ingot and for the heating of the melt 303 up to the operation temperature in the plating zone 306, the controller 336 is applied to control the heating devices by gathering the heating devices 332, 333*a,* 333*b* as one group, based on the melt temperature of the plating zone 305 detected by the thermometer 341, or alternatively, the heating devices 333*a,* 333*b* are gathered to form the first group, and the heating device 332 is set as the second group, then the controller 336 controls the output of the first group, or the heating devices 333*a* and 333*b,* based on the melt temperature in the plating zone 305 detected by the thermometer 341, while the output of the second group, or the heater 332, is adjusted on the basis of the melt temperature in the dross removing zone 306 detected by the thermometer 342.

The melt 303 in the plating zone 305 is transferred to the dross removing zone 306 by the mechanical pump 310. While the melt 303 flows in the arrow direction shown in FIG. 24 at sides and below the plating zone 305 in the dross removing zone 306, and the dross is sedimented and removed. The supernatant bath after sedimented and removed the dross is recycled to the plating zone 305 through the weir 307 which is located on the separation wall 326 at rear side of the snout 301.

Since the apparatus of FIG. 24 allows to secure a large capacity of the dross removing zone 306, the retention time for sedimentation and removal of bottom dross is sufficient in the dross removing zone 306.

According to the Best Mode 4, when what is called the "tandem pot" plating apparatus is installed having plurality of plating tanks for producing different grades of hot-dip galvanized steel strips each having significantly different compositions of coating films the plurality of plating tanks may be installed on a single vehicle for assuring quick replacement of the applied plating tanks, and for simultaneously moving there each.

According to the Best Mode 4, the amount of dross generated during the hot-dip galvanizing on steel strip is reduced, the once-generated dross is prevented from deposition in the plating tank, and the dross is efficiently removed in the dross removing tank located below the plating tank. Consequently, the quality defects caused from the dross adherence to the steel strip are reduced. The Best Mode 4 allows to produce high quality hot-dip galvanized steel strip.

The apparatus of the Best Mode 4 has no additional tank for removing the dross an existing facility may be modified to apply the present invention. The apparatus is a simple and inexpensive one, and solves several problems such as solidification and leak of melt occurred accompanied with the transfer of melt. Furthermore, the apparatus does not induce additional operational and quality problems accompanied with the transfer of melt, which are encountered in gas lift pump application.

In addition, even when the plurality of plating tanks are installed for producing different grades of hot-dip galvanized steel strips, the apparatus according to the Best Mode 4 is advantageous owing to the small space for installation.

Best Mode 5

The essentials of the Best Mode 5 are the following.

The first embodiment is a method for hot-dip galvanizing, on conducting hot-dip galvanizing continuously to a steel strip, which was traveled through a snout, via a sink roll located in a plating vessel which contains a molten metal by immersing the steel strip therein, which method is characterized in that a plating tank is located in the bath of plating vessel to cover the sink roll, that a shielding member is located to shield a gap formed between a lower portion of the snout beneath the steel strip and an upper portion of the side walls of the plating tank, thus dividing the plating vessel into a plating zone and a dross removing zone, that the steel strip is immersed in the plating zone to conduct hot-dip galvanizing, that a mechanical pump is used to discharge the molten metal bath in the plating zone to the dross removing zone, that the dross in the molten metal bath is removed in the dross removing zone, and a solid phase metal for plating is dissolved in the dross removing zone, and that the molten metal bath is recycled from the dross removing zone to the plating zone.

The second embodiment is the method for hot-dip galvanizing described in the first embodiment, which method is characterized in that the plating tank is positioned so as the upper edge of the plating tank to become higher level than that of the rotary shaft of the sink roll.

The third embodiment is an apparatus for hot-dip galvanizing, comprising a plating vessel having a snout through which a steel strip travels, and having a sink roll which guides the steel strip traveled through a snout, and containing a molten metal, which apparatus is characterized in that a plating tank is located in the bath of the plating vessel to cover the sink roll, that a shielding member is located to shield a gap formed between a lower portion of the snout beneath the steel strip and an upper portion of the side walls of the plating tank, thus dividing the plating vessel into a plating zone and a dross removing zone, that the steel strip is immersed in the plating zone to conduct plating, that the dross removing zone removes the dross in the molten metal bath and dissolves a solid phase metal for plating, that a mechanical pump is used to discharge the molten metal bath in the plating zone to the dross removing zone, and to recycle the molten metal bath from the dross removing zone to the plating zone.

The fourth embodiment is the apparatus for hot-dip galvanizing described in the embodiment 3, which apparatus is characterized in that the plating tank is positioned so as the upper edge of the plating tank to become higher level than that of the rotary shaft of the sink roll.

According to the Best Mode 5, the plating tank is located in the bath of the plating vessel to cover the sink roll, and the shielding member is located to shield a gap formed between the lower portion of the snout beneath (or rear surface side of) the steel strip and an upper portion of the side walls of the plating tank, thus substantially dividing the plating vessel into the plating zone and the dross removing zone.

According to the Best Mode 5, the make up of zinc which was brought out by adhesion to the steel strip, or the dissolving solid phase zinc (ingot), is done in the dross removing zone. Consequently, the variations of temperature of the molten metal bath in the plating zone become less, which reduces the generation of the dross in the plating zone.

Since the melt containing dross in the plating zone is transferred to the dross removing zone using the mechanical pump, there occurs no problem of quality and operation, such as generation of fume and top dross, which are observed in the case of using a gas lift pump. In addition, the use of mechanical pump improves unstable transfer of the melt appearing in utilizing the flow accompanied with the traveling steel strip, and assures the transfer of melt from a portion of high concentration of dross to the dross removing zone at a necessary flow rate.

Since no agitation of the melt in the dross removing zone caused from the traveling steel strip occurs in the dross removing zone, the flow becomes calm to enhance the sedimentation of the dross. Furthermore, dissolving the ingot in the dross removing zone enhances the sedimentation and removal of dross owing to the reduction of local melt temperature and to the changes in aluminum concentration. With these two actions, the dross is efficiently and promptly removed in the dross removing zone.

The supernatant bath after removing dross in the dross removing zone is preferentially recycled to the plating zone. Since the flow of melt gives very little flow resistance, there appears very little difference in the level of melt between the dross removing zone and the plating zone. Therefore, no top dross is generated in the plating zone on recycling the melt.

When the plating tank is positioned in the bath of plating vessel so as the upper edge of the plating tank to become higher than the level of the rotary shaft of the sink roll, the deposition of dross in the plating tank is prevented, thus giving further enhanced effect to reduce the generation of dross adhesion to the steel strip.

The apparatus is a simple one only separating the plating zone from the dross removing zone by installing the plating tank in the plating vessel. Accordingly, the apparatus is fabricated at a low investment cost, and solves several problems such as the investment cost problem accompanied with melt transfer to a distant tank, and the problems of solidification and leak of melt.

Figure 25:
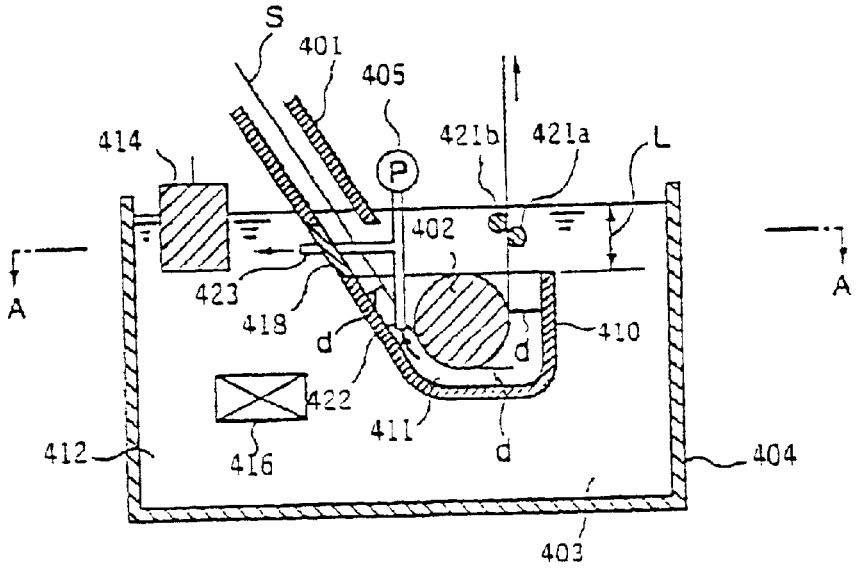
FIG. 25 shows a cross sectional view of the apparatus for hot-dip galvanizing of the Best Mode 5.
Figure 26:
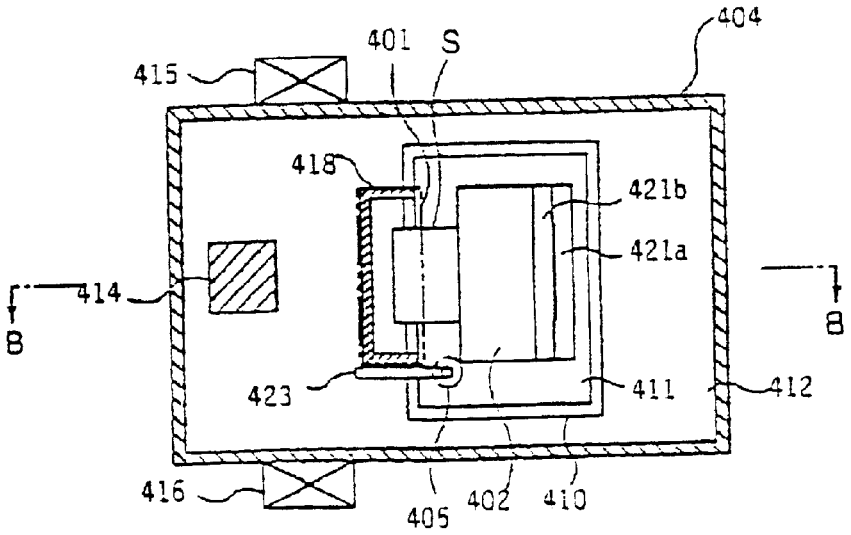
FIG. 26 is the cross sectional view along A—A line of the apparatus of FIG. 25.

The Best Mode 5 is described referring to FIGS. 25 and 26. FIG. 25 shows a cross sectional view of the apparatus for hot-dip galvanizing of the Best Mode 5, (the cross sectional view along B—B line of FIG. 26 given below). FIG. 26 is the cross sectional view along A—A line of the apparatus of FIG. 25. In these figures, the reference number 401 is the snout, 402 is the sink roll, 403 is the molten metal bath (melt), 404 is the plating tank. The plating tank 410 is located in the bath of the plating vessel 404 to cover the sink roll 402. The shielding member 418 is located in the plating vessel 404 to shield the gap formed between the lower portion of the snout 401 at lower surface side of the steel strip and the upper portion of the side walls of the plating tank 410. The plating vessel 404 is divided into the plating zone 411 which conducts plating the steel strip S, and the dross removing zone 412 which sediments and removes the dross and which dissolves the ingot 414. The plating tank 410 and the shielding member 418 are attached to the plating vessel 404 by respective hanging jigs or fixed to the bottom of the plating vessel 404 by respective support jigs. The reference number 405 designates the mechanical pump that discharges the molten metal bath from the plating zone 411 to the dross removing zone 412. The dross removing zone 412 is provided with a pair of heating devices (induction heating devices) 415, 416.

According to FIG. 25, the upper end of the plating tank 401 is opened to the dross removing zone 412 in the bath opposite to the charge portion of the ingot 414. Actually, however, jigs (not shown) to support the support rolls 421*a*, 421*b*, other than the sink roll, and the jigs (not shown) to support these under-bath facilities are arranged in the apparatus. Accordingly, the melt 403 in the bath is able to be divided into the plating zone 411 and the dross removing zone 412. Thus, the melt 403 in upper portion of the plating tank 410 belongs to the plating zone 411, and the melt 403 in other portions belong to the dross removing zone 412.

In the above-described apparatus, the steel strip S travels in the arrow direction to enter the plating zone 411 through the snout 401, and the steel strip S changes the travel direction around the sink roll 402, then is taken out from the molten metal bath 403. After being adjusted the coating weight in a coating weight controller (not shown), the steel strip S is cooled and subjected to a specified post-treatment to become a plated steel strip.

The melt 403 containing the dross in the plating zone 411 is transferred to the portion dissolving the ingot 414 in the dross removing zone 412 by the mechanical pump 405 to sediment and remove the dross in the dross removing zone 412. The melt 403 after sedimented and removed the dross in the dross removing zone 412 is recycled to the plating zone 411 flowing through the gap between the upper end of the plating tank 410 opposite to the portion dissolving the ingot 414 and the bath surface.

According to the apparatus, the plating tank 410 does not have a heating device. The temperature control of the melt in the plating zone 412 is done by the heating devices 415, 416 located in the dross removing zone 412 and by the adjustment of temperature of the traveling steel strip.

When the ingot 414 is charged into the dross removing zone 412, the temperature of melt flowing into the plating zone 411 through the gap between the upper end of the plating tank 410 opposite to the portion dissolving the ingot 414 and the bath surface is controlled to a specified level by adequately functioning the heating devices 415, 416.

The shielding member 418 shields the gap formed between the upper end of the plating tank 410 opposite to the portion dissolving the ingot 414 and the bath surface, thus prevents the influence of the hot bath flow coming from the heating devices 415, 416, and of the local bath temperature reduction to the plating zone 411, and also reduces the fluctuations of bath temperature and bath composition in the plating zone 411. Furthermore, the shielding member 418 prevents the occurrence of the phenomena of bath flow caused from the heating devices 415, 416 stirring up the once-sedimented and removed dross in the dross removing zone 412 to entering the plating zone 411.

Since the ingot 414 is not dissolved in the plating zone 411, the temperature variations of the melt 403 in the plating zone 411 become minimum. Since the temperature control of the melt 403 in the plating zone 411 is done by the heating devices 415, 416 of the dross removing zone 411, the hot melt 403 ejected from the induction heating devices does not contact the steel strip S. As a result, the elution of iron from the steel strip S is suppressed, and the generation of dross in the plating zone 411 is reduced.

The apparatus is provided with a ceramics mechanical pump 405 in the plating vessel 410. The pump has a suction opening at the bottom portion of the plating tank 410, and a discharge opening 423 at the portion of dissolving the ingot 414. The pump transfers the melt 403 at bottom portion of the plating tank 410 to the dross removing zone 412. Since the position of the suction opening of the mechanical pump 405 is located as described above, even in the case that the line speed is slow and that the width of steel strip is narrow, the melt 403 containing dross which may deposit on the bottom of the plating tank 410 is surely transferred to the dross removing zone 412, thus preventing the dross deposition in the plating tank 410. Since the dross likely deposits on the bottom center portion of the plating tank 410, the suction opening 402 of the mechanical pump is preferably positioned at near the bottom center portion of the plating tank 410.

From the viewpoint of traveling performance of the steel strip, of attaching/detaching the rolls placed in the plating tank 410, of attaching/detaching the jigs for supporting the rolls, and of prevention of dross deposition caused from weakened agitation of the melt 403 at bottom portion of the plating tank 410, the gap (d) between the inner walls of the plating tank 410 and the steel strip S, and between the edges of sink roll in the two axial directions and the inner walls of the plating tank 410 are preferably in an approximate range of from 250 to 500 mm.

According to the apparatus, since the plating tank 410 is placed in the bath of the plating vessel 404. As a result, the problems of solidification and leak of the melt 403 during transfer thereof are substantially solved. Furthermore, the melt 403 in the plating zone 411 can be transferred to the dross removing zone 412 at necessary amount.

The mechanical pump means a pump such as a volute pump (centrifugal pump), a turbine pump, and a displacement pump, which transfers melt directly contacting the melt to working parts of the pump. The mechanical pump described here does not include a gas lift pump.

In the dross removing zone 412, dissolving the ingot and sedimentation and removal of bottom dross are conducted. In the dross removing zone 412, there appears no agitation of melt 403 caused from the traveling steel strip S, so that the flow of melt 403 is uniformized. Adding to the action, the local melt temperature reduction and the aluminum concentration changes accompanied with the ingot dissolving are increased, and the sedimentation and removal of dross are enhanced, thus increasing the efficiency of sedimentation and removal of the dross.

The dross removing zone 412 may have a separation plate, at need, to uniformize the flow of the melt 403 for efficient sedimentation and removal of the bottom dross.

In the dross removing zone 412, the dissolved ingot melt is mixed to the flow, and the supernatant bath in the vicinity of the bath surface having high cleanliness after sedimented and removed the dross preferentially flows through the gap between the upper edge of the plating tank 410 and the bath surface and preferentially returns to the plating zone 411. Since the melt 403 flows with very little flow resistance, there appears very little difference in the level of melt 403 between the plating zone 411 and the dross removing zone 412. As a result, when the melt 403 returns to the plating zone 411, no top dross is generated.

Since the clean melt 403 after removed the dross returns to the plating zone 411, and since the quantity of dross generated in the plating zone 411 is small, the effect of preventing the dross deposition in the plating tank 410 becomes excellent.

With the apparatus of FIG. 25, the inventors of the present invention studied the occurrence of quality defects caused from the adherence of dross thereto by changing the vertical position of the plating tank 410 to very the relative position to the sink roll 402. The plating tank 410 had a depth of 1 m, and the sink roll had a diameter of 750 mm. The result is shown in FIG. 27.

Figure 27:
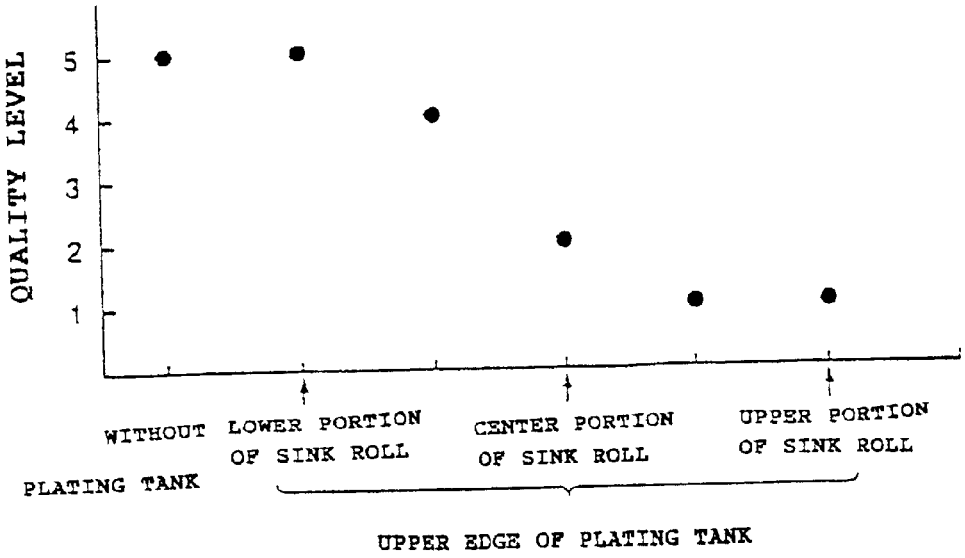
FIG. 27 shows the status of generation of quality defects caused from the dross adherence to the steel strip under the conditions of varied position between the plating tank and the sink roll in the apparatus of FIG. 25.

In FIG. 27, the horizontal axis is upper edge position of the plating tank 410 as the relative position to the sink roll 402. The lower portion of the sink roll indicates that the upper edge of the plating tank 410 only reaches the lower edge of the sink roll. The upper portion of the sink roll indicates that the upper edge of the plating tank 410 reaches up to the upper edge of the sink roll. The vertical axis shows the occurrence state of quality defects caused from the adherence of dross, and gives five grade evaluation (indexes 1 through 5) responding to the degree of dross adherence determined by visual observation of the steel strip S after plating. Index 1 is the best, which is the quality level currently requested for the high quality hot-dip galvanized steel strip. The current level is the index 5.

When the upper edge of the plating tank 410 is above the lower edge of the sink roll 402, or when the plating tank 410 is located to cover the sink roll 402, the dross adhesion is prevented, and the effect for improving the quality becomes significant. If the upper edge of the plating tank 410 becomes above around the centerline of the sink roll 402, the index becomes 1, giving particularly excellent quality.

The presumable reason of the phenomenon is the following. The flow of melt 403 accompanied with the traveling steel strip S changes its direction to the strip width direction at the position contacting with the sink roll 402, then collides against a side wall of the plating tank 410, and the flow is divided into the upward flow and the downward flow. The downward flow becomes a driving force for agitating the bath to prevent deposition of the bottom dross in the plating tank 410. In a shallow plating tank in which that kind of flow is difficult to appear, agitation is insufficient, and the bottom dross deposits in the plating tank 410. Thus, changes of traveling speed of the steel strip or changes of width of traveling steel strip induce stirring up of once-deposited bottom dross resulting in adhesion to the steel strip S.

To separate the plating zone 411 from the dross removing zone 412, it is preferable to keep the distance between the upper edge of the plating tank 410 and the bath surface (L) within 1000 mm.

Figure 28:
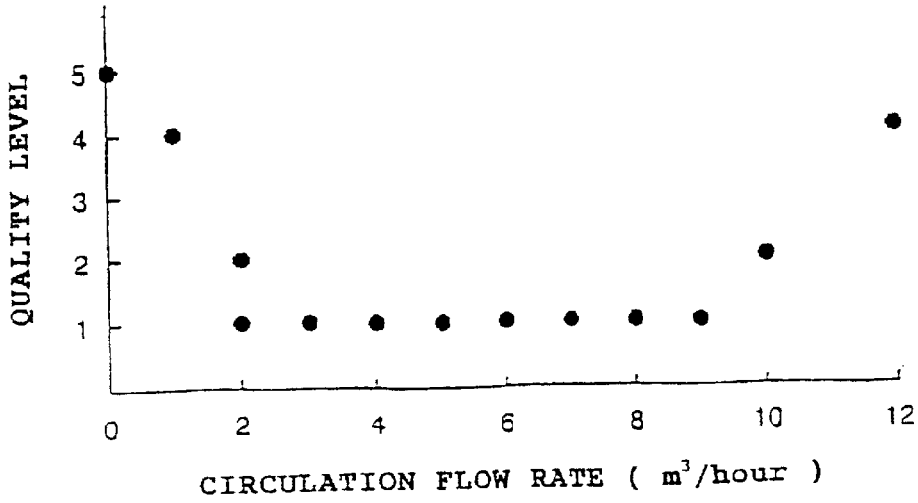
FIG. 28 shows the relation between the circulation flow rate and the generation of dross defects caused from adherence of dross to the steel strip in the apparatus of FIG. 25.

The inventors studied the generation of quality defects on the steel strip S caused from the adhesion of dross by conducting the plating on steel strip S under the conditions that the capacity of the plating tank 410 and of the dross removing zone 412 is fixed to 5 $m^3$ and 20 $m^3$, respectively, while changing the circulation flow rate (transfer rate of the mechanical pump). The result is shown in FIG. 28.

When the circulation flow rate was large, once-deposited dross was stirred up owing to the insufficient sedimentation and removal of dross in the dross removing zone 412 or owing to the melt 403 discharged from the mechanical pump 405, which presumably flew in the plating zone 411 to induce quality defects. The dross removing zone 412 should secure the retention time not less than the dross sedimentation time. The above-described quality defects were reduced with the reduction in circulation flow rate. And, when the circulation flow rate becomes not more than 10 $m^3$/h, products free from quality defects can be produced. However, when the circulation flow rate further reduced to below 1 $m^3$/h, the dross remained in the plating zone 411, not being discharged to the dross removing zone 412, which increased the index and degrades the quality. To produce high quality hot-dip galvanized steel strip, the circulation flow rate is necessary to control between 1 and 10 $m^3$/h.

Example

The Example used the apparatus shown in FIG. 25. The plating vessel 404 had 2.5 meters in depth. The plating tank 410 had 5 $m^3$ in capacity, and the dross removing zone 412 had 25 $m^3$ in capacity. The sink roll 402 had 750 mm in diameter. The gap between the sink roll 402 and the bottom of the plating tank 410, the gap between the steel strip S entered through the snout 401 into the plating zone and the inner walls of the plating tank 411 until the steel strip S contacts with the sink roll 410, and the gap between the steel strip S after detached from the sink roll 402 and the side walls of the plating tank 410, were set to 300 mm. The plating tank 410 was positioned so as the upper edge thereof to become 700 mm of distance from the bath surface, while the upper edge comes nearly equal level of the upper edge of the sink roll.

The dross sedimentation speed which raises problem in ordinary hot-dip galvanizing is around 1 meter per hour. Since the depth of the plating vessel 404 was 2.5 meters, the dross removing zone 412 required 2.5 hours or longer retention time. If the circulation flow rate is not more than 10 $m^3$/h, the retention time exceeds 2.5 hours, which expects the dross removal effect. On the other hand, if the circulation flow rate becomes below 1 $m^3$/h, the dross remains in the plating zone 411 to cause the generation of quality defects. Considering the abovedescribed conditions, the circulation flow rate was selected to 3 $m^3$/h.

The above-described apparatus was applied to hot-dip galvanizing to a steel strip. The generation of dross defects on the plated steel strip became zero, compared with around 2% of defect generation in conventional production line. Thus, the problem of dross adherence was completely solved. As a result, the steel strip traveling speed could be increased from conventional level of 100 m/min to 160 m/min.

According to the Best Mode 5, the amount of dross generated during the hot-dip galvanizing on steel strip is reduced, the once-generated dross is prevented from deposition in the plating tank, and the dross is efficiently removed in the dross removing zone in the plating vessel, the quality defects caused from the adhesion of dross to steel strip are reduced. According to the present invention, high quality hot-dip galvanized steel strip can be produced.

Since the plating tank according to the Best Mode 5t can be installed in an existing plating vessel, an existing apparatus may be modified to readily conduct the present invention.

Best Mode 6

The essentials of the Best Mode 6 are the following.

(1) An apparatus for hot-dip galvanizing comprises a plating bath tank which holds a hot-dip galvanizing bath containing aluminum at contents of 0.05 wt. % or more, and a snout through which a steel strip immersed in the plating bath tank travels, wherein the plating bath tank is divided by a separation wall into a plating tank which conducts plating to the steel strip and a dross removing tank which dissolves an ingot and which sediments and removes dross, and the plating tank and the dross removing tank are connected to each other at directly below the snout and at a part of exit of the steel strip so as the connecting passage to have 0.1 meter or larger hydraulic diameter (defined by a formula given below) and so as the bath levels of both tanks to become equal to each other, and the plating bath in the snout is sucked by a pump from both longitudinal edges of the snout to discharge the sucked bath to a portion where no steel strip travels, thus cleaning the plating bath surface in the snout and circulating the plating bath between the plating tank and the dross removing tank, wherein the hydraulic diameter is defined as Hydraulic diameter={(Cross sectional area of flow passage)/(Wet length of flow passage)}×4

(2) The apparatus for hot-dip galvanizing of (1) is characterized in that the capacity of the plating tank is not more than 10 $m^3$, and the capacity of the dross removing tank is not less than 10 $m^3$.

(3) A method for hot-dip galvanizing by immersing a steel strip traveled through a snout in a hot-dip galvanizing bath containing 0.5 wt. % or higher aluminum concentration in a plating bath tank, which method comprises the steps that the plating bath tank is divided by a separation wall into a plating tank which conducts plating to the steel strip and a dross removing tank which dissolves an ingot and which sediments and removes dross, that the plating tank and the dross removing tank are connected to each other at directly below the snout and at a part of exit of the steel strip so as a connecting passage to have 0.1 meter or larger hydraulic diameter (defined by a formula given below) and so as the bath levels of both tanks to become equal to each other, and that the plating bath in the snout is sucked by a pump from both longitudinal edges of the snout to discharge the sucked bath to a portion where no steel strip travels thus cleaning the plating bath surface in the snout and circulating the plating bath between the plating tank and the dross removing tank, wherein the hydraulic diameter is defined as Hydraulic diameter={(Cross sectional area of flow passage)/(Wet length of flow passage)}×4

(4) The method for hot-dip galvanizing of (3) is characterized in that the capacity of the plating tank is not more than 10 $m^3$, and the capacity of the dross removing tank is not less than 10 $m^3$, and that the circulation flow rate between the plating tank and the dross removing tank is in a range of from 0.5 to 5 $m^3$/h.

The Best Mode 6 is described in detail in the following.

To improve the workability of plating film on a hot-dip galvanized steel strip, the plating bath consists mainly of zinc contains 0.05 % by weight (hereinafter referred to as "wt. %") of aluminum. When a steel strip is immersed in the plating bath, iron is eluted from the steel strip to become dross.

According to the Best Mode 6, a separation wall is located in the plating bath tank to divide thereof into the dross removing tank and the plating tank. Thus, while the dross in the plating tank is in a small size, the plating bath (molten metal) is transferred from the plating tank to the dross removing tank. During a long sedimentation time, the dross is sedimented and removed from the plating bath containing fine dross in the dross removing tank. After cleaned, the plating bath is recycled to the plating tank.

Figure 29:
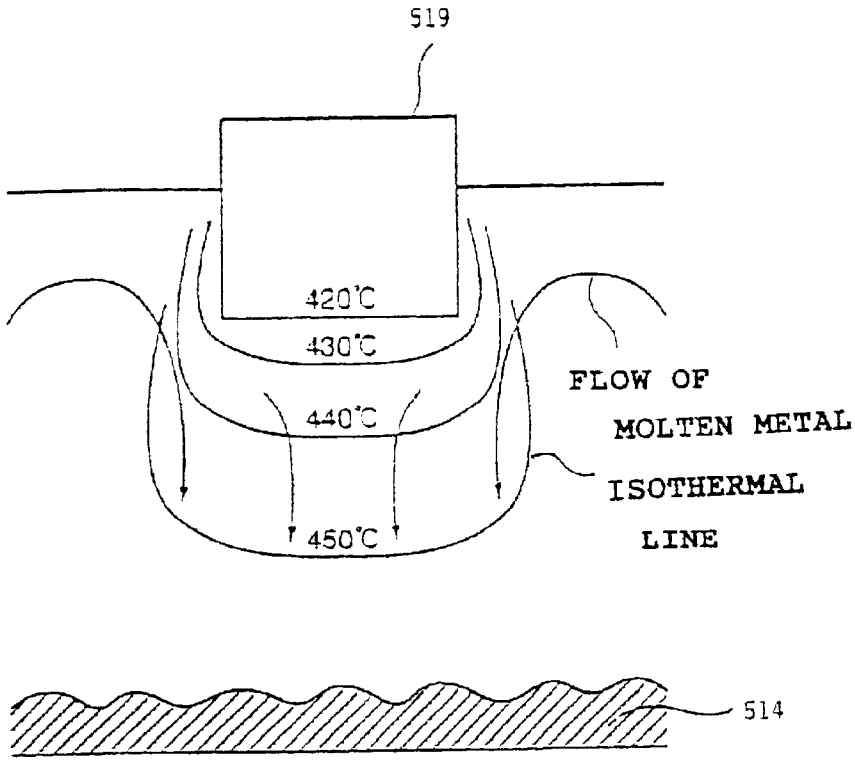
FIG. 29 illustrates the temperature distribution of plating bath in the vicinity of an ingot when the ingot is thrown into the plating bath.

In ordinary operation, make up of the zinc taken out carried by the traveling steel strip is done by dissolving a low temperature ingot in the plating thank which is maintained to a specified temperature. In that case, as seen in FIG. 29 the temperature around the ingot 519 becomes lower than the bulk bath temperature. Since the iron solubility in the plating bath is reduced by the temperature reduction, the iron in the plating bath generates intermetallic compounds of zinc or aluminum.

According to the Best Mode 6, the make up of zinc which was brought out by adhesion to the steel strip, or the dissolving solid phase zinc (ingot), is done in the dross removing tank. Consequently, the variations of temperature of the plating bath in the plating tank become less, which reduces the generation of the dross in the plating tank.

Regarding the transfer of the plating bath, an immersed pump which cleans the bath surface of the snout is located to produce further high quality plated steel strip. The molten zinc is sucked from both ends of the snout at its longitudinal side, and is discharged to the portion where no steel strip travels. Each passage is located at directly below the snout of pump suction side and at exit of the steel strip from the plating tank to connect the plating tank with the dross removing tank. The plating bath flows from the dross removing tank to the plating tank via the flow passage directly below the snout. The plating bath flows from the plating tank to the dross removing tank via the flow passage at exit of the steel strip.

Normally, the snout bath surface has foreign matter such as zinc oxide and dust which were separated and dropped from the wall surface of the snout, which foreign matter may cause the surface defects of the plated steel strip.

Owing to the pump, the snout bath is discharged to keep the cleanliness of the snout bath surface and to provide high quality plated steel strip. Furthermore, the flow established by the pump allows to form a stable flow in the direction of width of steel strip ranging from the inlet of steel strip in the plating tank to the exit thereof thus improving unstable transfer of plating bath using the flow accompanied with the traveling steel strip, and allowing the transfer of plating bath from a portion of high dross concentration to the dross removing tank at a necessary amount without fail.

According to the Best Mode 6, the plating bath is exchanged before the dross grows to a harmful size. To do this, the plating tank preferably has a capacity of 10 $m^3$ or less. The plating bath containing fine dross discharged from the plating tank is received in the dross removing tank, where the dross is removed by taking a long time. To do this, the capacity of the dross removing tank is preferably 10 $m^3$ or more.

To assure the cleanliness of the bath surface in the snout, the circulation flow rate of plating bath between the plating tank and the dross removing tank is preferably from about 0.5 to about 5 $m^3$/h. If the circulation flow rate is less than 0.5 $m^3$/h, quality defects occur owing to the delayed exchange of bath surface. If the circulation flow rate exceeds 5 $m^3$ /h, waving and splash occur on the bath surface owing to the excessive flow rate, which causes other quality defects. Regulation of the flow rate in the above-described range is further advantageous for transferring the plating bath from the plating tank to the dross removing tank while the dross in the plating tank is still in a small size.

The dross in the plating tank is transferred from the plating tank to the dross removing tank while the dross in the plating tank is still in a small size. The dross is sedimented and removed taking a long time in the dross removing tank. Inside of the dross removing tank, no agitation of plating bath caused from the traveling steel strip occurs, thus the flow becomes calm, and the dross becomes easily sediment. Furthermore, dissolving the ingot in the dross removing tank enhances the sedimentation and removal of dross owing to the reduction of local plating bath temperature and to the changes in aluminum concentration. With these two actions, the dross is efficiently and promptly removed in the dross removing tank.

The plating bath after removing dross in the dross removing tank is preferentially recycled to the plating tank via the flow passage having a specified hydraulic diameter and being located at directly below the snout of the plating tank. Since the flow of plating bath gives very little flow resistance, there appears very little difference in the level of plating bath between the dross removing tank and the plating tank. Therefore, no top dross is generated in the plating tank on recycling the plating bath.

The apparatus is a simple one only separating the plating tank from the dross removing tank by installing the separation wall in the plating bath tank. Accordingly, the apparatus is fabricated at a low investment cost, and solves several problems such as the investment cost problem accompanied with plating bath transfer to a distant tank, and the problems of solidification and leak of the plating bath.

Figure 30:
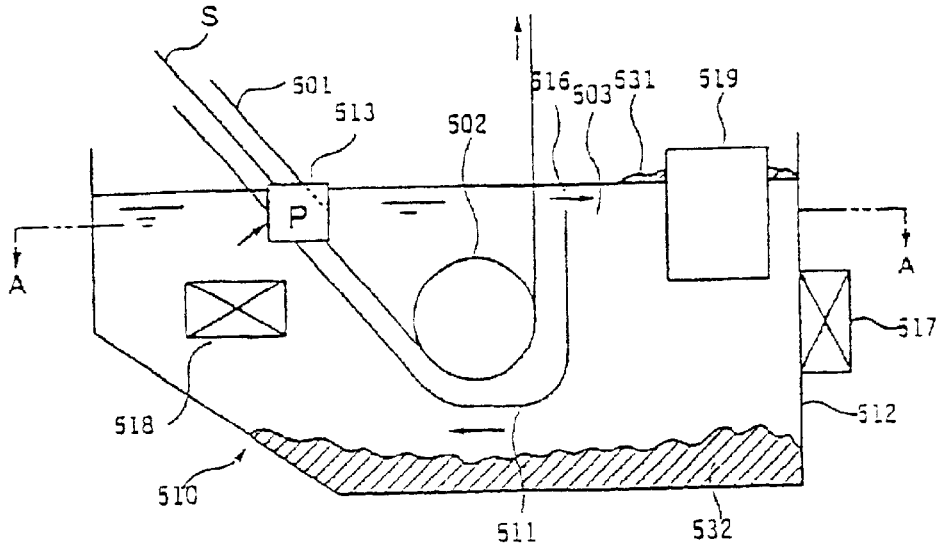
FIG. 30 shows the plating apparatus of the Best Mode 6.
Figure 31:
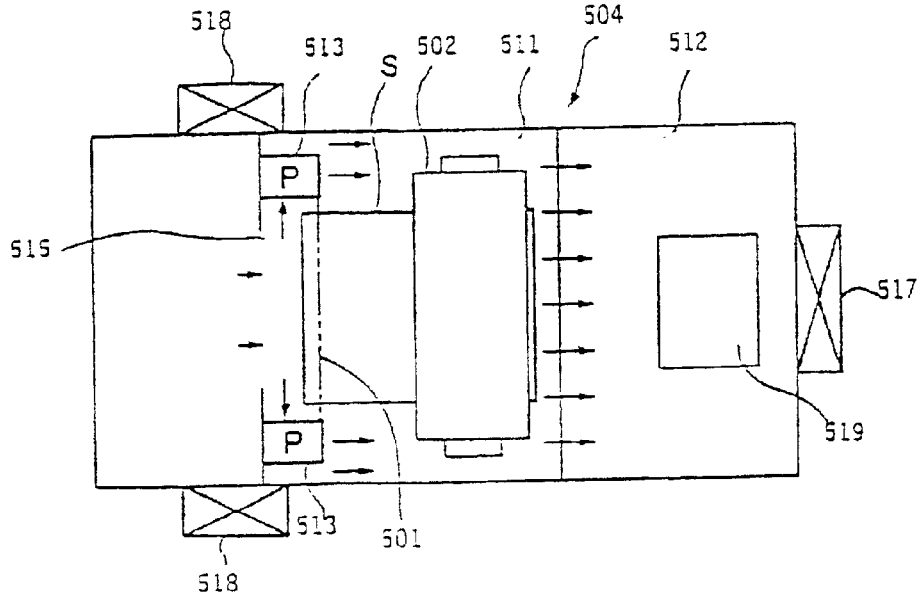
FIG. 31 shows the cross sectional view along A—A line of the plating apparatus of FIG. 30.

The Best Mode 6 is described referring to FIGS. 30 through 33. FIG. 30 shows the plating apparatus of the Best Mode 6. FIG. 31 shows the cross sectional view along A—A line of the plating apparatus of FIG. 30.

In these figures, the reference number 501 is the snout, 502 is the sink roll, 503 is the plating bath, 510 is the plating bath tank, 511 is the plating tank, 512 is the dross removing tank, and 513 is the mechanical pump. The plating bath tank 510 is divided into the plating tank 511 and the dross removing tank 512 by the tank walls of the plating tank 511. The dross removing tank 512 is located below the plating tank 511. The reference numbers 517 and 518 are heating devices (induction heating devices), and 519 is the ingot.

The steel strip S travels in the arrow direction to enter the plating tank 511 through the snout 501, thus being plated while immersing in the plating tank 511. The steel strip S changes the travel direction around the sink roll 502, then is taken out from the plating bath 503. After being adjusted the coating weight in a coating weight controller (not shown), the steel strip S is cooled and subjected to a specified post-treatment to become a plated steel strip.

According to the embodiment, from the viewpoint of maintenance, the flow passage 515 which is located directly below the snout and which connects the plating tank 511 and the dross removing tank 512 is positioned near the bath surface. The flow passage 516 located at exit of the steel strip is opened at its top side. The transfer of the plating bath between the plating tank 511 and the dross removing tank 512 is done by the mechanical pump 513 which is mounted for cleaning the plating bath surface in the snout.

That is, the flow passage 515 is located at near the bath surface at the tank walls direct bellow the snout 501 in the plating tank 511, while the flow passage 516 is located at a side wall of the exit of steel strip by opening the top side thereof. Thus the plating bath level is equal between the plating tank 511 and the dross removing tank 512. The transfer of plating bath 503 between the plating tank 511 and the dross removing tank 512 is carried out by the mechanical pumps 513 located at both sides of the snout 501 near the flow passage 515 directly below the snout. Each of the pumps sucks the plating bath at a depth ranging from 0 to 500 mm below the bath surface directly below the snout, and discharges the plating bath to a portion where no steel strip S travels in the plating tank 511.

An aluminum-base top dross floats at near the bath surface in the dross removing tank 512. The plating bath 503 is sucked by the mechanical pump 513, and the supernatant bath having high cleanliness at slightly below the bath surface of the dross removing tank 512 is discharged to the plating tank 511.

Since the plating bath 503 is circulated by the mechanical pumps 513, there occurs no problem of quality and operation, such as generation of fume and top dross, which are observed in the case of using a gas lift pump.

Figure 32:
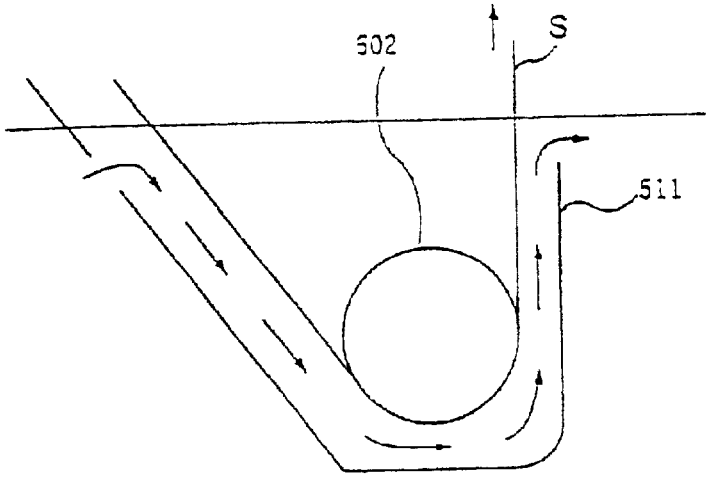
FIG. 32 illustrates the flow pattern of the plating bath at positions of presence of steel strip.
Figure 33:
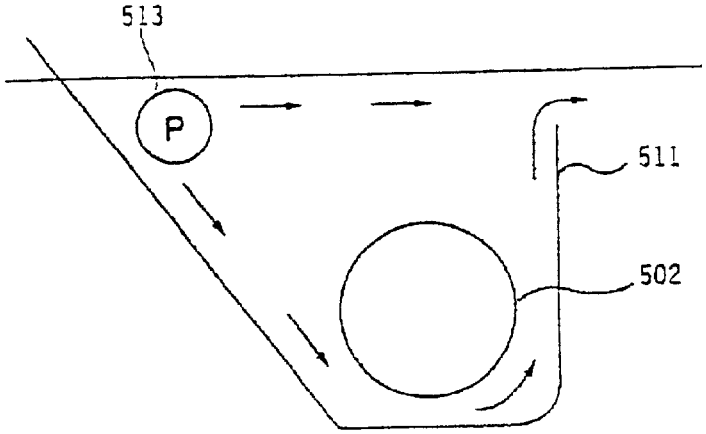
FIG. 33 illustrates the flow pattern of the plating bath at positions of absence of steel strip.

By introducing the plating bath 503 which was sucked by the mechanical pumps 513 to the portion of plating tank 511 where no steel strip S travels, the flow of plating bath 503 in the plating tank 511 is brought to two-dimensional flow as far as possible, thus preventing the formation of three-dimensional flow. Normally, when no flow is forcefully formed by a pump, the flow of plating bath 503 in the plating tank 511 is governed by the flow accompanied with the traveling steel strip S, thus establishing a stagnant portion in the plating tank 511. The appeared stagnant portion causes stirring up of once-deposited dross in the case that the width of traveling steel strip S increases. By introducing the plating bath 503 discharged from the mechanical pumps 513 to a portion where no steel strip S travels, the portion where the steel strip S travels establishes a two-dimensional flow, as seen in FIG. 32, while the portion where the steel strip S does not travel establishes two-dimensional flow owing to the flow of plating bath 503 discharged from the pumps, as seen in FIG. 33. As a result, the occurrence of stagnant portion in the plating tank 511 is prevented, thus solving the problems of dross deposition and of stirring up of once-deposited dross.

As for the plating bath 503 which was brought out by adhering to the traveling steel strip S, the plating bath level is kept unchanged by charging the ingot 519 to the dross removing tank 512 to dissolve by the heating devices 517, 518. At near the ingot 519 in the dross removing tank 512, iron and aluminum react to each other to generate the top dross 531, while zinc and iron react to each other to generate the bottom dross 532. Although the generation of dross varies with the concentration of aluminum in the ingot 519, finally the dross deposits mainly in the dross removing tank 512 and is removed there, so that the generation of dross in the plating tank 511 is significantly suppressed.

Increasing the size of flow passage brings the passage similar with normal plating tank 504. Therefore, the size of the flow passage has an optimum level. Since there are many kinds of cross sectional shapes of the flow passage, such as circular and rectangular shapes, the inventors of the present invention studied the sizes of flow passage using the definition of hydraulic diameter applied in hydrodynamics. The hydraulic diameter is defined by dividing the cross sectional area of flow passage by the wet length of the flow passage, or the peripheral length of the cross section of the flow passage, and multiplied by 4. In the case of circular cross section, the hydraulic diameter becomes the diameter of the circular cross section. For the case of square cross section, the hydraulic diameter becomes the length of a side of the square.

The study on the hydraulic diameter revealed that a flow passage having not more than 50 mm of hydraulic diameter induced the generation of solidified zinc in the flow passage to fail in establishing stable transfer of the molten metal, which means that these sizes of hydraulic diameter are not applicable to practical uses. The hydraulic diameter is necessary around 100 mm at the minimum. On the other hand, increasing the size of flow passage induced mixed function allotment between the plating tank 511 and the dross removing tank 512, and the dross generation in the plating tank 511 increased. The study suggested that the hydraulic diameter is preferably not more than 0.5 m. The embodiment used the plating tank 511 having 8 $m^3$ in capacity, the dross removing tank 512 having 2.5 m in depth and 12 $m^3$ in capacity. The flow passage 515 located directly below the snout of the plating tank 511 had 1500 mm in cross sectional width and 200 mm in height. The flow passage 516 located at the side of upward travel of the steel strip had 2500 mm in cross sectional width and 100 mm in height. That is, the hydraulic diameter of respective flow passages was 353 mm and 192 mm. The pump discharge rate was adjusted to 3 $m^3$/h of circulation flow rate.

The embodiment showed no dross defects on the plate steel strip, which was observed at around 2% of the products in conventional apparatus, and no problem on dross appeared.

Another embodiment used the apparatus of FIGS. 30 and 31, having the plating tank 510 with 2 m in depth, the dross removing tank 512 with 20 $m^3$ in capacity, and the flow passages 515 and 516 with the same dimensions as in the above-described embodiment. The dross sedimentation speed which raises problem in ordinary hot-dip galvanizing is around 1 meter per hour. Since the depth of the plating tank 510 was 2 meters, the dross removing tank 512 required 2 hours or longer retention time. If the circulation flow rate is not more than 10 $m^3$/h, the retention time exceeds 2 hours, which expects the dross removal effect. On the other hand, if the circulation flow rate becomes below 0.5 $m^3$/h, the dross remains in the plating tank 511 to cause the generation of quality defects. Considering the above-described conditions, the circulation flow rate was selected to 5 $m^3$/h.

The inventors carried out the hot-dip galvanizing to a steel strip using the above-described apparatus, and found that no dross was generated under a condition of line speed of 120 m/min, and no dross-related problem occurred even after increased the line speed to 160 m/min.

According to the Best Mode 6, the dross generated in the plating tank is transferred to the dross removing tank which is separated from the plating tank to remove the dross as the top dross or the bottom dross. Accordingly, the generation of bottom dross in the plating tank is reduced, the deposition of the bottom dross is prevented, and, at the same time, the bath surface in the snout is cleaned. According to the invention, the apparatus for hot-dip galvanizing prevents the generation of surface defects on the steel strip caused from the dross, and the generation of surface defects caused from zinc oxide and the like in the snout, so that high quality hot-dip galvanized steel strip is produced.

In addition, the apparatus has a simple structure to solve serious problems such as leak and solidification of plating bath in the flow passage, and offers excellent operability.

Best Mode 7

The inventors of the present invention studied the flow of molten zinc in a molten zinc tank (plating pot) commonly used in ordinary operation, the mechanism of dross generation, and the behavior of dross in the plating pot. The study revealed the following.

Figure 34A:
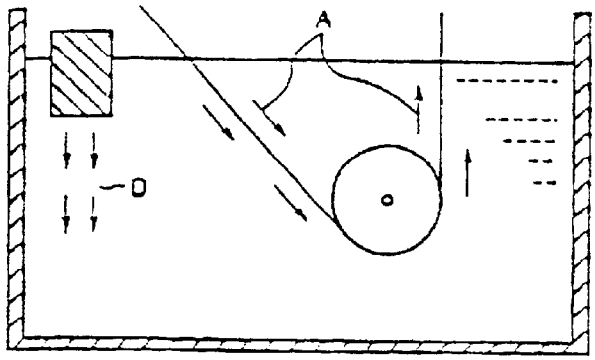
FIGS. 34(*a*), 34(*b*), and 34(*c*) are schematic drawings of the flow pattern of molten zinc in the plating pot.
Figure 34B:
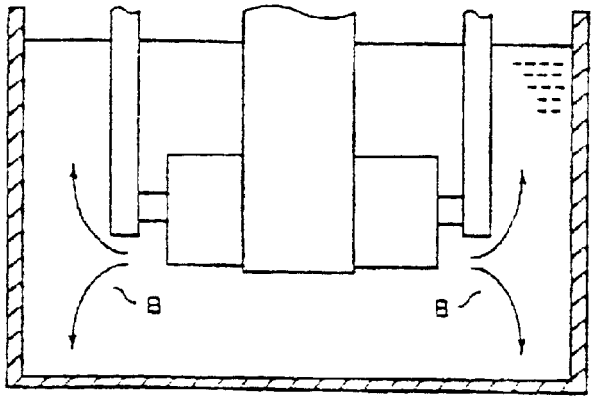
Figure 34C:
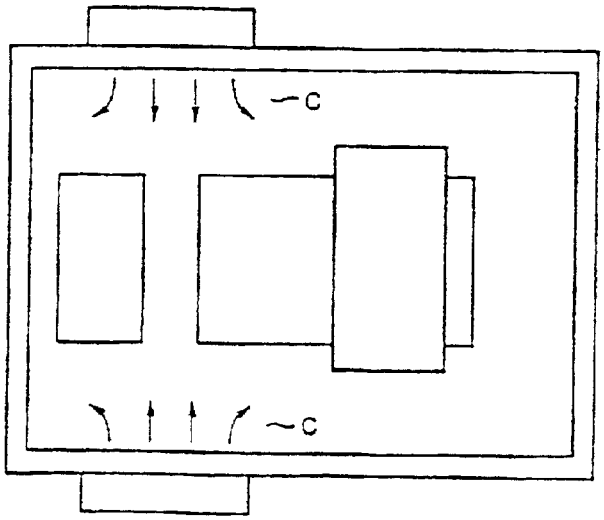

That is, as shown in FIGS. 34(*a*), (*b*), and (*c*), the driving forces of molten zinc flow in the plating pot are:

1. The molten zinc flow accompanied with the strip traveling in the plating pot, which is expressed by the symbol A of FIG. 34(*a*);
2. The discharge flow which is formed from the accompanied flow which lost the exit thereof at the points of contact on to the strip and the sink roll, and which changed the flow direction thereof in the shell length direction of the sink roll, which discharge flow is expressed by the symbol B of FIG. 34(*b*);
3. The flow induced by electromagnetic force of the induction heating device to hold the heat of or to heat the molten zinc, which is expressed by the symbol C of FIG. 34(*c*): and
4. The flow of natural convection caused from nonuniform temperature of molten zinc, induced in the vicinity of the ingot-charge point for supplying solid phase zinc, which is expressed by the symbol D of FIG. 34(*a*).

A cold model experiment relating to a molten plating bath flow, introduced in "Tetsu To Hagane (Iron and Steel)", Vol. 81, No. 7, (1995), described that the above-given flow A plays the principal role. The inventors of the present invention analyzed the data of dross sedimentation distribution, and found that the flows of B and C are equally important to the flow of A.

As shown in FIG. 34, the data of water model tests revealed the following. That is, concentrated deposition of dross to a range of from lower portion near the sink roll to the edge portion of the pot is induced by, adding to the re-stirring up of dross caused from the flow A, that the flow B induces the generation of a flow containing dross at the bottom portion from the edge portion of the pot, and the dross is stirred up or collected, and by that the flow C induces stirring up of once-sedimented dross.

On the other hand, it was found that, on entering the strip into the pot, the iron powder attached to the strip or the iron eluted from the strip by reacting with molten zinc reacts with zinc to form intermetallic compounds during the initial period of operation. The intermetallic compounds are fine dross, and the fine dross flows accompanied with the traveling strip to reach the bottom portion of the plating pot. By mixing thus reacted dross with the low temperature plating bath at the bottom portion, or by varying the solubility of iron in the molten zinc and the composition of the intermetallic compounds, the dross is grown.

From the above-described findings, it was found that, to obtain a high quality hot-dip galvanized steel strip with very few quality defects, it is necessary to promptly sediment the dross generated in the molten zinc to the bottom portion of the molten zinc plating bath in the pot to remove thereof, thus cleaning the molten zinc plating bath, and to form a flow without containing coarse dross in the plating portion. To do this, it is necessary that the molten zinc in the vicinity of the sink roll is kept in a strong agitation state thus letting the dross attach to the steel strip while the dross is in a size below the one inducing problem, that dross once-flown out from the peripheral portion of the sink roll is sedimented and removed as far as possible at the portion of non-disturbed flow, and that the coarse dross is prevented from being re-stirred up.

The present invention was derived from the above-described findings, and the first embodiment of the Best Mode 7 provides an apparatus for hot-dip galvanizing, which apparatus comprises: a molten zinc tank which holds a molten zinc and which has a heating means to heat the molten zinc; a sink roll which is immersed in the molten zinc in the molten zinc tank and around which a steel strip is wound; a vessel which holds the sink roll therein and which comprises side panels and a bottom panel, while opening the upper end thereof; whereby hot dip zinc plating is applied to a continuously fed steel plate in the molten zinc tank.

The second embodiment provides the apparatus for hot-dip galvanizing described in the first embodiment, wherein the heating means of the molten zinc tank conducts coreless induction heating.

The third embodiment provides the apparatus for hot-dip galvanizing described in the first embodiment or the second embodiment, wherein the vessel keeps gaps of from 200 to 500 mm between the vessel walls and the steel strip traveling through the vessel, the sink roll, and the jigs to fix the sink roll.

The fourth embodiment provides the apparatus for hot-dip galvanizing described in any one of the first through the third embodiments, which apparatus further comprises a cover which substantially covers the lower surface of the steel strip being immersed in the molten zinc in the molten zinc tank until the steel strip reaches the vessel.

The fifth embodiment provides the apparatus for hot-dip galvanizing described in any one of the first through the fourth embodiments, wherein the vessel has a curved face at joints of the side plates and the bottom plate.

The sixth embodiment provides the apparatus for hot-dip galvanizing described in any one of the first through the fifth embodiments, wherein the vessel has a discharge opening at the bottom thereof to discharge the molten zinc, through which discharge opening the molten zinc is forcefully discharged into the molten zinc tank.

According to the first embodiment, the applied vessel comprises the side plates and the bottom plate to hold the sink roll therein, and the top thereof is opened. With the configuration of the vessel, the flows accompanied with the rotating sink roll and with the traveling steel strip do not appear in the bottom portion of the molten zinc tank. In addition the presence of the side plates of the vessel prevents the flow of molten zinc flowing in the shell direction of the sink roll at the contact point of the steel strip and the sink roll from reaching the bottom of the molten zinc tank. Furthermore, the flow collides against the side plates of the vessel to separate into the flow toward the bottom of the vessel and the upward flow. The flow toward the bottom of the vessel gives an effect of sufficiently mixing the molten zinc in the vessel, and the strong agitation by the effect prevents dross deposition. The upward flow does not become the driving force to stir up the dross at the bottom portion of the molten zinc tank, so that the bottom portion of the molten zinc tank becomes a calm state to allow the dross to sediment and remove. Consequently, very high quality hot-dip galvanized steel strip having very few quality defects is produced.

As seen in the second embodiment, the coreless induction heating reduces local high flow speed caused from convection of molten zinc occurred during heating with conventional injection heater, and the quality defects are further reduced.

As in the case of the third embodiment, by limiting the distance between the steel strip, the sink roll the supporting jigs thereof, and the walls of the vessel to a range of from 200 to 500 mm, the agitation in the vessel is fully performed. That is, since the vessel has to be installed before inserting under-bath facilities and devices such as sink roll, it is preferable that sufficient space for installation is secured and that the space is preferably 200 mm or more to prevent occurrence of local temperature distribution and concentration distribution. If the space exceeds 500 mm, a strong flow which agitates the molten zinc at bottom portion of the vessel appears, and the stable operation becomes difficult.

As in the case of the fourth embodiment, a cover is placed to cover substantially the lower portion of the steel strip until the steel strip which was immersed in the molten zinc in the molten zinc tank reaches the vessel. The configuration increases the effect to shield the accompanied flow between the sink roll and the steel strip, which further improves the effect of sedimentation and removal of dross by calming the molten zinc at bottom of the molten zinc tank.

As seen in the fifth embodiment, the curved joint between the side plates and the bottom plate gives no sharp corner to cause the stagnant flow, thus the agitation effect in the vessel is further improved.

As in the sixth embodiment, the forcefully discharging the molten zinc from the bottom discharge opening of the vessel further effectively prevents the sedimentation of the dross in the vessel. In that case, it is preferable that the molten zinc is discharged upward at a slow speed not to let the discharged flow contribute to the stirring up of the dross on the bottom of the molten zinc tank.

The Best Mode 7 is described in more detail referring to the drawings.

Figure 35:
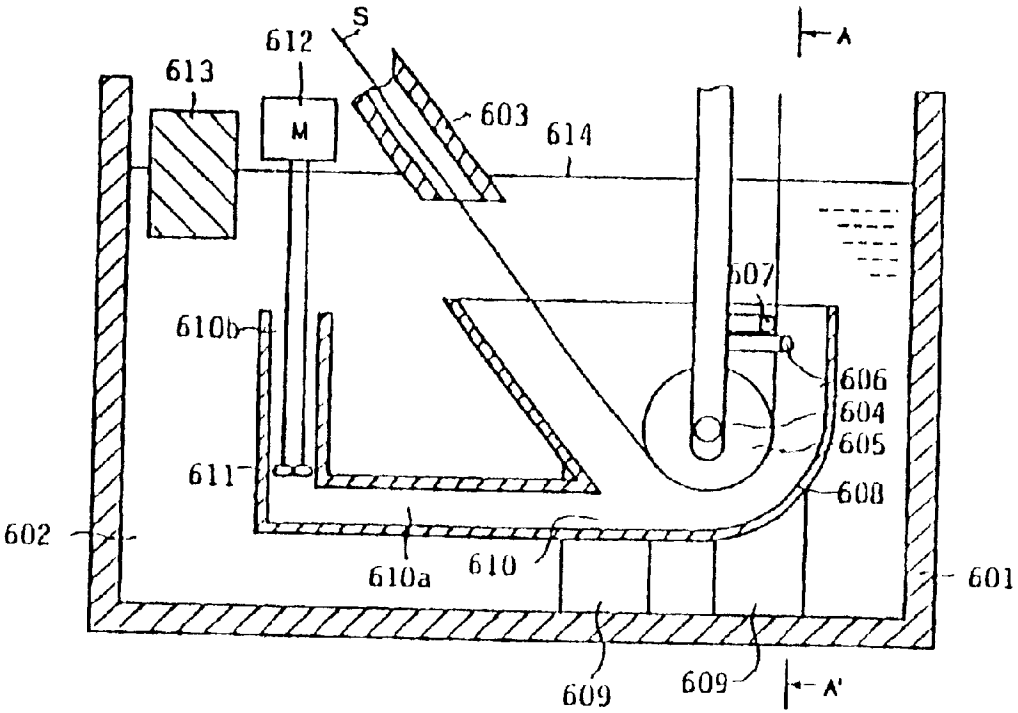
FIG. 35 shows a cross sectional view of a manufacturing apparatus of hot-dip galvanized steel plates according to the first embodiment of the Best Mode 7.
Figure 36:
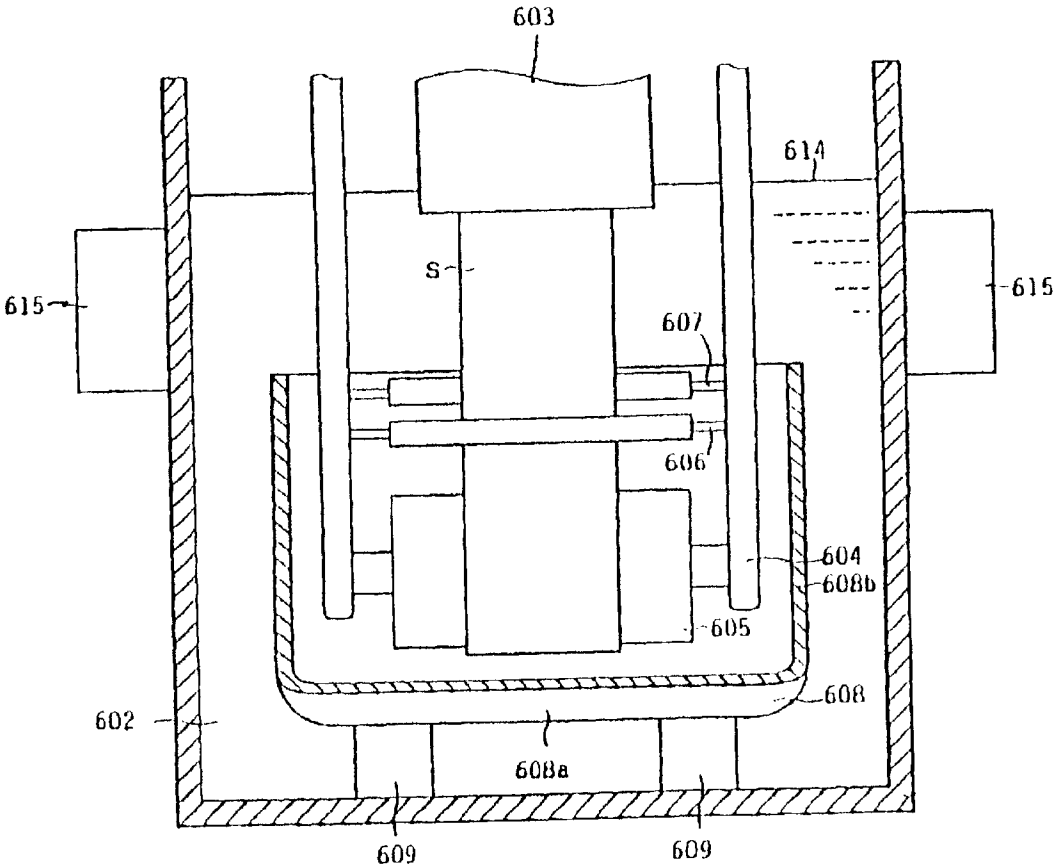
FIG. 36 shows the cross sectional view along A–A' line of FIG. 35.
Figure 37:
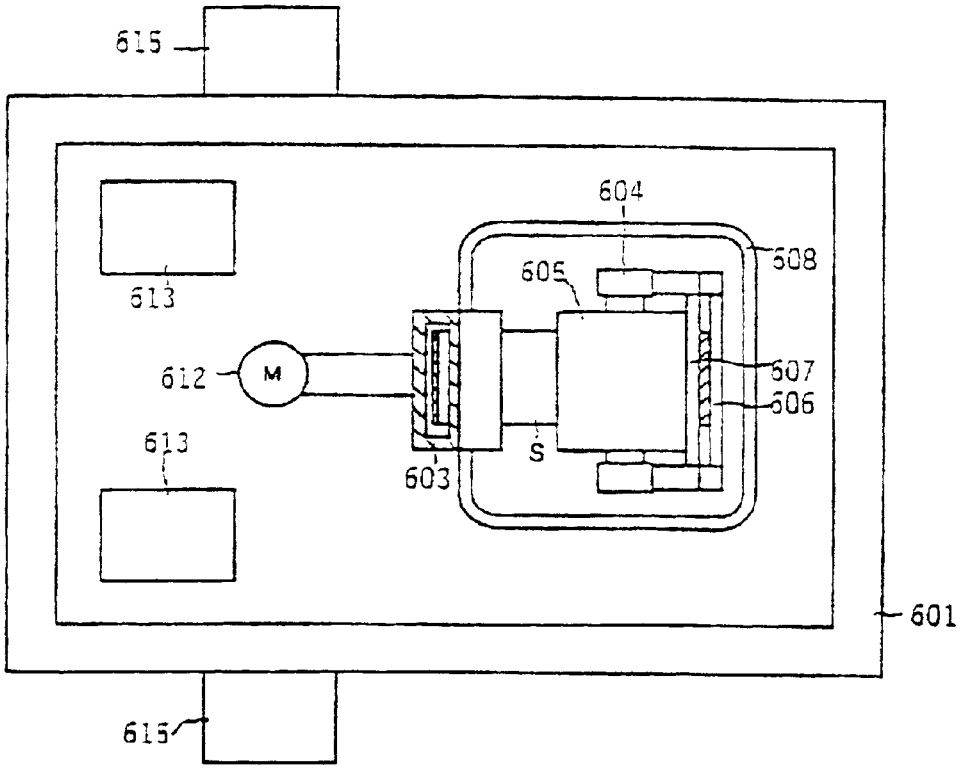
FIG. 37 shows the plan view of the manufacturing apparatus of hot-dip galvanized steel plates according to the first embodiment of the Best Mode 7.

The first embodiment is described referring to FIGS. 35 through 37. FIG. 35 shows a cross sectional view of a manufacturing apparatus of molten zinc-base plated steel plates according to the first embodiment of the Best Mode 7. FIG. 36 shows the cross sectional view along A–A' line of FIG. 35. FIG. 37 shows the plan view of the manufacturing apparatus of molten zinc-base plated steel plates according to the first embodiment.

As seen in these drawings, the apparatus for manufacturing hot-dip galvanized steel strip according to the present invention has the rectangular plating pot 601. The plating pot 601 contains the molten zinc 602 as the plating bath. The plating pot 601 is provided with the sink roll 605 which is immersed in the molten zinc 602, which sink roll 605 is attached to the plating pot 601 by the supporting jigs 604. The steel strip S which is immersed in the molten zinc 602 in the plating pot 601 via the snout 603 is turned around the sink roll 605 to change its traveling direction to upward, then the steel strip S is continuously taken up from the plating pot 601. A pair of support rolls 606, 607 are located above the sink roll 605, by which support rolls the steel strip S is supported to adjust the shape thereof.

The plating pot 601 is provided with the vessel 608 to hold the sink roll 605, the supporting jigs 604, and the support rolls 606, 607. The vessel 608 consists of the bottom plate 608*a* and the side plates 608*b*, while opening the upper end thereof. The joints between the bottom plate 608*a* and the side plates 608*b* are in a curved shape. The vessel 608 is supported at its bottom by the pipe-shape support legs 609.

At center portion of the bottom of vessel 608 in the steel strip width direction, the discharge opening 610 for discharging the molten zinc is located. And, the discharge pipe 610*a* is extended from the discharge opening 610 curving upward. The discharge pipe 610*a* is provided with the ceramics pump 611, which pump is driven by the motor 612 located above the front edge 610*b* of the discharge pipe 610*a*, thus forcefully discharging the molten zinc in the vessel 608 to the plating pot 601 via the discharge opening 610 and the discharge pipe 610*a*. The bottom plate 608*a* and the side plates 608*b* of the vessel 608 are preferably separated from the steel strip S traveling through the vessel 608, the sink roll 605, the support jigs 605, and the support rolls 606, 607, to a range of from 200 to 500 mm. For example, the distance is set to 300 mm.

At near the surface of the molten zinc 602 at the edge of the plating pot 601, the zinc ingot 613 for make up of molten zinc is immersed. At outside the plating pot 601, the induction heater 615 is positioned to heat the molten zinc 602 in the plating pot 601.

According to the apparatus for manufacturing hot-dip galvanized steel strip having the above-described configuration, the steel strip S as the work is continuously immersed in the molten zinc 602 held in the plating pot 601 via the snout 603. The steel strip S changes the traveling direction upward by the sink roll 605, then the steel strip S is taken up from the plating pot 601. A gas-wiper (not shown) removes excess amount of molten zinc to provide a hot-dip galvanized steel strip.

The vessel 608 is structured by the side plates 608*b* and the bottom plate 608*a*, while opening the top thereof. Accordingly, no flow accompanied with the sink roll 605 and with the traveling steel strip S occurs in the bottom portion of the plating pot 601, and the flow of molten zinc flowing in the shell length direction of the sink roll at the contact point of the steel strip S and the sink roll 605 does not reach the bottom of the pot 601. The flow collides against the side wall 608*b* of the vessel 608, and the flow is divided into the downward flow toward the bottom portion of the vessel 608 and the upward flow. The downward flow toward the bottom portion of the vessel 608 functions to sufficiently mix the molten zinc 602 in the vessel 608, and the strong agitation prevents the dross deposition. Since the ascended flow does not become the driving force to stir up the dross, the flow becomes calm in the bottom portion of the plating pot 601 to assure full sedimentation and removal of the dross. As a result, high quality hot-dip galvanized steel strip with very few quality defects is attained.

The walls of the vessel 608 are positioned to keep distances of from 200 to 500 mm from the traveling steel strip S, the sink roll 605, the support jigs 604 supporting the sink roll 605, and the support rolls 606, 607. The configuration assures sufficient agitation of the content of the vessel 608. In addition, the joints between the side plates 608*b* and the bottom plate 608*a* of the vessel 608 are in curved shape, so that the flow of molten zinc in the vessel 608 is in a favorable state, and the agitation effect in the vessel 608 is very high.

The support legs 609 are structured by, for example, cylindrical pipes each having 200 mm in diameter. Therefore, when the vessel 608 is immersed in the plating pot, the molten zinc 602 flows into the vessel 608 from the pipe-shape support legs 609, which makes the vessel 608 readily immerse in the plating pot 601. Furthermore on taking up the vessel 608 the molten zinc 602 in the vessel 608 is discharged from the pipe-shape support legs 609, which also makes the vessel 608 readily being taken up from the plating pot 601. During the operation, since the pipe-shape support legs 609 contact the bottom of the plating pot 601, the molten zinc 602 in the bottom portion of the plating pot 601 does not mix with the bulk content of the vessel.

The ceramics pump 611 is driven by the motor 612 located above the pump 611, and the molten zinc 602 is forcefully discharged from the discharge opening 610 positioned at center portion in the width direction of the steel strip S in the vessel 608 to the plating pot 601 via the discharge pipe 610*a*. Thus, the sedimentation of dross in the vessel 608 is further effectively prevented.

The inventors of the present invention studied the generation of quality defects caused from the adhesion of dross to the steel strip using the apparatus of the embodiment for manufacturing hot dip zinc-plated steel strip. The study confirmed the occurrence of quality defects not more than 1% during the two weeks of continuous operation even under varied line speed. Furthermore, the study confirmed that no coarse dross which may cause problems in working such as pressing appeared.

Figure 38:
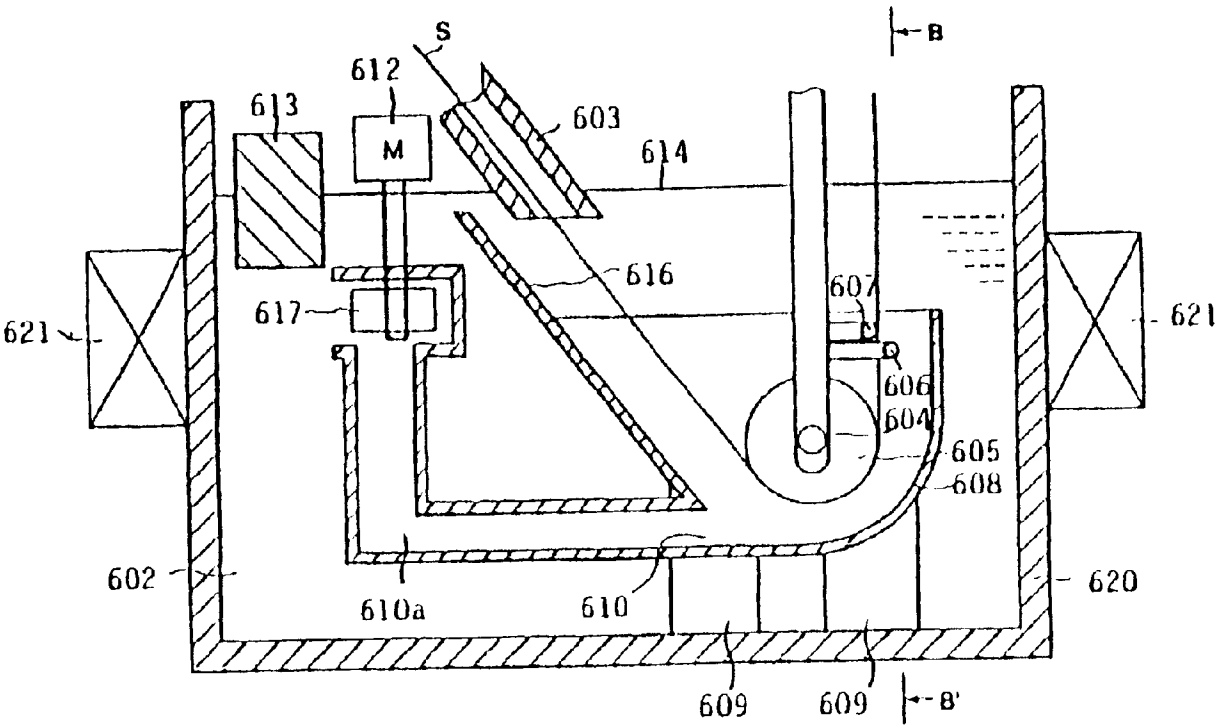
FIG. 38 shows a cross sectional view of the manufacturing apparatus of hot-dip galvanized steel plates according to the second embodiment of the Best Mode 7.
Figure 39:
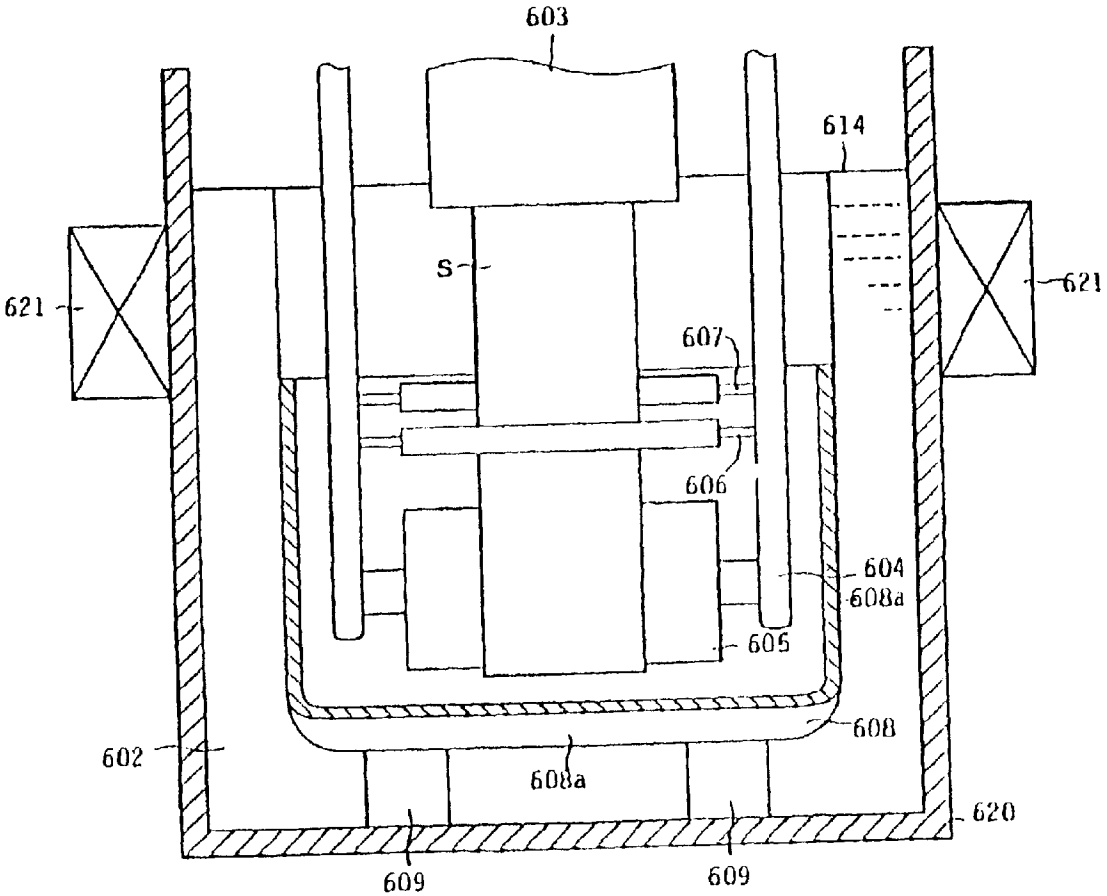
FIG. 39 shows the cross sectional view along B–B' line of FIG. 38.
Figure 40:
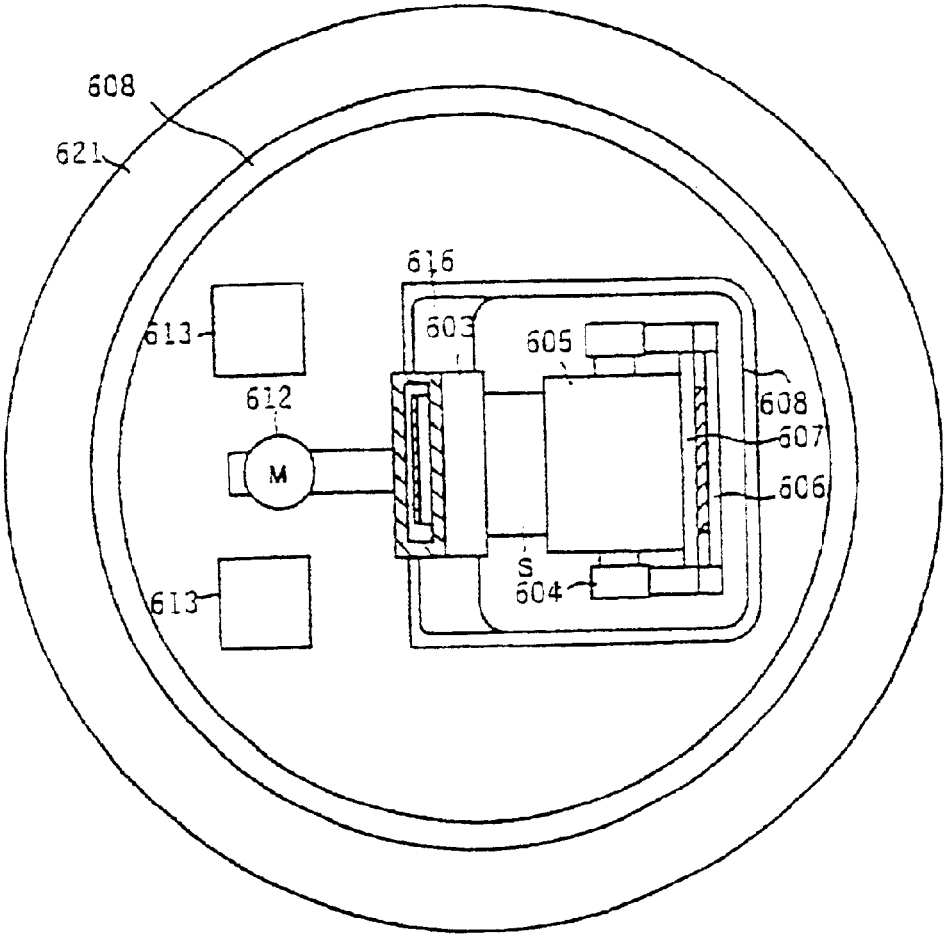
FIG. 40 shows the plan view of the manufacturing apparatus of hot-dip galvanized steel plates according to the second embodiment of the Best Mode 7.

The second embodiment is described referring to FIGS. 38 through 40. FIG. 38 shows a cross sectional view of the manufacturing apparatus of molten zinc-base plated steel plates according to the second embodiment of the Best Mode 7. FIG. 39 shows the cross sectional view along B–B' line of FIG. 38. FIG. 40 shows the plan view of the manufacturing apparatus of hot-dip galvanizes steel plates according to the second embodiment of the Best Mode 7.

As seen in these drawings the apparatus for manufacturing hot-dip galvanized steel strip according to the embodiment has the similar basic configuration as that of the apparatus of the first embodiment. Thus, the reference symbols same as those in the first embodiment are applied for simplification of description.

The apparatus for hot-dip galvanizing according to the embodiment has the cylindrical plating pot 620 containing molten zinc. At around the plating pot 620, a high frequency coil 621 is provided as the heating means to heat the molten zinc 602 by the coreless induction heating. The sink roll 605 and the support rolls 606, 607 are arranged in similar manner with the first embodiment. The steel strip S which was immersed in the molten zinc 602 of the plating pot 620 is wound around the sink roll 605, as in the case of the first embodiment, and changes its traveling direction upward, thus being continuously taken up from the plating pot 601.

The plating pot 626 is provided with the vessel 608 having similar structure with that of the first embodiment, thus containing the sink roll 605, the support jigs 604, and the support rolls 606, 607. The U-shape cover 616 is located in a range of from the point that the steel strip S which passed through the snout 603 is immersed in the molten zinc 602 to the point that the steel strip S reaches the vessel 608, to substantially cover the lower face of the steel strip S.

Also the embodiment uses the discharge pipe 610*a* which extends straight from the discharge opening 610 located at bottom of the vessel 608 at corresponding center portion of the width of the steel strip S, which then curves upward. The mechanical pump 617 is positioned at front edge of the discharge pipe 610*a*. The mechanical pump 617 is driven by the motor 612 positioned above the pump 617 to forcefully discharge the molten zinc in the vessel 608 to the plating pot 620 via the discharge opening 610 and the discharge pipe 610*a*. The embodiment also preferably has distances of from 200 to 500 mm between the bottom plate 608*a*, side plates 608*b* of the vessel 608 and the traveling steel strip S the sink roll 605, the support jigs 604, and the support rolls 606, 607. The distance is set to, for example, 300 mm. At near the surface of the molten zinc 602 at edge of the plating pot 620, the zinc ingot 613 for make up of molten zinc is immersed.

With thus configured apparatus for hot-dip galvanized steel strip, the steel strip S as the work is, similar with the first embodiment, continuously immersed in the molten zinc 602 held in the plating pot 620 via the snout 603. The steel strip S is changed the traveling direction by the sink roll 605 upward, and is taken up from the pot 620. A gas-wiper (not shown) removes excess amount of molten zinc to provide a hot-dip galvanized steel strip which is coated with specified amount of molten zinc on both sides thereof.

Similar with the first embodiment, the second embodiment attains the similar effect by the presence of the vessel 608. And, owing to the coreless induction heating by the high frequency coil 621, the local high speed flow caused by convection of molten zinc, which is observed in conventional induction heating, is reduced as an additional effect. As a result, the quality defects are further diminished. The cover 616 increases the effect for shielding the flow accompanied with the sink roll 605 and with the traveling steel strip S. The molten zinc 602 at bottom portion of the plating pot 620 is calmed to further enhance the dross sedimentation and removal effect.

As in the case of the first embodiment, by limiting the distance between the walls of the vessel 608 and the traveling steel strip, the sink roll 605, the supporting jigs 604 thereof, and the support rolls 606, 607 to a range of from 200 to 500 mm, the agitation in the vessel 608 is fully performed. Furthermore, the joints between the bottom plate and the side plates are in curved shape, which assures favorable flow of molten zinc in the vessel 608, and assures very high agitation effect in the vessel 608.

The mechanical pump 617 forcefully discharges the molten zinc 602 from the discharge opening 610 positioned at center portion in the width direction of the steel strip S in the vessel 608 to the plating pot 601 via the discharge pipe 610*a*. Thus, the sedimentation of dross in the vessel 608 is further effectively prevented.

The inventors of the present invention studied the generation of quality defects caused from the adhesion of dross to the steel strip using the apparatus of the embodiment for manufacturing hot dip zinc-plated steel strip. The study confirmed the occurrence of quality defects not more than 1% during the three weeks of continuous operation even under varied line speed. Furthermore the study confirmed that no coarse dross which may cause problems in working such as pressing appeared.

As described above, according to the present invention, the installation of the vessel to hold the sink roll in the molten zinc tank allows to sediment and remove the dross, to clean the plating bath, and to form a flow having no coarse dross therein in the plating portion, thus providing the apparatus for manufacturing high quality hot-dip galvanized steel plate with extremely few quality defects.

Best Mode 8

The specific concept of the Best Mode 8 is described below.

1) The dross is basically removed by the sedimentation method. To do this, the sedimentation tank is designed to a large size.
2) The plating tank exchanges the holding liquid before the dross grows to a harmful size. To do this, the plating tank is preferably as small as possible.
3) The charge of raw material zinc to the plating tank is done by liquid zinc, not by solid zinc to prevent enhanced growth of the dross caused by variations of bath temperature in the plating tank.
4) The charge of raw material zinc is done by dissolving solid zinc (ingot) in the sedimentation tank to enhance the dross growth utilizing the variations of bath temperature near the dissolving zone of the solid zinc. The sedimentation tank essentially has a heating device.
5) The supply of molten zinc from the sedimentation tank to the plating tank is done by a very mild flow to suppress the generation of top dross. If a flow to trap even a very small quantity of air occurs on the bath surface, the top dross is vigorously generated. The required condition is satisfied by connecting the sedimentation tank with the plating tank at opening of there each and by assuring the equal liquid level to each other.
6) The discharge of the molten zinc after removed the dross from the sedimentation tank is most preferably done by the discharge of flow including the liquid surface in the sedimentation tank. The required condition is satisfied by locating the opening at upper portion of the sedimentation tank as far as possible.
7) Even when the line speed is high or low the dross in the plating tank shall be surely transferred to the dross removing tank. Even when the line speed is high, the dross removing capacity shall be sufficient.
8) The above-described requirements are performed by dividing a single vessel into the plating tank at upper portion thereof and the dross removing tank at lower portion thereof. The plating tank is designed in separable structure. These means are for simplified facility installation, for stable operation, for investment cost reduction, and for narrowing the facility space.

The Best Mode 8 is derived from the above-described concept, and the essentials of the Best Mode 8 are the following.

The first embodiment is a method for hot-dip galvanizing, on conducting hot-dip galvanizing continuously to a steel strip, which was traveled through a snout, and which is guided by a roll under the bath, in a plating vessel which contains a molten metal by immersing the steel strip therein, which method is characterized in that the plating vessel is divided into to the dross removing tank and the plating tank which is located in the dross removing tank, that the hot-dip galvanizing is conducted by immersing the steel strip in the plating tank, that the molten metal bath is transferred from the plating tank to the dross removing tank using a mechanical pump and using a flow accompanied with the traveling steel strip passing through the first connection, between the plating tank and the dross removing tank, opened on a side wall of the plating tank facing the surface of the steel strip being taken up from the plating tank, that the dross is removed from the transferred molten metal bath in the dross removing tank, and the solid phase metal for plating is dissolved in the dross removing tank, and that the molten metal bath is recycled from the dross removing tank through a second connection, between the plating tank and the dross removing tank, opened on a side wall of the plating tank in lateral direction to the surface of the steel strip being taken up from the plating tank.

The second embodiment is the method for hot-dip galvanizing described in the first embodiment, which method is characterized in that the molten metal bath in the plating tank is sucked from the plating tank at opposite side to the first connection, placing the roll under the bath in between, using the mechanical pump. The sucked molten metal is discharged to the dross removing tank at opposite side to the first connection, placing the plating tank in between.

The third embodiment is the hot-dip galvanizing described in the first embodiment or the second embodiment, which method is characterized in that the distance between the steel strip and the walls of plating tank and between the walls of the plating tank and the roll under the bath are regulated to a range of from 200 to 400 mm in a range of from the point of entering the steel strip into the plating tank and the point of leaving the steel strip from the roll under the bath, and that the plating tank and the dross removing tank satisfy the relation of $W1 \leqq 10\ m^3$ and $W1 \leqq W2$, (W1 is the capacity of the plating tank, and W2 is the capacity of the dross removing tank), and that the flow rate of the molten metal bath transferred from the plating tank to the dross removing tank is regulated to a range of from 1 to 10 $m^3/h$.

The fourth embodiment is an apparatus for hot-dip galvanizing, on conducting hot-dip galvanizing continuously to a steel strip, which was traveled through d snout, and which is guided by a roll under the bath, in a plating vessel which contains a molten metal by immersing the steel strip therein, which apparatus is characterized in that the plating vessel is divided into the dross removing tank and the plating tank, which dross removing tank removes the dross from the molten metal and dissolves a solid phase metal for plating, and which plating tank is placed in the dross removing tank and conducts the hot-dip galvanizing to the steel strip, that a mechanical pump is located to transfer the molten metal bath from the plating tank to the dross removing tank, that the first connection which connects the plating tank with the dross removing tank to transfer the molten zinc bath using the flow accompanied with the traveling steel strip is located on a side wall of the plating tank facing the surface of the steel strip being taken up from the plating tank, and that the second connection which connects the plating tank with the dross removing tank for recycling the molten metal bath from the dross removing tank to the plating tank is located on a side wall of the plating tank in lateral direction to the steel strip being taken up from the plating tank.

The fifth embodiment is the apparatus for hot-dip galvanizing described in the fourth embodiment, which apparatus is characterized in that the suction opening of the mechanical pump is positioned in the plating tank opposite to the first connection placing the roll under the bath in between, and that the discharge opening of the sucked molten metal to the dross removing tank is positioned in the dross removing tank opposite to the first connection placing the plating tank in between.

The sixth embodiment is the apparatus for hot-dip galvanizing described in the fourth embodiment or the fifth embodiment, which apparatus is characterized in that the plating tank and the dross removing tank satisfy the relation of $W1 \leqq 10\ m^3$ and $W1 \leqq W2$, (W1 is the capacity of the plating tank, and W2 is the capacity of the dross removing tank), and that the distance between the steel strip and the walls of plating tank and between the walls of the plating tank and the roll under the bath are regulated to a range of from 200 to 400 mm in a range of from the point of entering the steel strip into the plating tank and the point of leaving the steel strip from the roll under the bath.

According to the Best Mode 8, the make up of zinc which was carried out by adhesion to the steel strip, or the dissolving solid phase zinc (ingot), is done in the dross removing tank. Consequently, the variations of temperature of the molten metal bath (melt) in the plating tank become less, which prevents the generation of the dross in the plating tank.

The melt containing dross in the plating tank is transferred by the mechanical pump and through the first connection between the plating tank and the dross removing tank, opened on a side wall of the plating tank facing the surface of the steel strip taken up from the plating tank. As a result, there occurs no problem of quality and operation, such as generation of fume and top dross, which are observed in the case of using a gas lift pump. In addition, the use of mechanical pump improves unstable transfer of the melt appearing in utilizing the flow accompanied with the traveling steel strip, and assures the transfer of melt from a portion of high concentration of dross to the dross removing tank at a necessary flow rate.

That is, in the case that the traveling speed of the steel strip is slow, the generated dross is difficult to be removed solely by the flow accompanied with the traveling steel strip. To this point, the mechanical pump forcefully transfers the bath containing dross from the plating tank to the dross removing tank through the first connection, thus increases the transfer rate of the melt proportional to the generation of the dross, without depending on the traveling speed of the steel strip, and without depending on the control of rotational speed of the mechanical pump.

Since the dross removing tank induces no agitation of the melt caused from the traveling steel strip, the flow becomes calm to enhance the sedimentation of the dross. Furthermore, dissolving the ingot in the dross removing tank enhances the sedimentation and removal of dross owing to the reduction of local melt temperature and to the changes in aluminum concentration. With these two actions, the dross is efficiently and promptly removed in the dross removing tank.

The dross is removed in the dross removing tank. The cleaned melt is preferentially recycled to the plating tank through the second connection opened on a side wall of the plating tank lateral to the surface of the steel strip being taken up from the plating tank, between the plating tank and the dross removing tank. Since the liquid level of the dross removing tank and that of the plating tank are equal, no top dross is generated in the plating tank on recycling the melt.

When the second connection is located at upper portion as far as possible to recycle the supernatant after removed the dross in the dross removing tank, the supernatant bath in the vicinity of the bath surface which has higher cleanliness can be recycled to the plating tank. In this case, if the melt is introduced to a portion between the steel strip and the sink roll from the lateral direction to the steel strip surface, the efficiency of the melt circulation in the plating tank is improved. To establish the above-described flow, the first connection is preferably located on a side wall of the plating tank facing the surface of the steel strip being taken up from the plating tank, and the second connection is preferably located on a side wall of the plating tank in lateral direction to the surface of the steel strip being taken up from the plating tank.

When the suction opening of the mechanical pump for the melt in the plating tank is positioned in the plating tank opposite to the first connection placing the roll under the bath in between, and the discharge opening of the sucked melt to the dross removing tank is positioned in the dross removing tank opposite to the first connection placing the plating tank in between, and when the mechanical pump is operated to discharge the melt from the plating tank to the dross removing tank, the circulation efficiency of the melt further improves.

The apparatus is a simple one only dividing the plating vessel into the plating tank and the dross removing tank. Accordingly, the apparatus is fabricated at a low investment cost, and solves several problems such as the investment cost problem accompanied with melt transfer to a distant tank, and the problems of solidification and leak of melt.

Ranging from the point of entering the steel strip into the plating tank to the point of leaving the steel strip from the roll under the bath, the distance between the steel strip and the walls of the plating tank and the distance between the steel strip and the roll under the bath are kept to a specified range (200 to 400 mm). Thus the steel strip is prevented from contacting the tank walls. In addition, the melt is transferred by the mechanical pump and by the flow accompanied with the traveling steel strip, thus the dross deposition in the plating tank can be prevented, and the defects caused from dross is prevented.

In a range of from the point of entering the steel strip into the plating tank to the point of leaving the steel strip from the roll under the bath, if the distance between the steel strip S and the walls of the plating tank 711, (L1 and L2 in FIG. 42) becomes less than 200 mm, and if the distance between the walls of the plating tank and the roll under the bath, (L3 in FIG. 42, L4 in FIG. 41) becomes less than 200 mm, the steel strip S may contact the walls of the plating tank 711 during travel of the steel strip S or on operational trouble, which may result in the generation of flaws, generation of fracture of strip at welded portion, or generation of irregular temperature distribution in the plating tank 711. If the distance exceeds 400 mm, a part of the plating tank 711 likely induces dross deposition. Therefore, the above-defined distance is preferably in a range of from 200 and 400 mm.

It is further preferable that the apparatus adopts the plating tank and the dross removing tank which satisfy the conditions of $W1 \leqq 10\ m^3$ and $W1 \leqq W2$, (W1 is the capacity of the plating tank, and W2 is the capacity of the dross removing tank), and that the operation is conducted under the condition of 1 to 10 $m^3/h$ of the flow rate of the molten metal bath transferred from the plating tank to the dross removing tank. In that state, the dross deposition at stagnant melt portion in the plating tank is prevented, and the once-generated dross is efficiently removed in the dross removing tank.

Figure 41:
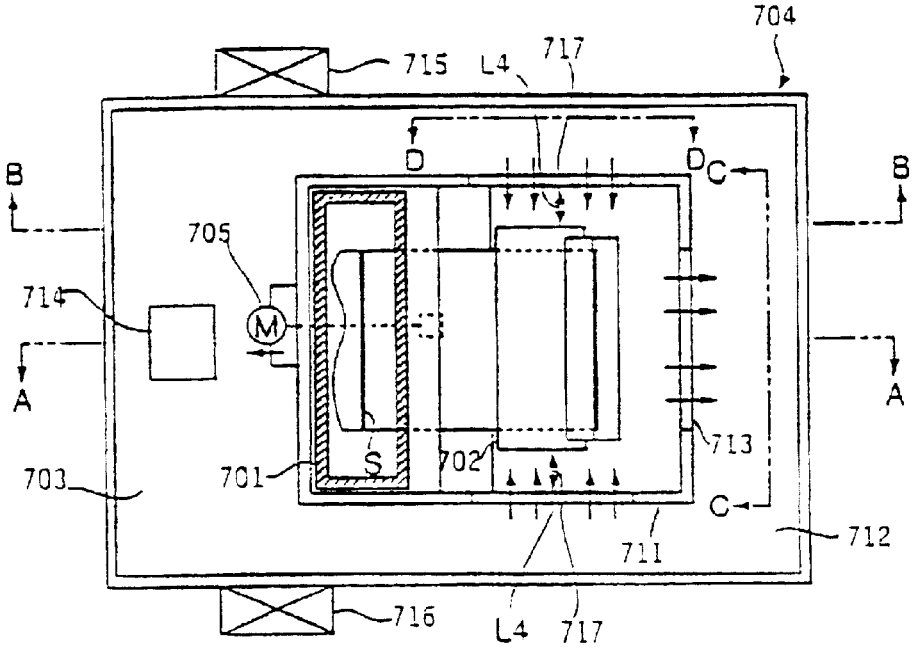
FIG. 41 shows arrangement of main components of the apparatus for hot-dip galvanizing of the Best Mode 8.
Figure 42:
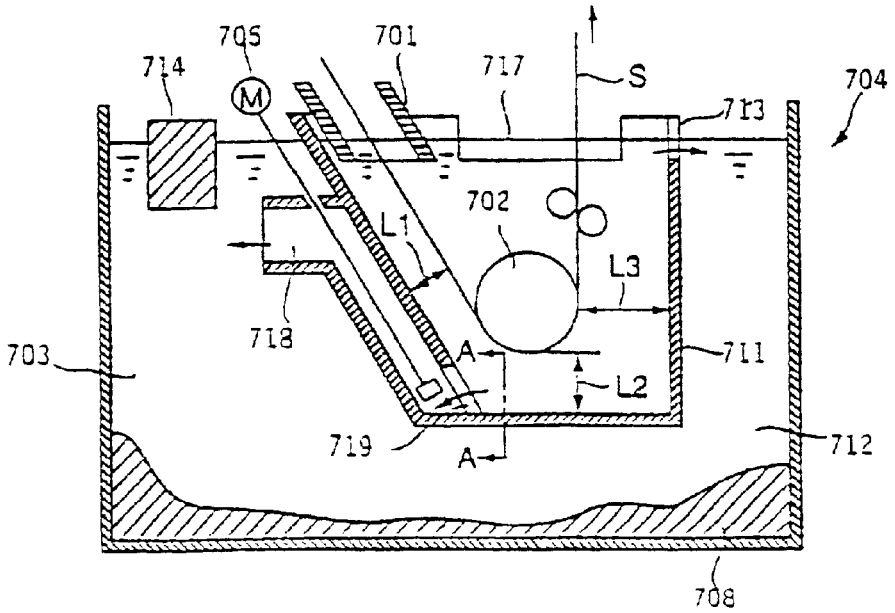
FIG. 42 is the cross sectional view taken along A—A line of FIG. 41.
Figure 43:
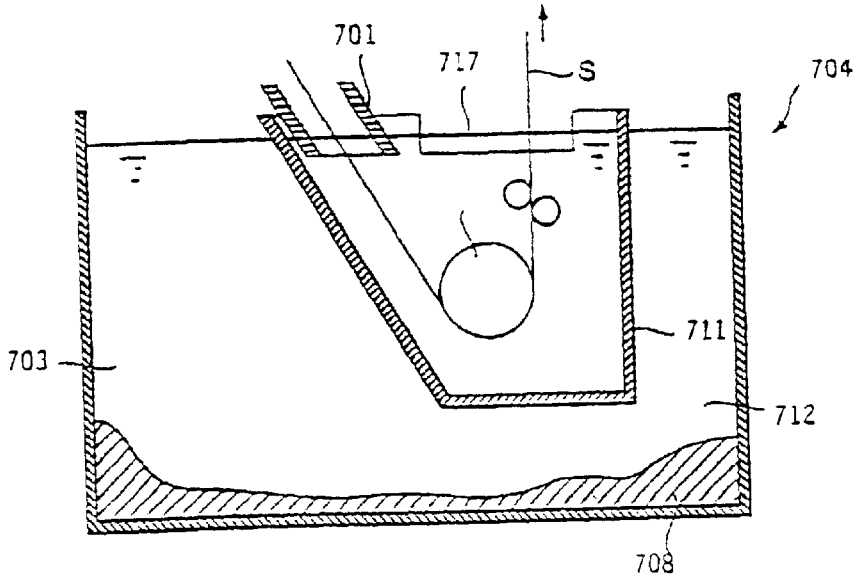
FIG. 43 is the cross sectional view taken along B—B line of FIG. 41.

The Best Mode 8 is described in detail referring to FIGS. 41 through 43. FIG. 41 shows the hot-dip galvanizing apparatus according to the Best Mode 8, illustrating the arrangement of main components looking down from the upper edge of the plating vessel. FIG. 42 is the cross sectional view along A—A line of FIG. 41. FIG. 43 is the cross sectional view along B—B line of FIG. 41. In these figures the reference number 701 is the snout, 702 is the sink roll (roll under the bath). 703 is the molten metal bath (melt), and 704 is the plating vessel. The plating vessel 704 is provided with the roll under the bath 702, and the plating vessel 704 is divided into the plating tank 711 in which the steel strip S is plated, and the dross removing tank 712 which is located beneath the plating tank 711 and which sediments and removes the dross and dissolves the ingot 714.

The reference number 713 is the first opening (the first connection) located on the plating tank 711. The first opening is positioned on a side wall of the plating tank 711 facing the surface of the steel strip being taken up from the plating tank 711. The first connection connects the plating tank 711 with the dross removing tank 712. The reference number 717 is the second opening (the second connection) located on the plating tank 711. The second opening is positioned on a side wall of the plating tank 711 in lateral direction to the surface of the steel strip being taken up from the plating tank 711. The second connection connects the plating tank 711 with the dross removing tank 712. The reference number 705 is the mechanical pump that sucks the melt 703 of the plating tank 711 from the third opening 719 located at bottom of the plating tank 711 opposite to the first opening 713 placing the roll under the bath 702 in between, and discharges the sucked melt 703 to the dross removing tank 712 from the discharge opening 718 located at opposite side to the first opening 713 placing the plating tank 711 in between.

Figure 44A:
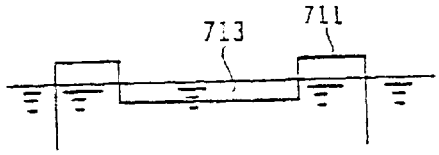
FIG. 44 illustrates the opening shapes of the apparatus of FIG. 41.
Figure 44B:
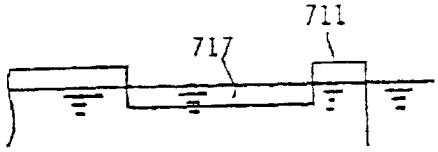
Figure 44C:
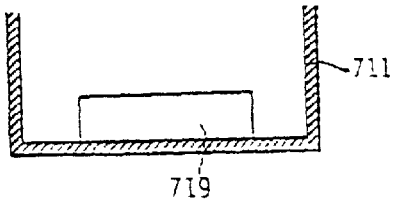

FIG. 44 shows several shapes of the openings. FIG. 44(*a*) is the cross sectional view along C—C line of FIG. 41 illustrating the first opening 713. FIG. 44(*b*) is the cross sectional view along D—D line of FIG. 41 illustrating the second opening 717. FIG. 44(*c*) is the cross sectional view along A—A line of FIG. 42 illustrating the third opening 719. Both the first opening 713 and the second opening 717 are located to form respective flow passages in the vicinity of the bath surface including the bath surface.

The steel strip S travels in the arrow direction, and is immersed in the plating tank 711 via the snout 701. After changed the traveling direction by the sink roll 702, the steel strip S is taken up from the melt 703. After being adjusted the coating weight in a coating weight controller (not shown), the steel strip S is cooled and subjected to a specified post-treatment to become a plated steel strip.

The melt 703 containing dross in the plating tank 711 is transferred from the opening 719 to the dross removing tank 712 via the discharge opening 718 using the mechanical pump 705. The melt 703 also flows from the first opening 713 to the dross removing tank 712 by the flow accompanied with the traveling steel strip S. The dross is sedimented and removed in the dross removing tank 712, while the melt 703 is recycled to the plating tank 711 via the second opening 717. The circulation flow rate of the melt 703 between the plating tank 711 and the dross removing tank 712 is the sum of the flow rate of discharge coming from the first opening 713 induced by the flow accompanied with the traveling steel strip S and the flow rate of discharge coming from the mechanical pump 705.

The dross removing tank 712 is provided with a pair of heating devices (induction heating devices) 715, 716. According to the apparatus, the plating tank 711 does not have a heating device. The temperature control of the melt in the plating tank 711 is done by the heating devices 715, 716 located in the dross removing tank 712 and by the adjustment of temperature of the traveling steel strip because the melt temperature of the plating tank 711 is determined by the heat of melt 703 recycled from the dross removing tank 712 and by the temperature of steel strip S entering the plating tank 711.

When the ingot 714 is charged into the dross removing tank 712, the temperature of melt flowing into the plating tank 711 through the opening 717 is controlled to a specified level by adequately functioning the heating devices 715, 716.

For prompt temperature adjustment in the plating tank 711, the plating tank 711 is preferably fabricated by a material of high heat conductivity and high corrosion resistance, such as SUS416L, not by ceramics materials. Use of metallic material for the plating tank 711 is advantageous also in mounting/dismounting the plating tank 711 to/from the plating vessel 704.

Since the ingot 714 is not dissolved in the plating tank 711, the temperature variations of the melt 703 in the plating tank 711 become minimum. Since the temperature control of the melt 703 in the plating tank 711 is done by the heating devices 715, 716 of the dross removing tank 711 the hot melt 703 ejected from the heating devices 715, 716 does not contact the steel strip S. As a result, the elution of iron from the steel strip S is suppressed, and the generation of dross in the plating tank 711 is reduced.

The melt 703 containing dross in the plating tank 711 is sucked by the ceramics mechanical pump 705 located in the plating vessel 704 from the third opening 719, and is transferred to the dross removing tank 712 via the discharge opening 718. Also the melt 703 in the plating tank 711 is transferred to the dross removing tank 712 via the first opening which forms a flow passage in the vicinity of the bath surface including the bath surface, as shown in FIG. 44(*a*). Since the plating tank 711 and the dross removing tank 712 are adjacent to each other the transfer distance of the melt 703 is short, thus the problems of solidification and leak of the melt 703 during transfer is substantially solved.

If the traveling speed of the steel strip is slow, the mechanical pump 705 may forcefully suck the melt 703 in the plating tank 711 via the third opening 719 to transfer the melt 703 to the dross removing tank 712. In the case of slow travel speed of the steel strip, the flow accompanied with the traveling steel strip S may transfer the melt 703 to the dross removing tank 712 via the first opening 713 on the plating tank 711 at necessary flow rate without fail.

The mechanical pump means a pump such as a volute pump (centrifugal pump), a turbine pump, and a displacement pump, which transfers melt directly contacting the melt to working parts of the pump. The mechanical pump described here does not include a gas lift pump.

The dross removing tank 712 performs the dissolution of the ingot 714 and the sedimentation and removal of the bottom dross 708. In the dross removing tank 712, the flow of melt 703 is uniformized. Adding to the action, the local melt temperature reduction and the aluminum concentration changes accompanied with the ingot dissolving are increased, and the sedimentation and removal of dross are enhanced, thus increasing the efficiency of sedimentation and removal of the dross.

For efficient sedimentation and removal of the bottom dross 708, the dross removing tank 712 may be provided with a separation plate to uniformize the flow of melt 703, at need.

As seen in FIG. 44(*b*), a side wall of the plating tank 711 is provided with the second opening 717 to form a flow passage in the vicinity of the bath surface including the bath surface. The dissolved ingot melt is mixed to the flow, and the supernatant bath in the vicinity of the bath surface having high cleanliness after sedimented and removed the dross preferentially flows through the second opening 717 and returns to the plating tank 711. Since the melt 703 flows with very little flow resistance, there appears very little difference in the level of melt 703 between the plating tank 711 and the dross removing tank 712. As a result, when the melt 703 returns to the plating tank 711, no top dross is generated.

Since the clean melt 703 after removed the dross returns to the plating tank 711, and since the quantity of dross generated in the plating tank 711 is small, the effect of preventing the dross deposition in the plating tank 711 becomes excellent.

In a range of from the point of entering the steel strip into the plating tank to the point of leaving the steel strip from the roll under the bath, if the distance between the steel strip S and the walls of the plating tank 711, (L1 and L2 in FIG. 42) becomes less than 200 mm, and if the distance between the walls of the plating tank and the roll under the bath, (L3 in FIG. 42, L4 in FIG. 41) becomes less than 200 mm, the steel strip S may contact the walls of the plating tank 711 during travel of the steel strip S or on operational trouble, which may result in the generation of flaws, generation of fracture of strip at welded portion, or generation of irregular temperature distribution in the plating tank 711. If the distance exceeds 400 mm, a part of the plating tank 711 likely induces dross deposition. Therefore, the above-defined distance is preferably in a range of from 200 and 400 mm.

According to the apparatus of FIGS. 41 through 43, the side walls of the plating tank 711 having the first opening 713 and the second opening 717 are vertically positioned. These side walls may be, however not necessarily in vertical position. In that case, it is preferable that the distance between the steel strip S and the walls of the plating tank 711 and the distance between the walls of the plating tank 711 and the roll under the bath 702 are kept to a range of from 200 to 400 mm during the period between the point of entering the steel strip S into the plating tank 711 and the point of leaving the steel strip S from the roll under the bath 702. However, after the steel strip S left from the roll under the bath 702, the distance may exceed the above-specified range. The distance between the side walls of the plating tank 711 and the side walls of the plating vessel 704 is preferably not less than 100 mm.

Figure 46:
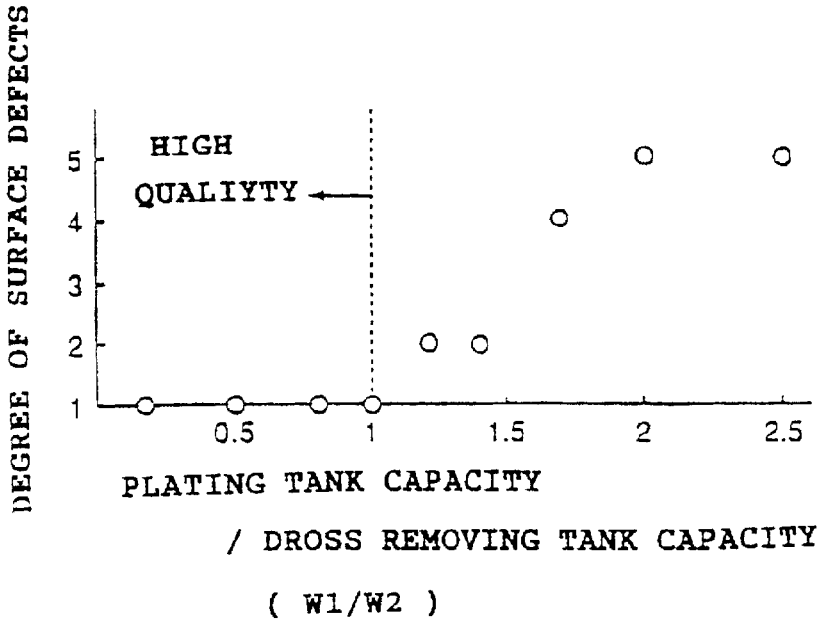
FIG. 46 shows the relation between the (capacity of plating tank)/(capacity of dross removing tank) and the degree of surface defects in the apparatus for hot-dip galvanizing of FIG. 41.
Figure 47:
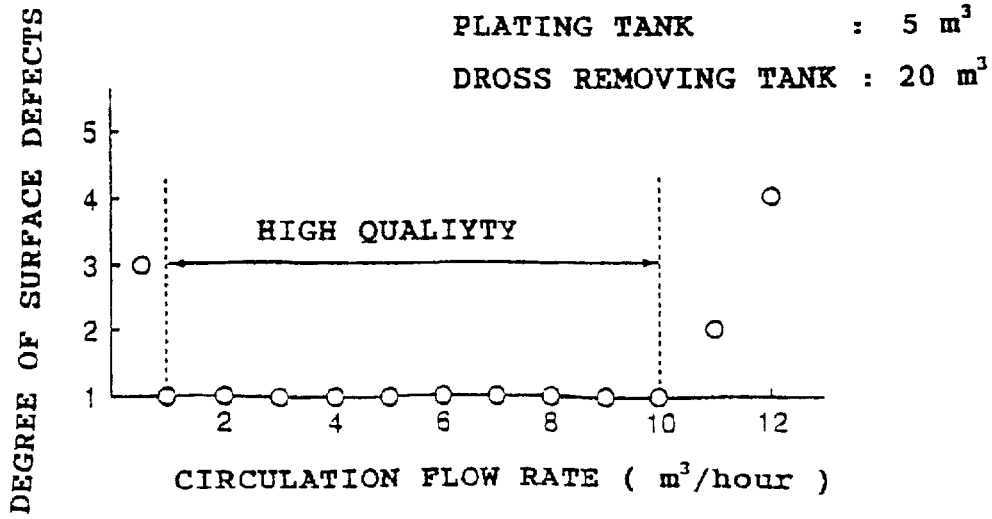
FIG. 47 shows the relation between the circulation flow rate and the degree of surface defects in the apparatus for hot-dip galvanizing of FIG. 41.

With the apparatus of FIG. 41, the inventors of the present invention studied the generation of quality defects caused from the adhesion of dross to the steel strip traveling through the plating tank 711 under the conditions of: the distance between the walls of the plating tank 711 and the steel strip S and the distance between the walls of the plating tank 711 and the roll under the bath 702, (L1 through L4), being 200 to 400 mm; the traveling speed of the steel strip S being 120 m/min; while varying the capacity of the tank and the circulation flow rate. The result is shown in FIGS. 45 through 47.

Figure 45:
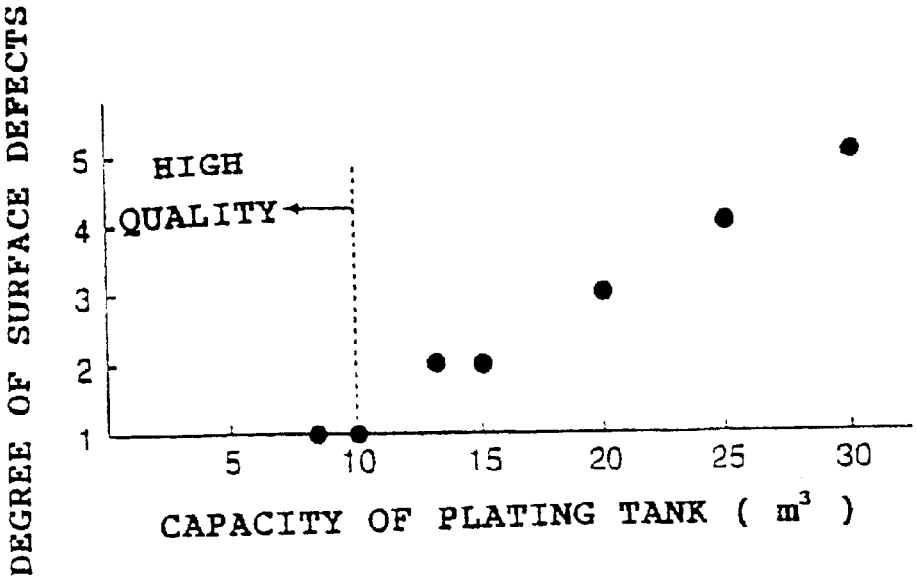
FIG. 45 shows the relation between the capacity of plating tank and the degree of surface defects in the apparatus for hot-dip galvanizing of FIG. 41.

FIG. 45 shows the generation of quality defects caused from the adhesion of dross to the steel strip S under the conditions of 20 $m^3$ in the capacity of dross removing tank 712, of 5$m^3$/h in the circulation flow rate, while varying the capacity of the plating tank 711. The surface state of the steel strip S after the plating was visually observed to identify the generation of quality defects caused from the dross adhesion, five grade evaluation (indexes 1 through 5) were given responding to the degree of dross adherence. Index 1 is the best, which is the quality level currently requested for the high quality hot-dip galvanized steel strip.

When the capacity of the plating tank 711 is not more than 10 $m^3$, the index is 1, which is, a favorable level. When, however, the capacity exceeds 10 $m^3$, the index number increases and the quality degrades because the increased capacity of the plating tank 711 induces generation of stagnant flow portion, where the bottom dross 708 deposits. To prevent the deposition of bottom dross 708 in the plating tank 711, it is effective to decrease the capacity of the plating tank 711. When the capacity of the plating tank 711 is brought to not more than 10 $m^3$, the currently requested high quality hot-dip galvanized steel strip can be produced.

The inventors studied the generation of quality defects caused from the adhesion of dross to the steel strip S by plating thereon under the conditions of 5 $m^3$/h of circulation flow rate while changing the capacity of the dross removing tank 712. Since the size of the dross removing tank 712 is influenced by the capacity (W1) of the plating tank 711, a parameter (W1/W2), or the capacity (W1) of the plating tank 711 divided by the capacity (W2) of the dross removing tank 712, was used to rearrange the state of generation of quality defects caused from the adhesion of dross to the steel strip S. The result is shown in FIG. 46.

In a zone that W1/W2 is not more than 1.0, the index is 1 giving favorable quality. If, however, W1/W2 exceeds 1.0, the index number increases to degrade the quality. By regulating the value of W1/W2 to not more than 1.0, the currently requested high quality hot-dip galvanized steel strip is produced.

The inventors studied the generation of quality defects caused from the adhesion of dross to the steel strip S by plating thereon under the conditions of 5 $m^3$ and 20 $m^3$ of the capacity of the plating tank 711 and the dross removing tank 712, respectively, while changing the circulation flow rate. The result is shown in FIG. 47.

When the circulation flow rate is high, the defects occurred presumably caused from the insufficient sedimentation and removal of dross in the dross removing tank 712 to allow the inflow of dross in the plating tank 711. In the dross removing tank 712, it is important to secure a retention time not less than the dross sedimentation time considering the concerned dross sedimentation time. The above-described defects diminish with the reduction of circulation flow rate. When the circulation flow rate becomes 10 $m^3$/h or less the products having no quality problem can be produced. However, when the circulation flow rate further reduced to below 1 $m^3$/h, the dross is not discharged from the plating tank 711 to the dross removing tank 712, and remains in the plating tank 711. Thus, the index number increases to degrade the quality. To produce a high quality hot-dip galvanized steel strip, the circulation flow rate is required to set between 1 and 10 $m^3$/h.

Increased travel speed of the steel strip increases the flow rate at the first opening 713. Accordingly, the circulation flow rate of the mechanical pump 705 is preferably set to a low level. At speeds of steel strip of 120 m/min or more, 6 $m^3$/h of the flow rate at the mechanical pump 705 is sufficient. If the flow rate at the mechanical pump 705 is excessively high, the dross sedimentation and removal become insufficient, as described before, the dross again enters the plating tank 712 through the second opening 717, which degrades the quality.

According to the apparatus of FIGS. 41 through 43, the melt 703 is transferred from the plating tank 711 to the dross removing tank 712 via the second opening 717 facing the steel strip S. thus establishing a melt transfer with a good circulation efficiency. Therefore, the first opening 713 and the second opening 717 may be in a continuous configuration, or the first connection and the second connection may be in continuous configuration.

In the case that, as in the apparatus shown in FIGS. 41 through 43, the suction opening (third opening) 713 of the mechanical pump 705 is positioned in the plating tank opposite to the first opening 713 placing the roll under the bath 702 in between, and that the discharge opening of the sucked melt 703 to the dross removing tank 712 is positioned to the dross removing tank 712 opposite to the first opening 713 placing the plating tank 711 in between, the circulation efficiency of the melt 703 becomes more favorable state. Thus, a connection portion between the plating tank 711 and the dross removing tank 712 may be located so as the upper edge of the plating tank 711 to come below the surface level of the melt 703, other than the above-described openings 713, 717, or the connection portion therebetween being positioned over the whole length of the periphery of upper edge of the side walls of the plating tank 711.

Figure 48B:
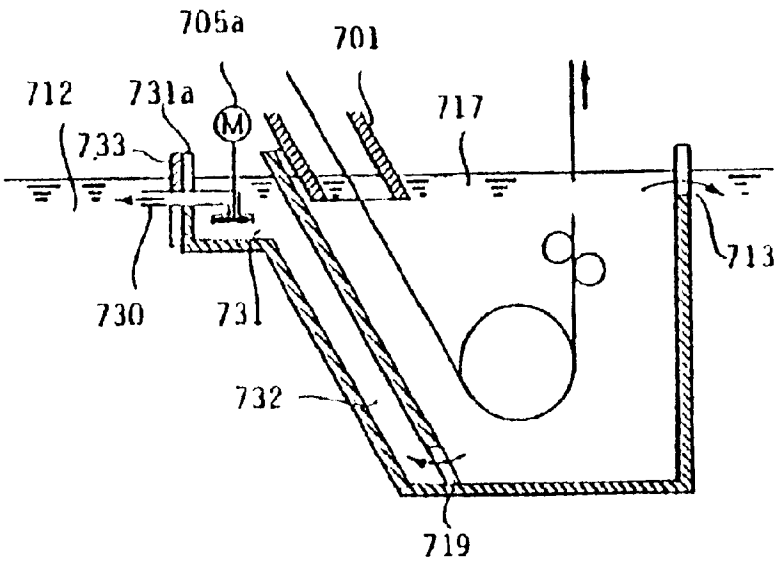
FIG. 48 shows an example of plating apparatus providing a mechanical pump at near the liquid level according to the Best Mode 8.
Figure 48A:
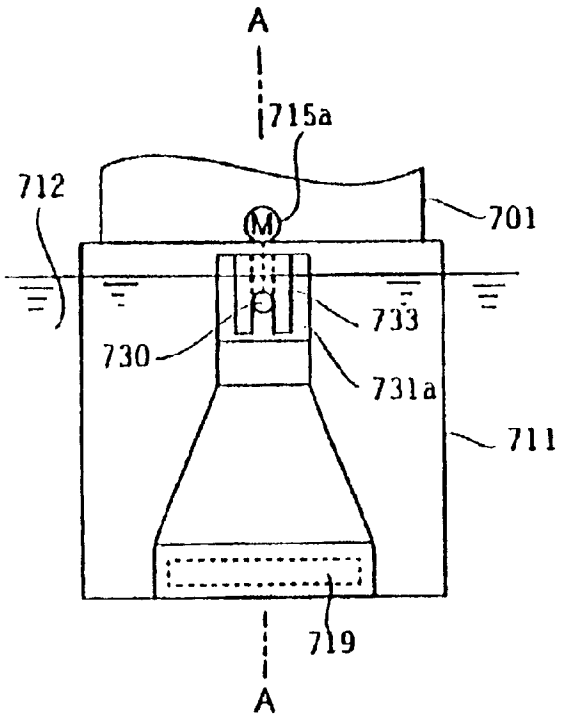

The apparatus of FIGS. 41 through 43 located the mechanical pump 705 to near the bottom of the plating tank 711. The mechanical pump 705 may be positioned at near the bath surface. FIG. 48 shows an example of the plating apparatus placing the mechanical pump at near the bath surface, illustrating the plating tank 711 and only the main facilities therearound. FIG. 48(*a*) shows the front view of the plating tank 711 viewed from the mechanical pump side. FIG. 48(*b*) shows the cross sectional view along A—A line of FIG. 48(*a*).

In FIG. 48, the reference number 719 is the third opening located on the plating tank 711, 705*a* is the mechanical pump, and 731 is the pump chamber holding the mechanical pump 705*a*. The melt discharged from the mechanical pump 705*a* can be sent to the dross removing tank 712 through the discharge pipe connected to the side wall 713*a* of the pump chamber 731 without exposing the flow passage to the bath surface. The seal member 733 is detachably mounted to the side wall 731*a* of the pump chamber 731. The side wall 731*a* is provided with a U-shape groove, and the seal member 733 is provided with an inverse-U-shape groove. The bottom of the groove of the side wall 731*a* and the top of the seal member 733 have respectively half-circular shape, which radius is almost equal to the outer diameter (radius) of the discharge pipe 730.

For installing the mechanical pump 705*a* to the pump chamber 731, the mechanical pump 705*a* is placed so as the discharge pipe 703 of the mechanical pump 705*a* to contact the bottom of the groove of the side wall 703*a*, and the seal member 733 is attached to the side wall 731*a* so as the top of the groove of the seal member 733 to contact the discharge pipe 730, thus sealing the outer periphery of the discharge pipe 730.

The melt 703 of the plating tank 711 sucked from the opening 719 is sent to the pump chamber 731 via the conduit 732, then is discharged to the dross removing tank 712 by the mechanical pump 705*a* via the discharge pipe 730. To take out the mechanical pump 705*a* from the pump chamber 731, the seal member 733 is detached from the side wall 731*a*, then the mechanical pump 705*a* is brought out from the pump chamber 731. According to the apparatus, the mechanical pump 705*a* is readily replaced.

Example

The Example used the apparatus shown in FIG. 41. The plating vessel 704 had 2.5 meters in depth. The plating tank 711 had 10 $m^3$ in capacity, and the dross removing tank 712 had 30 $m^3$ in capacity. The distance between the walls of the plating tank 711 and the steel strip S, and the distance between the walls of the plating tank 711 and the roll under the bath 702 were set to L1=30 mm, L2=250 mm, L3=300 mm, and L4=200 mm. The plating tank 711 was fabricated by welding steel plates (SUS 316L) having thicknesses of from 6 to 15 mm. The dross sedimentation speed which raises problem in ordinary hot-dip galvanizing is around 1 meter per hour. Since the depth of the plating vessel 704 was 2.5 meters, the dross removing tank 712 required 2.5 hours or longer retention time. If the circulation flow rate is not more than 12 $m^3$/h, the retention time exceeds 2.5 hours, which expects the dross removal effect. On the other hand, if the circulation flow rate becomes below 1 $m^3$/h, the dross remains in the plating tank 711 to cause the generation of quality defects. Considering the above-described conditions the circulation flow rate was selected to 3 $m^3$/h.

The above-described apparatus was applied to hot-dip galvanizing to a steel strip. The generation of dross defects on the plated steel strip became zero, compared with around 2% of defect generation in conventional production line. Thus, the problem of dross adherence was completely solved.

According to the Best Mode 8, the amount of dross generated during the hot-dip galvanizing on steel strip is reduced, the once-generated dross is prevented from deposition in the plating tank, and the dross is efficiently removed in the dross removing tank placed below the plating tank, thus the quality defects caused from the adhesion of dross to steel strip are reduced. According to the present invention, high quality hot-dip galvanized steel strip can be produced.

The apparatus of the Best Mode 8 is a simple one only dividing the plating vessel into the plating tank and the dross removing tank beneath the plating tank. Accordingly, the apparatus is fabricated at a low investment cost, and solves several problems such as the investment cost problem accompanied with melt transfer to a distant tank, and the problems of solidification and leak of melt.

Since the melt flows with very little flow resistance, there appears very little difference in the level of melt between the plating tank and the dross removing tank. As a result, when the melt returns to the plating tank, no top dross is generated. In addition, the dross in the plating tank is transferred to the dross removing tank without fail even when the line speed is high or low, thus there occurs no problem of dross sedimentation in the plating tank.

According to the apparatus of the Best Mode 8, the necessary zone for sedimenting and removing the dross is narrow, thus the total plating vessel is designed in small size. As a result, an existing apparatus may be modified to readily conduct the present invention.

What is claimed is:

1. An apparatus for hot-dip galvanizing comprising:

a plating vessel which holds a molten metal;

a plating tank which is located at an upper portion of the plating vessel and wherein the hot-dip galvanizing is conducted by immersion of a steel strip thereinto, the plating tank having a first side wall, a bottom wall and a second side wall;

a dross removing tank which is located at a lower portion of the plating vessel and which removes dross from the molten metal, the plating vessel being divided into the plating tank and the dross removing tank by the first side wall, the bottom wall and the second side wall;

a mechanical pump which transfers a molten metal bath in the plating tank to the dross removing tank; and an opening positioned on the plating tank to recycle the molten metal bath from the dross removing tank to the plating tank.

2. The apparatus of claim 1, wherein the mechanical pump has a suction opening to suck the molten metal which is positioned at a bottom center portion of the plating tank.

3. The apparatus of claim 1, further comprising a dissolving means to dissolve a solid phase metal, which is used for plating, in the dross removing tank.

4. The apparatus of claim 1, wherein the opening is positioned so that a supernatant bath after removal of the dross in the dross removing tank is recycled to the plating tank.

5. The apparatus of claim 1, wherein the second side wall is located at an exit side of the steel strip and has a height lower than the surface level of the molten metal bath, and the molten metal bath is recycled from the dross removing tank to the plating tank through the second side wall.

6. The apparatus of claim 1, wherein the plating tank and the dross removing tank satisfy the relationship of $W1 \leqq 10^3$ and $W1 \leqq W2$, wherein W1 is the capacity of the plating tank, and W2 is the capacity of the dross removing tank; and the mechanical pump is able to transfer the molten metal bath at a flow rate in a range of from 1 to 10 $m^3$/hour.

7. The apparatus of claim 1, wherein the first side wall, the second side wall and the bottom wall are allotted so that the distances between the steel strip and the side walls of the plating tank and between the steel strip and the bottom wall of the plating tank are in a range of from 200 to 500 mm.

8. The apparatus of claim 1, wherein the plating tank has a pipe fix to its bottom portion and through the pipe draining draining is conducted.

9. An apparatus for hot-dip galvanizing, comprising:

a plating tank which holds a molten metal;

a separation wall located in the plating tank to divide the plating tank into a plating zone where a steel strip is subjected to hot-dip plating, and a dross removing zone where dross in the molten metal bath is removed;

the dross removing zone comprising a first dross removing zone and a second dross removing zone;

a first mechanical pump which transfers the molten metal bath from the plating zone to the first dross removing zone;

a second mechanical pump which transfers the molten metal bath from the plating zone to the second dross removing zone;

a first weir located to the separation wall to transfer a supernatant bath of the molten metal bath after removal of the dross in the first dross removing zone to the plating zone; and a second weir located to the separation plate to transfer a supernatant bath of the molten metal bath after removal of the dross in the second dross removing zone to the plating zone.

10. An apparatus for hot-dip galvanizing, comprising:

a snout through which a steel strip travels;

a plating vessel which holds a molten metal, said plating vessel having a sink roll to guide the steel strip which travels through the snout;

a plating zone to conduct hot-dip galvanizing by immersion of the steel strip thereinto and a dross removing zone to remove dross from a molten metal bath, said plating zone and said dross removing zone being formed by locating a shielding member to shield a gap formed between a lower portion of the snout beneath the steel strip and an upper portion of a side wall of the plating tank; and a mechanical pump to discharge the molten metal bath from the plating zone to the dross removing zone and also to recycle the molten metal bath from the dross removing zone to the plating zone.

11. The apparatus of claim 10, wherein the plating tank is located so that an upper end of the plating tank is higher than the level of a rotary shaft of the sink roll.

12. An apparatus for hot-dip galvanizing, comprising:

a plating bath tank which holds a hot-dip galvanizing bath containing aluminum at a content of 0.05 wt. % or more;

a snout through which a steel strip immersed in the plating bath tank travels;

a plating tank wherein plating is conducted and a dross removing tank wherein dross is separated by sedimentation of the dross, both of the plating tank and the dross removing tank are formed by locating a separation wall in the plating bath tank;

a snout cleaning device which connects the plating tank and the dross removing tank at directly below the snout and at a part of exit of the steel strip so that a connecting passage has a hydraulic diameter of 0.1 meter or more, the hydraulic diameter being defined by a formula given below, and so that the bath levels of the plating tank and the dross removing tank become equal to each other, the snort cleaning device having a pump to suck the plating bath in the snout from both longitudinal edges of the snout to discharge the sucked bath to a portion where the steel strip does not travel, thus cleaning a plating bath surface in the snout, and to circulate the plating bath between the plating tank and the dross removing tank; wherein the hydraulic diameter is defined as follows:

hydraulic diameter={(cross sectional area of flow passage)/(wet length of flow passage)}×4.

13. The apparatus of claim 12, wherein the capacity of the plating tank is 10 $m^3$ or less and the capacity of the dross removing tank is 10 $m^3$ or more.

* * * * *